US008179413B2

(12) United States Patent
Nomura et al.

(10) Patent No.: US 8,179,413 B2
(45) Date of Patent: May 15, 2012

(54) IMAGE FORMING DEVICE THAT DETECTS A MOVING TIME OF A LATENT IMAGE CARRIER

(75) Inventors: Yujiro Nomura, Shiojiri (JP); Nozomu Inoue, Matsumoto (JP); Kiyoshi Tsujino, Matsumoto (JP); Ryuta Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/014,618

(22) Filed: Jan. 26, 2011

(65) Prior Publication Data

US 2011/0123210 A1 May 26, 2011

Related U.S. Application Data

(62) Division of application No. 12/332,204, filed on Dec. 10, 2008, now abandoned.

(30) Foreign Application Priority Data

Dec. 14, 2007 (JP) ..... 2007-323665
Oct. 14, 2008 (JP) ..... 2008-265034

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/229, 347/233–235, 237, 238, 248–250
See application file for complete search history.

(56) References Cited

U.S. PATENT DOCUMENTS

| | | | | |
|---|---|---|---|---|
| 4,435,064 | A * | 3/1984 | Tsukada et al. | 355/1 |
| 4,723,145 | A * | 2/1988 | Takada et al. | 399/36 |
| 5,444,525 | A | 8/1995 | Takahashi et al. | 399/76 |
| 6,493,010 | B1 | 12/2002 | Takahashi et al. | 347/116 |
| 7,283,149 | B2 * | 10/2007 | Nomura et al. | 347/240 |

FOREIGN PATENT DOCUMENTS

| | | |
|---|---|---|
| JP | 09-081006 | 3/1997 |
| JP | 2004-066758 | 3/2004 |

* cited by examiner

*Primary Examiner* — Hai C Pham
(74) *Attorney, Agent, or Firm* — DLA Piper LLP (US)

(57) ABSTRACT

An image forming device includes: an exposure head having a plurality of light emitting elements arranged in a first direction, a first imaging optical system adapted to image light emitted from the light emitting elements, and a second imaging optical system disposed in a second direction with respect to the first imaging optical system; a latent image carrier movable in the second direction; a detection section adapted to detect a moving time the latent image carrier takes to move from a first position to a second position in the second direction; and a control section adapted to control the time from emission of a first part of the light emitting elements adapted to emit light to be imaged by the first imaging optical system to emission of a second part of the light emitting elements adapted to emit light to be imaged by the second imaging optical system based on the detection result of the detection section, thereby aligning a latent image formed on the latent image carrier by the first imaging optical system and a latent image formed on the latent image carrier by the second imaging optical system in the first direction.

8 Claims, 33 Drawing Sheets

IMAGE FORMING DEVICE THAT DETECTS A MOVING TIME OF A LATENT IMAGE CARRIER

CROSS-REFERENCE TO THE RELATED APPLICATIONS

This application is a divisional of U.S. application Ser. No. 12/332,204, filed on Dec. 10, 2008, and claims the benefit of priority under 35 USC 119 to Japanese Patent Application No. 2007-323665, filed Dec. 14, 2007 and Japanese Patent Application No. 2008-265034, filed Oct. 14, 2008, the entire contents of which are incorporated herein by reference.

BACKGROUND

1. Technical Field

The present invention relates to an image forming device and an image forming method using an exposure head adapted to image a light beam emitted from a light emitting element with an imaging optical system.

2. Related Art

As the exposure head of this kind, there is known a line head adapted to image light beams emitted from a plurality of light emitting elements as a plurality of spots. In the line head (the exposure head in the document) described in JP-A-2004-66758, for example, there are arranged a corresponding number of light emitting elements to one line in a direction corresponding to the main scanning direction, and the light beams emitted from the respective light emitting elements are imaged as spots by a gradient index lens. Then, by sequentially forming a latent image of every line on a surface of a latent image carrier moving in a sub-scanning direction, a two-dimensional latent image corresponding to a desired image can be formed.

Incidentally, in order for achieving latent image formation with higher resolution, it is possible to use a line head having light emitting element groups obtained by grouping a plurality of light emitting elements. Specifically, in this line head, there is formed a plurality of light emitting element group columns, each of which has a plurality of light emitting element groups disposed at positions different from each other in a direction (a width direction) corresponding to a sub-scanning direction, disposed in a direction (a longitudinal direction) corresponding to a main-scanning direction. However, in the line head having a plurality of light emitting element groups disposed at positions different from each other in the width direction as described above, if a moving velocity of the surface of the latent image carrier varies, the position at which the latent image is formed is shifted in the sub-scanning direction, and in some cases, preferable latent image formation is not achievable.

SUMMARY

In view of the problem described above, the invention has an advantage of providing a technology capable of preventing the misalignment of the position at which the latent image is formed caused by the variation in the moving velocity of the surface of the latent image carrier from occurring, thereby achieving preferable latent image formation.

An image forming device according to an aspect of the invention includes an exposure head having a plurality of light emitting elements arranged in a first direction, a first imaging optical system adapted to image light emitted from the light emitting elements, and a second imaging optical system disposed in a second direction with respect to the first imaging optical system, a latent image carrier movable in the second direction, a detection section adapted to detect a moving time the latent image carrier takes to move from a first position to a second position in the second direction, and a control section adapted to control the time from emission of a first part of the light emitting elements adapted to emit light to be imaged by the first imaging optical system to emission of a second part of the light emitting elements adapted to emit light to be imaged by the second imaging optical system based on the detection result of the detection section, thereby aligning a latent image formed on the latent image carrier by the first imaging optical system and a latent image formed on the latent image carrier by the second imaging optical system in the first direction.

Further, an image forming method according to another aspect of the invention includes (a) detecting time a latent image carrier takes to move from a first position to a second position, (b) controlling time from emission of a first light emitting element adapted to emit light to be image by a first imaging optical system to emission of a second light emitting element adapted to emit light to be image by a second imaging optical system based on the detection result in step (a).

These aspects of the invention (the image forming device, the image forming method) configured as described above, detects the time the latent image carrier takes to move from the first position to the second position. Further, the time from emission of a first light emitting element adapted to emit light to be image by a first imaging optical system to emission of a second light emitting element adapted to emit light to be image by a second imaging optical system is controlled based on the detection result described above. Therefore, even in the case in which the variation is caused in the velocity of the latent image carrier in the period from emission of the light emitting elements adapted to emit light to be imaged by the first imaging optical system to emission of the light emitting elements adapted to emit light to be imaged by the second imaging optical system disposed in the second direction from the first imaging optical system, a favorable latent image can be formed.

Further, the control section controls the time from the emission of the first part of the light emitting elements adapted to emit light to be imaged by the first imaging optical system to emission of a third part of the light emitting elements adapted to emit light to be imaged by the first imaging optical system and disposed on the second direction side of the first part of the light emitting elements based on the detection result of the detection section, thereby aligning the latent image formed on the latent image carrier by the first part of the light emitting elements and a latent image formed on the latent image carrier by the third part of the light emitting elements in the first direction. In such a configuration, even in the case in which the variation is caused in the velocity of the latent image carrier in the period from emission of the first light emitting elements adapted to emit light to be imaged by the first imaging optical system to emission of the third light emitting elements adapted to emit light to be imaged by the first imaging optical system and disposed in the second direction side from the first light emitting elements, a favorable latent image can be formed.

Further, the invention is preferably adapted to the image forming device using the photoconductor drum rotating in the second direction as the latent image carrier. In particular, the invention is preferably applied to the image forming device having a drive source and a gear adapted to transmit the driving power from the drive source to the photoconductor drum. In other words, in such a configuration, there are some cases in which the rotational velocity is varied. Therefore, by applying the present invention to the device, a favorable latent image can be formed regardless of the rotational velocity variation.

On this occasion, it is preferable that a distance between the first imaging optical system and the second imaging optical system in the second direction is longer than a distance of the photoconductor drum obtained by multiplying a velocity variation period of the photoconductor drum by an average velocity of the photoconductor drum.

It should be noted that the velocity variation period can easily be obtained from an inverse of a value obtained by multiplying the number of rotations per unit time of the photoconductor drum by the number of teeth of the gear.

It is possible to apply the invention to the image forming device in which the gear is connected to the photoconductor drum via the coupling, or the image forming device in which the gear and the photoconductor drum are connected integrally. In either of the configurations, since there are some cases in which the rotational velocity of the photoconductor drum is varied, it is preferable to realize the preferable latent image formation independently of the rotational velocity variation of the photoconductor drum by applying the invention.

Further, it is also possible that the detection section has an encoder disc with a plurality of slits arranged radially from a rotational axis of the photoconductor drum, and an optical sensor adapted to detect the at least one slit. According to the detection section, the position of the photoconductor drum can be obtained with high accuracy, and it is advantageous to realize the preferable latent image formation.

Further, the detection section can be configured to have two optical sensors disposed on both sides of the rotational center of the photoconductor drum in the radial direction of the photoconductor drum. By disposing the two optical sensors in the radial direction of the photoconductor drum on both sides of the rotational center of the photoconductor drum, it becomes possible to suppress the influence of the eccentricity of the two optical sensors with respect to the rotational center of the photoconductor drum, thus the position of the photoconductor drum can be obtained with good accuracy.

Further, it is also possible to configure that a distance between light beam imaged by the first imaging optical system and light beam imaged by the second imaging optical system in the second direction of the latent image carrier is a value obtained by multiplying a pixel-to-pixel distance in the pixels in the second direction by an integral number. By configuring as described above, the emission timing control of the light emitting elements can be simplified.

It is also possible to configure that the pixel-to-pixel distance in the second direction is shorter than the pixel-to-pixel distance in the first direction in the pixel. By configuring as described above, the latent image formation in the second direction can be executed with high resolution. On this occasion, when the control section controls the emission of the light emitting elements with the PMW control, such latent image formation with high resolution can be achieved with relative ease.

Further, it is possible to configure the image forming device so as to include a latent image carrier, an exposure head a light emitting element, and an imaging optical system adapted to image the light from the light emitting element on the latent image carrier, a detection section adapted to detect a position of the latent image carrier, and a control section controls the emission of the light emitting element based on the detection result of the detection section, thus forming the latent image on the latent image carrier. The image forming device thus configured detects the position of the latent image carrier. Further, the control section controls the emission of the light emitting elements based on the detection result to form the latent image on the latent image carrier. Therefore, even in the case in which the variation is caused in the velocity of the latent image carrier, the latent image can preferably be formed.

An image forming device according to still another aspect of the invention includes a latent image carrier having a surface moving in a second direction one of perpendicular and substantially perpendicular to a first direction, a line head having a head substrate having a plurality of light emitting element groups each including a plurality of light emitting elements as a group disposed on the head substrate, and a lens array having a plurality of imaging optical systems provided respectively to the light emitting element groups and adapted to image the light beams emitted by the light emitting elements of the light emitting element group to form spots on a surface of the latent image carrier, a control section adapted to light the light emitting elements at a timing corresponding to the movement of the surface of the latent image carrier, and a detection section adapted to detect moving velocity of the surface of the latent image carrier, and in the head substrate of the line head, a plurality of light emitting element group columns, each of which has a plurality of light emitting element groups arranged at different positions from each other in the second direction, arranged in the first direction, assuming that the plurality of spots formed when each of the light emitting elements of the light emitting element group emit light beams simultaneously is defined as a spot group, the light emitting element groups of the light emitting element group column forms the spot groups at positions different from each other in the second direction, the control section adjusts the emission timing of the light emitting elements in accordance with the moving velocity of the surface of the latent image carrier detected by the detection section.

Further, a control method of a line head according to still another aspect of the invention includes exposing a latent image carrier surface moving in a second direction perpendicular to or substantially perpendicular to a first direction by making each of light emitting elements of a line head at a predetermined timing, the line head having a head substrate having a plurality of light emitting element groups each having a plurality of light emitting elements as a group arranged thereon, and a lens array having a plurality of imaging optical systems adapted to image light beams emitted by the light emitting elements of the light emitting element group to form spots on a surface of latent image carrier disposed corresponding respectively to the light emitting element groups, and in the head substrate of the line head, a plurality of light emitting element group columns, each of which has a plurality of light emitting element groups arranged at different positions from each other in the second direction, arranged in the first direction, assuming that the plurality of spots formed when each of the light emitting elements of the light emitting element group emit light beams simultaneously is defined as a spot group, the light emitting element groups of the light emitting element group column forms the spot groups at positions different from each other in the second direction, and in the exposing step, the moving velocity of the latent image carrier surface is detected, and the emission timing of the light emitting elements is adjusted based on the detection result.

In these aspects of the invention (the image forming device, the control method of a line head) configured as described above, the moving velocity of the latent image carrier surface is detected, and at the same time, the emission timing is adjusted based on the detection result. Therefore, it becomes possible to prevent the shift of the latent image formation position caused by the variation in the moving velocity of the surface of the latent image carrier from occurring, thus the preferable latent image formation becomes possible.

Further, the control section can be configured to adjust the emission timing of the light emitting elements in accordance with the difference between the moving velocity of the latent image carrier surface and the reference velocity. In such a configuration, since the emission timing of the light emitting elements is adjusted based on the shift of the moving velocity of the surface of the latent image carrier from the reference velocity, it becomes possible to efficiently prevent the shift of the latent image formation position, thus the preferable latent image formation becomes possible.

Further, the reference velocity can be an average value of the moving velocity of the surface of the latent image carrier. In such a configuration, since the emission timing of the light emitting elements is adjusted based on the shift of the moving velocity of the surface of the latent image carrier from the average value, it becomes possible to efficiently prevent the shift of the latent image formation position, thus the preferable latent image formation becomes possible.

Further, it is particularly preferable to apply the invention to the image forming device using the photoconductor drum rotating around the rotating shaft perpendicular to or substantially perpendicular to the second direction as the latent image carrier, and the circumferential surface of the photoconductor drum moves in the second direction as the latent image carrier surface. The reason therefor is that there are some cases in which the variation in the rotational velocity occurs in the photoconductor drum, and the variation in the rotational velocity causes the variation of the moving velocity of the circumferential surface of the photoconductor drum as the latent image carrier surface. Therefore, it is preferable to apply the invention to such an image forming device to prevent the shift of the latent image formation position caused by the variation in the moving velocity of the surface of the latent image carrier from occurring.

Further, it is possible that the detection section has a encoder disc having a plurality of slits disposed radially from the rotating shaft of the photoconductor drum, and an optical sensor adapted to detect the slit, and is configured to detect the moving velocity of the circumferential surface of the photoconductor drum based on the detection result of the optical sensor. According to such a configuration, the detection of the moving velocity of the circumferential surface of the photoconductor drum is executed based on the plurality of slits disposed radially from the rotating shaft of the photoconductor drum. Therefore, it becomes possible to detect the moving velocity of the circumferential surface of the photoconductor drum with high accuracy.

Further, the detection section can be configured to have two optical sensors disposed on both sides of the rotating shaft of the photoconductor drum. In such a configuration, the two optical sensors are provided. Further, the two optical sensors are disposed on both sides of the rotating shaft of the photoconductor drum. Therefore, as described later, even in the case in which the two optical sensors are disposed eccentrically with respect to the rotating shaft, it is possible to prevent the influence of the eccentricity, and to preferably detect the moving velocity.

Further, the control section makes the light emitting elements emit light at the timing corresponding to the movement of the latent image carrier surface to form the spots to the pixels of the latent image carrier surface, and further, it is possible to configure that the pitch of a plurality of spot groups formed by the light emitting element group columns in the second direction is a value obtained by multiplying the pixel pitch in the second direction by an integral number. The reason therefor is that as described later, by adopting such a configuration, it becomes possible to simplify the emission timing control of the light emitting elements.

BRIEF DESCRIPTION OF THE DRAWINGS

The invention will now be described with reference to the accompanying drawings, wherein like numbers reference like elements.

DESCRIPTION OF EXEMPLARY EMBODIMENTS

A. Explanations of Terms

Before explaining embodiments of the invention, the terms used in the present specification will be explained.

Figure 1:
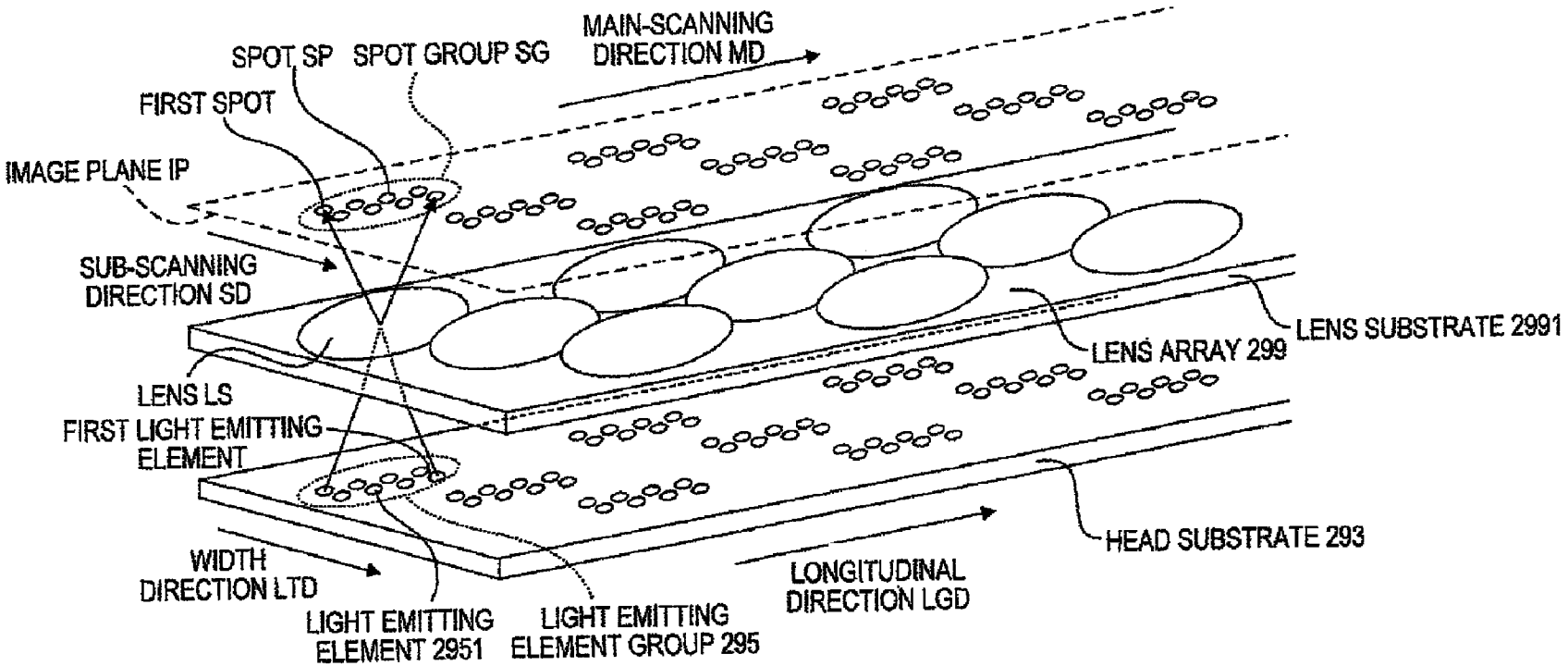
FIG. 1 is a diagram for explaining terms used in the present specification.
Figure 2:
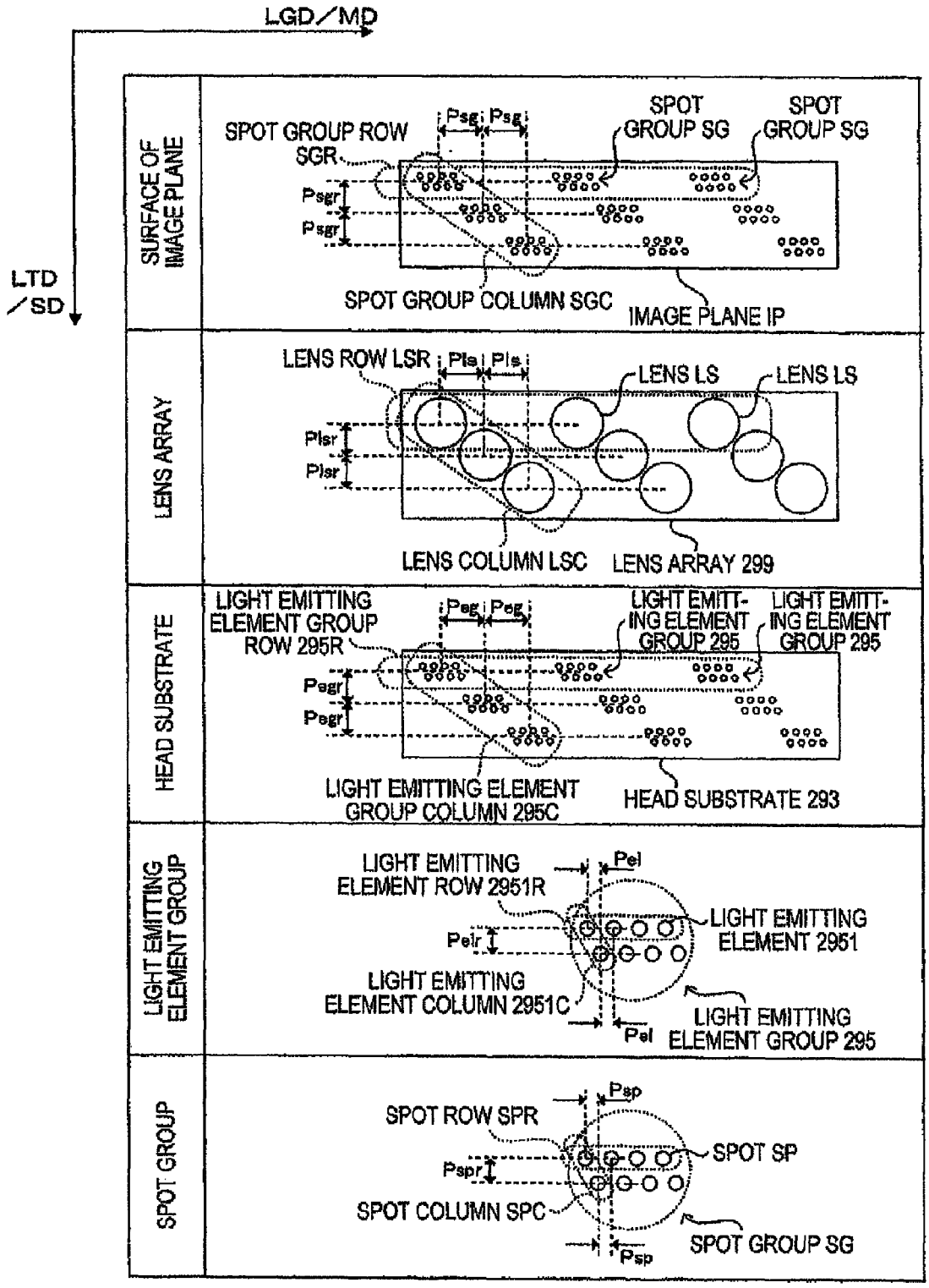
FIG. 2 is a diagram for explaining terms used in the present specification.

FIGS. 1 and 2 are diagrams for explaining the terms used in the present specification. The terms used in the present specification will hereinafter be organized with reference to these drawings. In the present specification, a conveying direction on a surface (image plane IP) of a photoconductor drum 21 is defined as a sub-scanning direction SD, and a direction perpendicular to or substantially perpendicular to the sub-scanning direction SD is defined as a main-scanning direction MD. Further, a line head 29 is disposed facing to the surface (the image plane IP) of the photoconductor drum 21 so that a longitudinal direction LGD thereof corresponds to the main-scanning direction MD, and a width direction LTD corresponds to the sub-scanning direction SD.

An aggregate of a plurality (eight in FIGS. 1 and 2) of light emitting elements 2951, which is disposed on a head substrate 293 in one-to-one correspondence with each of lenses LS included in a lens array 299, is defined as a light emitting element group 295. In other words, the light emitting element group 295 formed of a plurality of light emitting elements 2951 is disposed on the head substrate 293 corresponding to each of the plurality of lenses LS. Further, an aggregate of a plurality of spots SP formed on the image plane IP by imaging the light beams from the light emitting element group 295 on the image plane IP by the lens LS corresponding to the light emitting element group 295 is defined as a spot group SG. In other words, a plurality of spot groups SG can be formed in one-to-one correspondence with a plurality of light emitting groups 295. Further, the spot located uppermost stream in both the main-scanning direction MD and the sub-scanning direction SD in each of the spot groups SG is specifically defined as the first spot. Further, the light emitting element 2951 corresponding to the first spot is specifically defined as the first light emitting element.

Further, spot group row SGR and spot group column SGC are defined as shown in the "SURFACE OF IMAGE PLANE" section in FIG. 2. In other words, a plurality of spot groups SG arranged in the main-scanning direction MD is defined as a spot group row SGR. Further, a plurality of spot group rows SGR is arranged side by side in the sub-scanning direction SD at a predetermined spot group row pitch Psgr. Further, a plurality (three in the drawing) of spot groups SG arranged consecutively at a pitch having a component of the sub-scanning direction SD equal to the spot group row pitch Psgr and a component of the main-scanning direction MD equal to a spot group pitch Psg is defined as a spot group column SGC. It should be noted that the spot group row pitch Psgr is a distance in the sub-scanning direction SD between the geometric centroids of the respective two spot group rows SGR adjacent to each other in the sub-scanning direction SD. Further, the spot group pitch Psg is a distance in the main-scanning direction MD between the geometric centroids of the respective two spot groups SG adjacent to each other in the main-scanning direction MD.

Lens row LSR and lens column LSC are defined as shown in the "LENS ARRAY" section in the drawing. Specifically, a plurality of lenses LS arranged in the longitudinal direction LGD is defined as the lens row LSR. Further, a plurality of lens rows LSR is arranged side by side in the width direction LTD at a predetermined lens row pitch Plsr. Further, a plurality (three in the drawing) of lenses LS arranged consecutively at a pitch having a component of the width direction LTD equal to the lens row pitch Plsr and a component of the longitudinal direction LGD equal to a lens pitch Pls is defined as a lens column LSC. It should be noted that the lens row pitch Plsr is a distance in the width direction LTD between the geometric centroids of the respective two lens rows LSR adjacent to each other in the width direction LTD. Further, the lens pitch Pls is a distance in the longitudinal direction LGD between the geometric centroids of the respective two lens LS adjacent to each other in the longitudinal direction LGD.

Light emitting element group row 295R and light emitting element group column 295C are defined as shown in the "HEAD SUBSTRATE" section in the drawing. Specifically, a plurality of light emitting element groups 295 arranged in the longitudinal direction LGD is defined as the light emitting element group row 295R. Further, a plurality of light emitting group rows 295R is arranged side by side in the width direction LTD at a predetermined light emitting element group row pitch Pegr. Further, a plurality (three in the drawing) of light emitting element groups arranged consecutively at a pitch having a component of the width direction LTD equal to the light emitting element group row pitch Pegr and a component of the longitudinal direction LGD equal to a light emitting element group pitch Peg is defined as a light emitting element group column 295C. It should be noted that the light emitting element group row pitch Pegr is a distance in the width direction LTD between the geometric centroids of the respective two light emitting element group rows 295R adjacent to each other in the width direction LTD. Further, the light emitting element group pitch Peg is a distance in the longitudinal direction LCD between the geometric centroids of the respective two light emitting element groups 295 adjacent to each other in the longitudinal direction LCD.

Light emitting element row 2951R and light emitting element column 2951C are defined as shown in the "LIGHT EMITTING ELEMENT GROUP" section in the drawing. Specifically, in each of the light emitting element groups 295, a plurality of light emitting elements 2951 arranged in the longitudinal direction LGD is defined as the light emitting element group row 2951R. Further, a plurality of light emitting element rows 2951R is arranged side by side in the width direction LTD at a predetermined light emitting element row pitch Pelr. Further, a plurality (two in the drawing) of light emitting elements 2951 arranged consecutively at a pitch having a component of the width direction LTD equal to the light emitting element row pitch Pelr and a component of the longitudinal direction LCD equal to a light emitting element pitch Pel is defined as a light emitting element column 2951C. It should be noted that the light emitting element row pitch Pelr is a distance in the width direction LTD between the geometric centroids of the respective two light emitting element rows 2951R adjacent to each other in the width direction LTD. Further, the light emitting element pitch Pel is a distance in the longitudinal direction LGD between the geometric centroids of the respective two light emitting elements 2951 adjacent to each other in the longitudinal direction LGD.

Spot row SPR and spot column SPC are defined as shown in the "SPOT GROUP" section in the drawing. Specifically, in each of the spot groups SG, a plurality of spots SP arranged in the longitudinal direction LGD is defined as the spot row SPR. Further, a plurality of spot rows SPR is arranged side by side in the width direction LTD at a predetermined spot row pitch Pspr. Further, a plurality (two in the drawing) of spots SP arranged consecutively at a pitch having a component of the width direction LTD equal to the spot row pitch Pspr and a component of the longitudinal direction LGD equal to a spot pitch Psp is defined as a spot column SPC. It should be noted that the spot row pitch Pspr is a distance in the sub-scanning direction SD between the geometric centroids of the respective two spot rows SPR adjacent to each other in the sub-scanning direction SD. Further, the spot pitch Psp is a distance in the longitudinal direction LGD between the geometric centroids of the respective two spots SP adjacent to each other in the main-scanning direction MD.

B. First Embodiment

Figure 3:
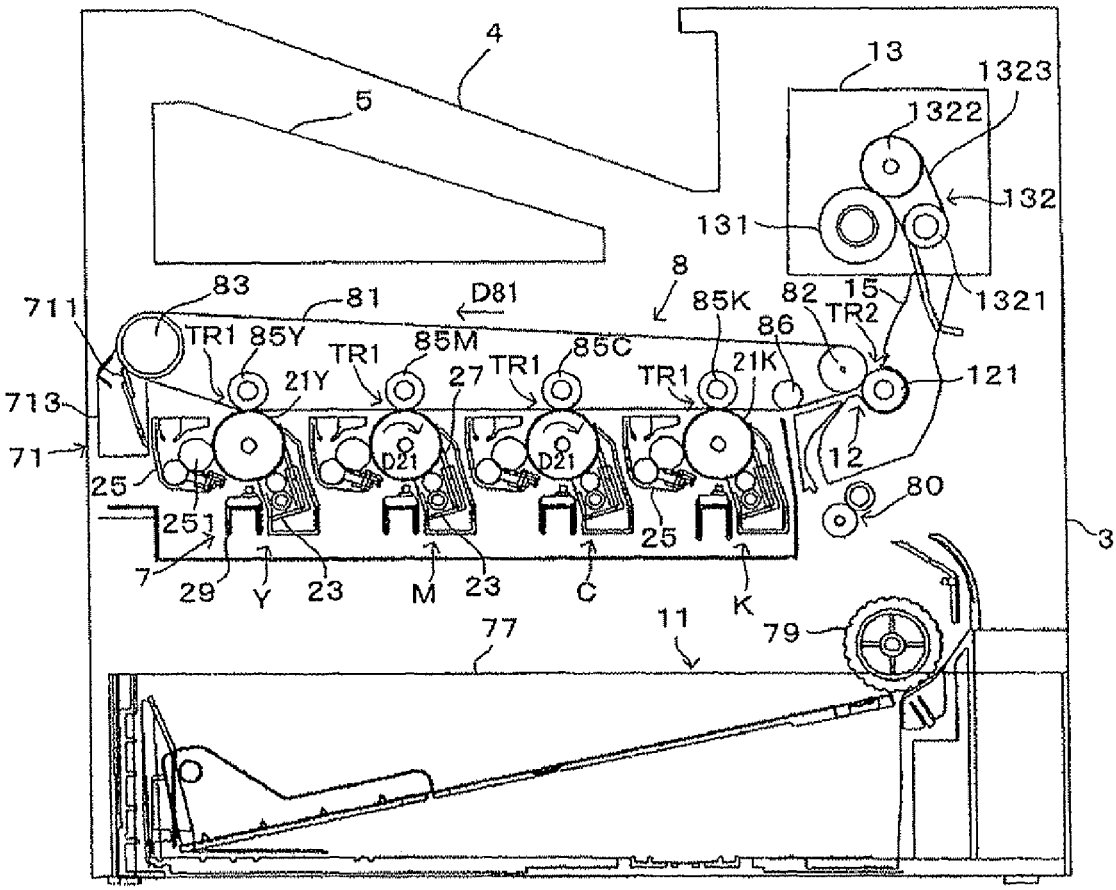
FIG. 3 is a diagram showing an example of an image forming device according to an embodiment of the invention.
Figure 4:
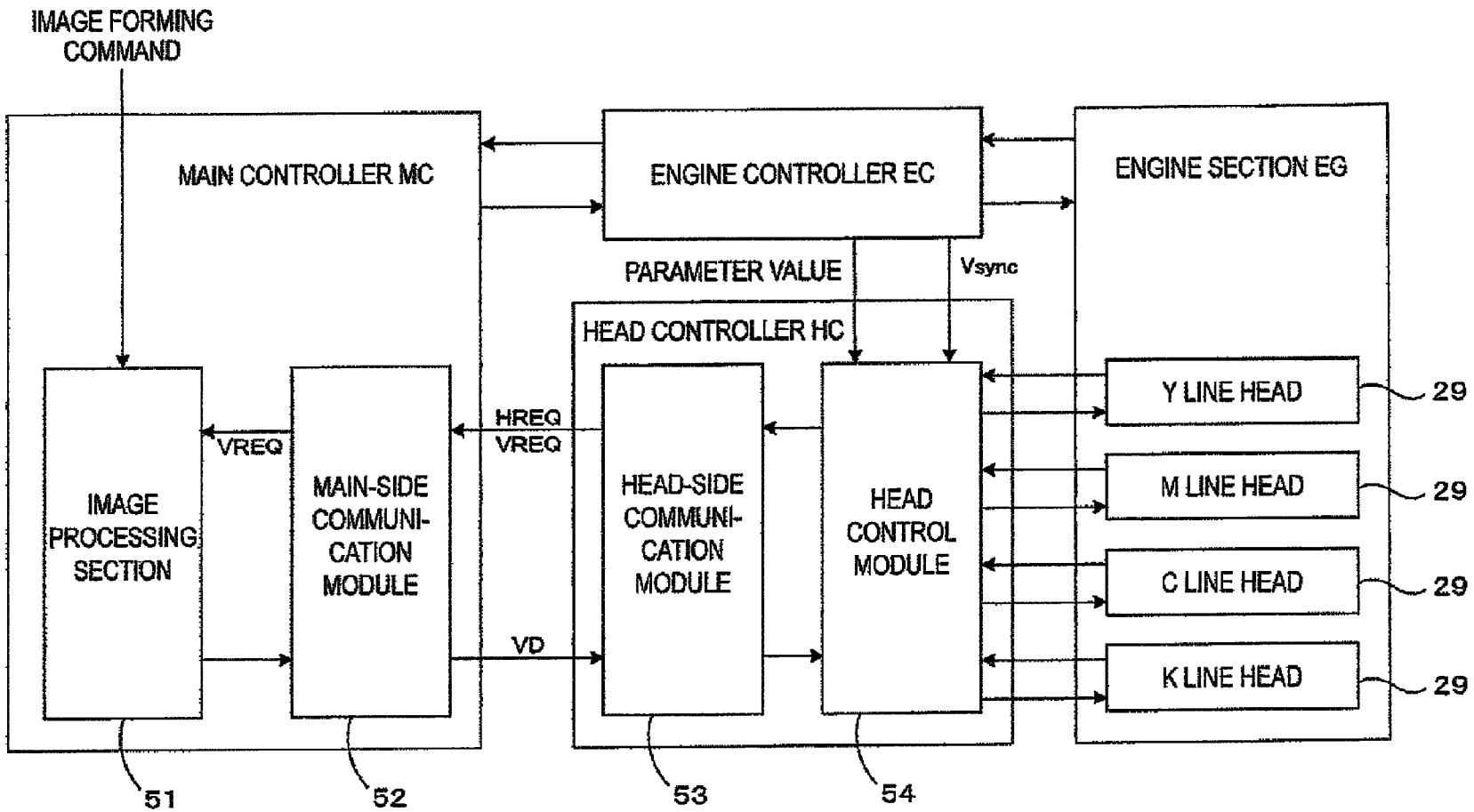
FIG. 4 is a diagram showing an electrical configuration of the image forming device shown in FIG. 3.

FIG. 3 is a diagram showing an example of an image forming device to which the invention can be applied. Further, FIG. 4 is a diagram showing an electrical configuration of the image forming device shown in FIG. 3. The device is an image forming device capable of selectively performing a color mode in which a color image is formed by overlapping four colors of toners of black (K), cyan (C), magenta (M), and yellow (Y), and a monochrome mode in which a monochrome image is formed using only the black (K) toner. It should be noted that FIG. 3 is a drawing corresponding to a state when performing the color mode. In the present image forming device, when an image formation command is provided to a main controller MC having a CPU, a memory, and so on from an external device such as a host computer, the main controller MC provides an engine controller EC with a control signal and so on, and a head controller HC with the video data VD corresponding to the image formation command. Further, the head controller HC controls line heads 29 in charge of respective colors based on the video data VD from the main controller MC and a vertical sync signal Vsync and parameter values from the engine controller EC. Thus, an engine section EG performs a prescribed image forming operation, thereby forming an image corresponding to the image formation command on a sheet such as copy paper, transfer paper, a form, or an OHP transparent sheet.

Inside a main housing 3 provided to the image forming device, there is disposed an electric component box 5 housing a power supply circuit board, the main controller MC, the engine controller EC, and the head controller HC. Further, an image forming unit 7, a transfer belt unit 8, and a paper feed unit 11 are also disposed inside the main housing 3. Further, inside the main housing 3 and on the right side thereof in FIG. 3, there are disposed a secondary transfer unit 12, a fixing unit 13, and a sheet guide member 15. It should be noted that the paper feed unit 11 is configured so as to be detachably mounted to a main body 1 of the device. Further, it is arranged that the paper feed unit 11 and the transfer belt unit 8 can separately be detached from the main body to be repaired or replaced.

The image forming unit 7 is provided with four image forming stations Y (for yellow), M (for magenta), C (for cyan), and K (for black) for forming images with plural colors different from each other. Further, each of the image forming stations Y, M, C, and K is provided with a cylindrical photoconductor drum 21 having a surface (a circumferential surface) with a predetermined length in the main-scanning direction MD. Further, each of the image forming stations Y, M, C, and K forms a toner image of the corresponding color on the surface of the photoconductor drum 21. The photoconductor drum is disposed so as to have the axial direction thereof substantially parallel to the main-scanning direction MD. Further, each of the photoconductor drums 21 is connected to a dedicated drive motor, and is driven to rotate at a predetermined velocity in a direction of the arrow D21 in the drawing. Thus, the surface, of the photoconductor drum 21 is moved in the sub-scanning direction SD perpendicular to or substantially perpendicular to the main-scanning direction MD. Further, around the photoconductor drum 21, there are disposed along the rotational direction, a charging section 23, the line head 29, a developing section 25, and a photoconductor cleaner 27. Further, a charging operation, a latent image forming operation, and a toner developing operation are executed by these functional sections. Therefore, when executing the color mode, the toner images respectively formed by all of the image forming stations Y, M, C, and K are overlapped on a transfer belt 81 provided to a transfer belt unit 8 to form a color image, and when executing the monochrome mode, a monochrome image is formed using only the toner image formed by the image forming station K. It should be noted that in FIG. 3, since the image forming stations in the image forming unit 7 have the same configurations as each other, the reference numerals are only provided to some of the image forming stations, and are omitted in the rest of the image forming stations only for the sake of convenience of illustration.

The charging section 23 is provided with a charging roller having a surface made of elastic rubber. The charging roller is configured so as to be rotated by the contact with the surface of the photoconductor drum 21 at a charging position, and is rotated in association with the rotational operation of the photoconductor drum 21 in a driven direction with respect to the photoconductor drum 21 at a circumferential velocity. Further, the charging roller is connected to a charging bias generating section (not shown), accepts the power supply for the charging bias from the charging bias generating section, and charges the surface of the photoconductor drum 21 at the charging position where the charging section 23 and the photoconductor drum 21 have contact with each other.

The line head 29 is disposed corresponding to the photoconductor drum 21 so that the longitudinal direction thereof corresponds to the main-scanning direction MD and the width direction thereof corresponds to the sub-scanning direction SD, and the longitudinal direction of the line head 29 is arranged to be substantially parallel to the main-scanning direction MD. The line head 29 is provided with a plurality of light emitting elements arranged in the longitudinal direction, and is disposed separately from the photoconductor drum 21. Further, these light emitting elements emit light onto the surface of the photoconductor drum 21 charged by the charging section 23, thereby forming an electrostatic latent image on the surface thereof (an exposure process).

The developing section 25 has a developing roller 251 with a surface holding the toner. Further, the charged toner is moved to the photoconductor drum 21 from the developing roller 251 by a developing bias applied to the developing roller 251 from a developing bias generating section (not shown) electrically connected to the developing roller 251 at the developing position where the developing roller 251 and the photoconductor drum 21 have contact with each other, thereby making the electrostatic latent image formed by the line head 29 visible.

The toner image thus made visible at the developing position is fed in the rotational direction D21 of the photoconductor drum 21, and then primary-transferred to the transfer belt 81 described in detail later at a primary transfer position TR1 at which the transfer belt 81 and each of the photoconductor drums 21 have contact with each other.

Further, in the present embodiment, the photoconductor cleaner 27 is disposed downstream of the primary transfer position TR1 and upstream of the charging section 23 in the rotational direction D21 of the photoconductor drum 21 so as to have contact with the surface of the photoconductor drum 21. The photoconductor cleaner 27 remove the residual toner on the surface of the photoconductor drum 21 after the primary transfer to clean the surface thereof by having contact with the surface of the photoconductor drum 21.

The transfer belt unit 8 is provided with a drive roller 82, a driven roller 83 (hereinafter also referred to as a blade-opposed roller 83) disposed on the left of the drive roller 82 in FIG. 3, and the transfer belt 81 stretched across these rollers and circularly driven in the direction (a feeding direction) of the arrow D81 shown in the drawing. Further, the transfer belt unit 8 is provided with four primary transfer rollers 85Y, 85M, 85C, and 85K disposed inside the transfer belt 81 respectively opposed one-on-one to the photoconductor drums 21 included in the image forming stations Y, M, C, and K when the photoconductor cartridges are mounted. These primary transfer rollers 85 are electrically connected to respective primary transfer bias generating sections (not shown). Further, as described later in detail, when executing the color mode, all of the primary transfer rollers 85Y, 85M, 85C, and 85K are positioned on the side of the image forming stations Y, M, C, and K as shown in FIG. 3 to press the transfer belt 81 against the photoconductor drums 21 included in the respective image forming stations Y, M, C, and K, thereby forming the primary transfer position TR1 between each of the photoconductor drums 21 and the transfer belt 81. Then, by applying the primary transfer bias to the primary transfer rollers 85 from the primary transfer bias generating section with appropriate timing, the toner images formed on the surfaces of the photoconductor drums 21 are transferred to the surface of the transfer belt 81 at the respective primary transfer positions TR1 to form a color image.

On the other hand, when executing the monochrome mode, the primary transfer rollers 85Y, 85M, and 85C for color printing out of the four primary transfer rollers 85 are separated from the image forming stations Y, M, and C respectively opposed thereto, while only the primary transfer roller 85K mainly for monochrome printing is pressed against the image forming station K, thus making only the image forming station K mainly for monochrome printing have contact with the transfer belt 81. As a result, the primary transfer position TR1 is formed only between the primary transfer roller 85K mainly for monochrome printing and the corresponding image forming station K. Then, by applying the primary transfer bias to the primary transfer roller 85K mainly for monochrome printing from the primary transfer bias generating section with appropriate timing, the toner image formed on the surface of the photoconductor drum 21 is transferred to the surface of the transfer belt 81 at the primary transfer position TR1 to form a monochrome image.

Further, the transfer belt unit 8 is provided with a downstream guide roller 86 disposed on the downstream side of the primary transfer roller 85K mainly for monochrome printing and on the upstream side of the drive roller 82. Further, the downstream guide roller 86 is arranged to have contact with the transfer belt 81 on a common internal tangent of the primary transfer roller 85K and the photoconductor drum 21 at the primary transfer position TR1 formed by the primary transfer roller 85K mainly for monochrome printing having contact with the photoconductor drum 21 of the image forming station K.

The drive roller 82 circularly drives the transfer belt 81 in the direction of the arrow D81 shown in the drawing, and at the same time functions as a backup roller of a secondary transfer roller 121. On the peripheral surface of the drive roller 82, there is formed a rubber layer with a thickness of about 3 mm and a volume resistivity of no greater than 1000 kΩ·cm, which, when grounded via a metal shaft, serves as a conducting path for a secondary transfer bias supplied from a secondary transfer bias generating section not shown via the secondary transfer roller 121. By thus providing the rubber layer having an abrasion resistance and a shock absorbing property to the drive roller 82, the impact caused by a sheet entering the contact section (a secondary transfer position TR2) between the drive roller 82 and the secondary transfer roller 121 is hardly transmitted to the transfer belt 81, thus the degradation of the image quality can be prevented.

The paper feed unit 11 is provided with a paper feed section including a paper feed cassette 77 capable of holding a stack of sheets and a pickup roller 79 for feeding the sheet one-by-one from the paper feed cassette 77. The sheet fed by the pickup roller 79 from the paper feed section is fed to the secondary transfer position TR2 along the sheet guide member 15 after the feed timing thereof is adjusted by a pair of resist rollers 80.

The secondary transfer roller 121 is provided so as to be able to be selectively contacted with and separated from the transfer belt 81, and is driven to be selectively contacted with and separated from the transfer belt 81 by a secondary transfer roller drive mechanism (not shown). The fixing unit 13 has a rotatable heating roller 131 having a heater such as a halogen heater built-in and a pressing section 132 for biasing the heating roller 131 to be pressed against an object. Then, the sheet with the image, which is secondary-transferred on the surface thereof, is guided by the sheet guide member 15 to a nipping section formed of the heating roller 131 and a pressing belt 1323 of the pressing section 132, and the image is thermally fixed in the nipping section at predetermined temperature. The pressing section 132 is composed of two rollers 1321, 1322 and the pressing belt 1323 stretched across the two rollers. Further, it is arranged that by pressing a tensioned part of the surface of the pressing belt 1323, which is stretched by the two rollers 1321 and 1322, against the peripheral surface of the heating roller 131, a large nipping section can be formed between the heating roller 131 and the pressing belt 1323. Further, the sheet on which the fixing process is thus executed is fed to a paper catch tray 4 disposed on an upper surface of the main housing 3.

Further, in the present device, a cleaner section 71 is disposed facing the blade-opposed roller 83. The cleaner section 71 has a cleaner blade 711 and a waste toner box 713. The cleaner blade 711 removes foreign matters such as the toner remaining on the transfer belt 81 after the secondary transfer process or paper dust by pressing a tip section thereof against the blade-opposed roller 83 via the transfer belt 81. Then the foreign matters thus removed are collected into the waste toner box 713. Further, the cleaner blade 711 and the waste toner box 713 are configured integrally with the blade-opposed roller 83. Therefore, as described below, when the blade-opposed roller 83 moves, the cleaner blade 711 and the waste toner box 713 should also move together with the blade-opposed roller 83.

Figure 5:
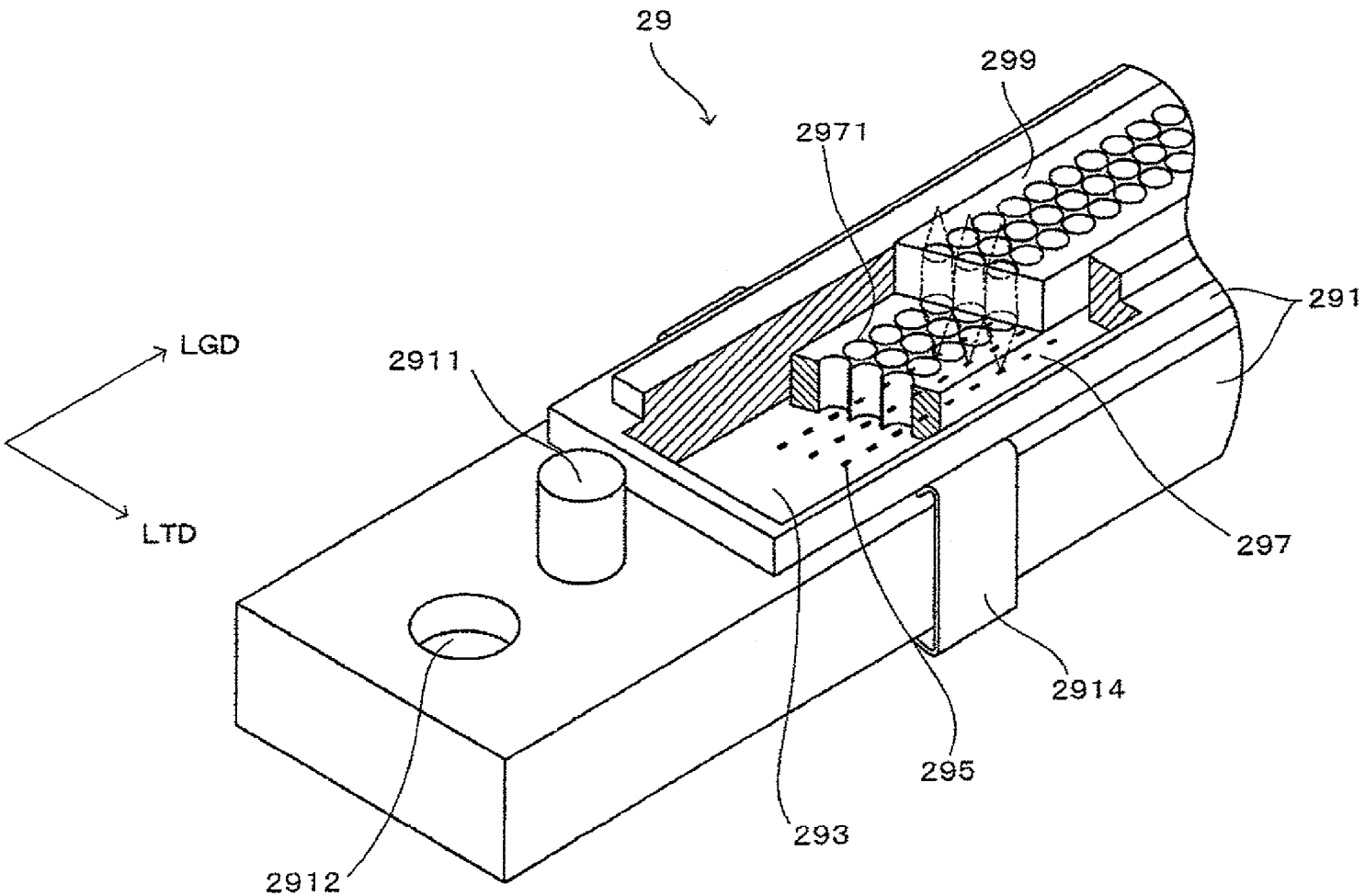
FIG. 5 is a perspective view schematically showing a line head according to the embodiment of the invention.
Figure 6:
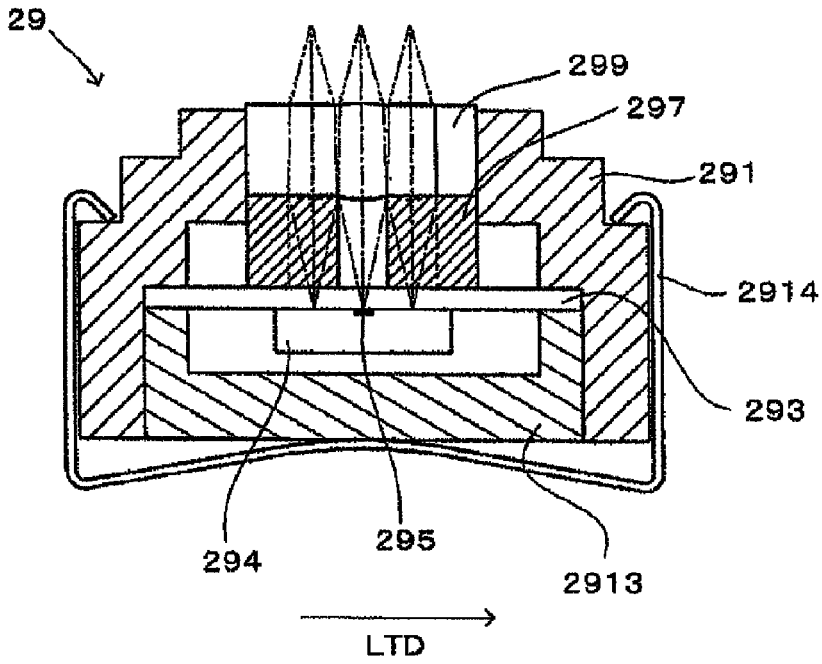
FIG. 6 is a cross-sectional view of the line head shown in FIG. 5 along the width direction.

FIG. 5 is a perspective view schematically showing a line head according to a first embodiment. Further, FIG. 6 is a cross-sectional view of the line head shown in FIG. 5 along the width direction. As described above, the line head 29 is disposed corresponding to the photoconductor drum 21 so as to have the longitudinal direction LGD thereof correspond to the main-scanning direction MD, and the width direction LTD thereof correspond to the sub-scanning direction SD. It should be noted that the longitudinal direction LGD and the width direction LTD thereof are substantially perpendicular to each other. The line head 29 in the present embodiment is provided with a case 291, and each end of longitudinal direction of the case 291 is provided with a positioning pin 2911 and a screw hole 2912. Further, by fitting the positioning pin 2911 into a positioning hole (not shown) provided to a photoconductor cover (not shown) covering the photoconductor drum 21 and positioned with respect to the photoconductor drum 21, the line head 29 is positioned with respect to the photoconductor drum 21. Further, setscrews are screwed in and fixed to the screw holes (not shown) of the photoconductor cover via the screw holes 2912, thereby positioning and fixing the line head 29 to the photoconductor drum 21.

The case 291 holds a lens array 299 at a position opposed to the surface of the photoconductor drum 21, and is provided with a light shielding member 297 and a head substrate 293 disposed inside thereof in this order from the lens array 299. The head substrate 293 is made of a material (e.g., glass) capable of transmitting a light beam. Further, on the reverse surface (the opposite surface to the surface with the lens array 299 out of the two surfaces provided to the head substrate 293) of the head substrate 293, there is disposed a plurality of bottom emission type, organic Electro-Luminescence (EL) elements as the light emitting elements 2951. As described later, the plurality of light emitting elements 2951 is divided into light emitting element groups 295 and separately disposed as groups. Further, the light beams emitted from each of the light emitting element groups 295 penetrate the head substrate 293 from the reverse side to the obverse side thereof and proceed towards the light shielding member 297.

The light shielding member 297 is provided with a plurality of light guide holes 2971 penetrating the light shielding member corresponding one-on-one to the plurality of light emitting element groups 295. Further, such a light guide hole 2971 is provided as a substantially cylindrical hole penetrating the light shielding member 297 along a line parallel to the normal line of the head substrate 293 as the center axis thereof. Therefore, the light beams proceeding towards other areas than the light guide holes 2971 corresponding to the light emitting element group 295 out of the light beams emitted from the light emitting element group 295 are shielded by the light shielding member 297. Thus, all of the light beams emitted from the same light emitting element group 295 proceed towards the lens array 299 via the same light guide hole 2971, and the interference between the light beams emitted from different light emitting element groups 295 can be prevented by the light shielding member 297. Further, the light beams passing through the light guide hole 2971 provided to the light shielding member 297 are each imaged by the lens array 299 on the surface of the photoconductor drum 21 as a spot.

As shown in FIG. 6, a retainer 2914 presses a back lid 2913 against the case 291 via the head substrate 293. Specifically, the retainer 2914 has elastic force for pressing the back lid 2913 towards the case 291, and seals the inside of the case 291 light-tightly (in other words, so that light does not leak from the inside of the case 291 and that light does not enter from the outside of the case 291) by pressing the back lid with such elastic force. It should be noted that the retainer 2914 is disposed in each of a plurality of positions in the longitudinal direction of the case 291. Further, the light emitting element groups 295 are covered by a seal member 294.

Figure 7:
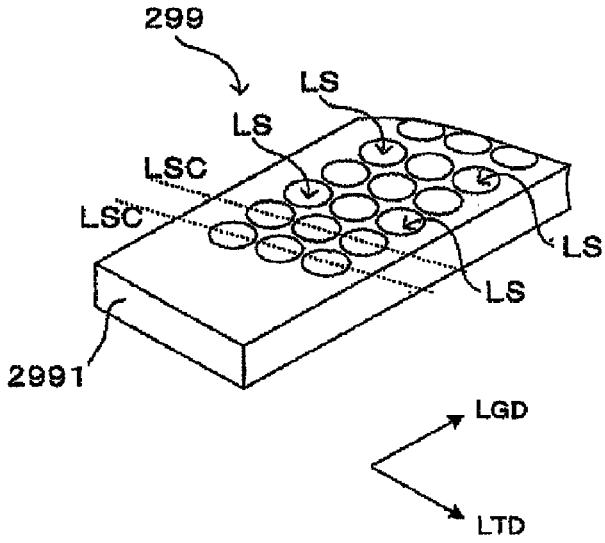
FIG. 7 is a perspective view schematically showing a lens array.
Figure 8:
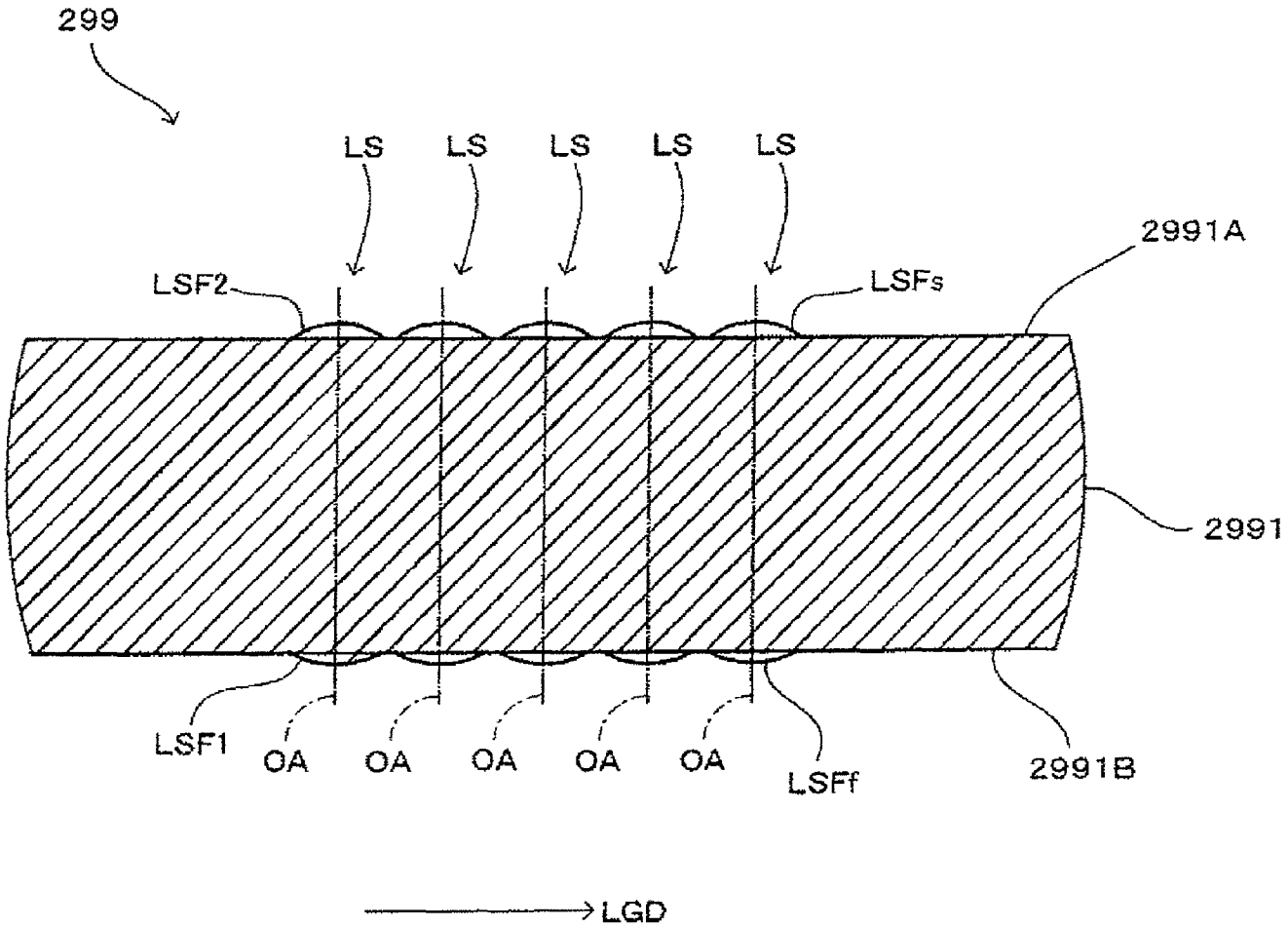
FIG. 8 is a cross-sectional view of the lens array along the longitudinal direction LGD.

FIG. 7 is a perspective view schematically showing the lens array. Further, FIG. 8 is a cross-sectional view of the lens array in the longitudinal direction LGD. The lens array 299 has a lens substrate 2991. Further, a first surface LSFf of the lens LS is formed on the reverse surface 2991B of the lens substrate 2991, and the second surface LSFs of the lens LS is formed on the obverse surface 2991A of the lens substrate 2991. Further, the first surface LSFf and the second surface LSFs of the lens opposed to each other, and the lens substrate 2991 held between the two surfaces function as one lens LS. It should be noted that the first surface LSFf and the second surface LSFs of the lens LS can be formed from resin, for example.

The lens array 299 has a plurality of lenses LS arranged so as to have the respective optical axes OA substantially parallel to each other. Further, the lens array 299 is disposed so that the optical axes OA of the respective lenses LS are substantially perpendicular to the reverse surface (the surface on which the light emitting elements 2951 are disposed) of the head substrate 293. The lenses LS are disposed corresponding one-on-one to the light emitting element groups 295, and arranged two-dimensionally corresponding to the arrangement of the light emitting groups 295 described later. Specifically, a plurality of lens columns LSC composed of three lenses LS disposed at different positions from each other in the width direction LTD is arranged in the longitudinal direction LGD.

Figure 9:
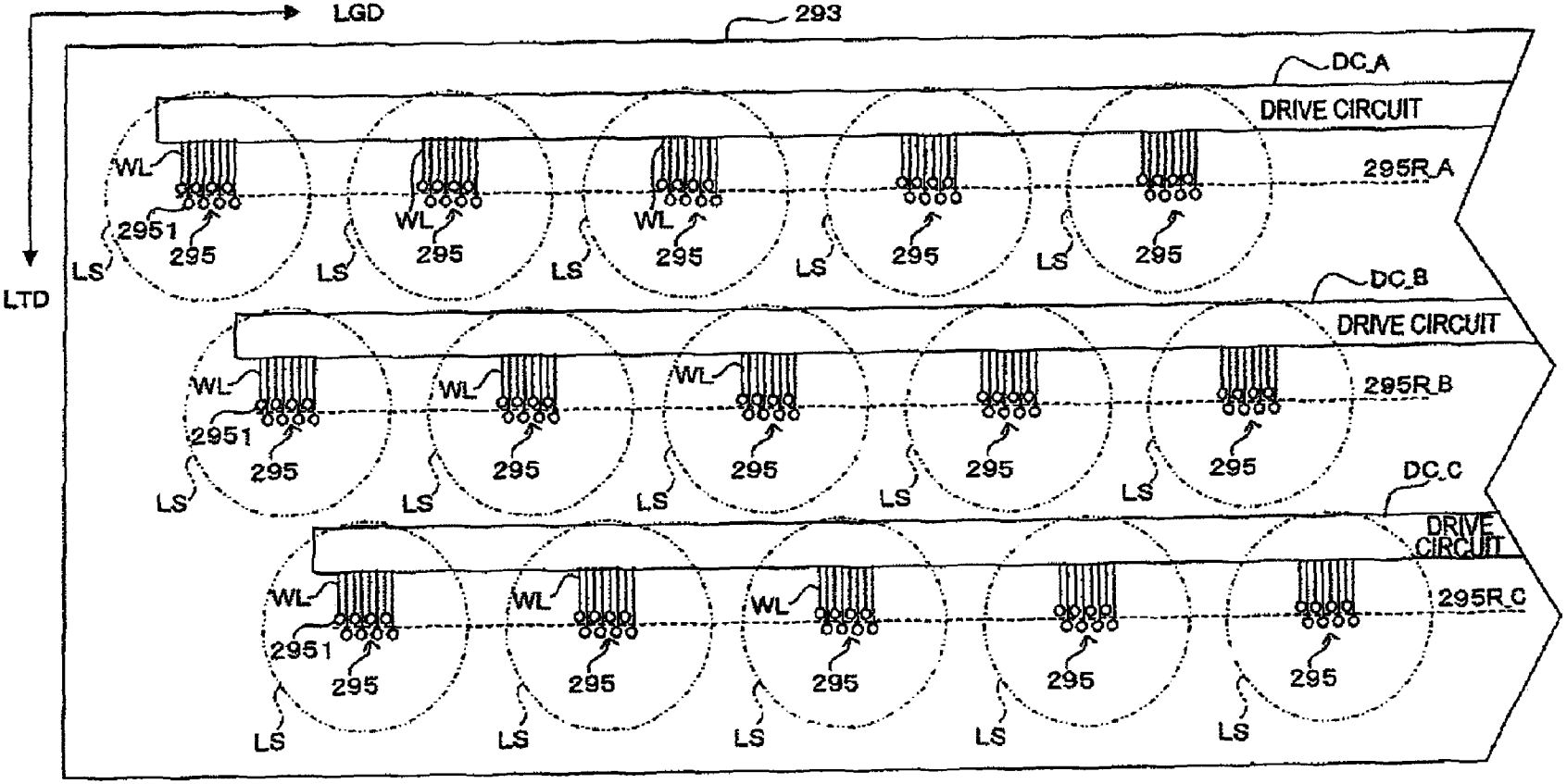
FIG. 9 is a diagram showing a configuration of the reverse side of a head substrate.
Figure 10:
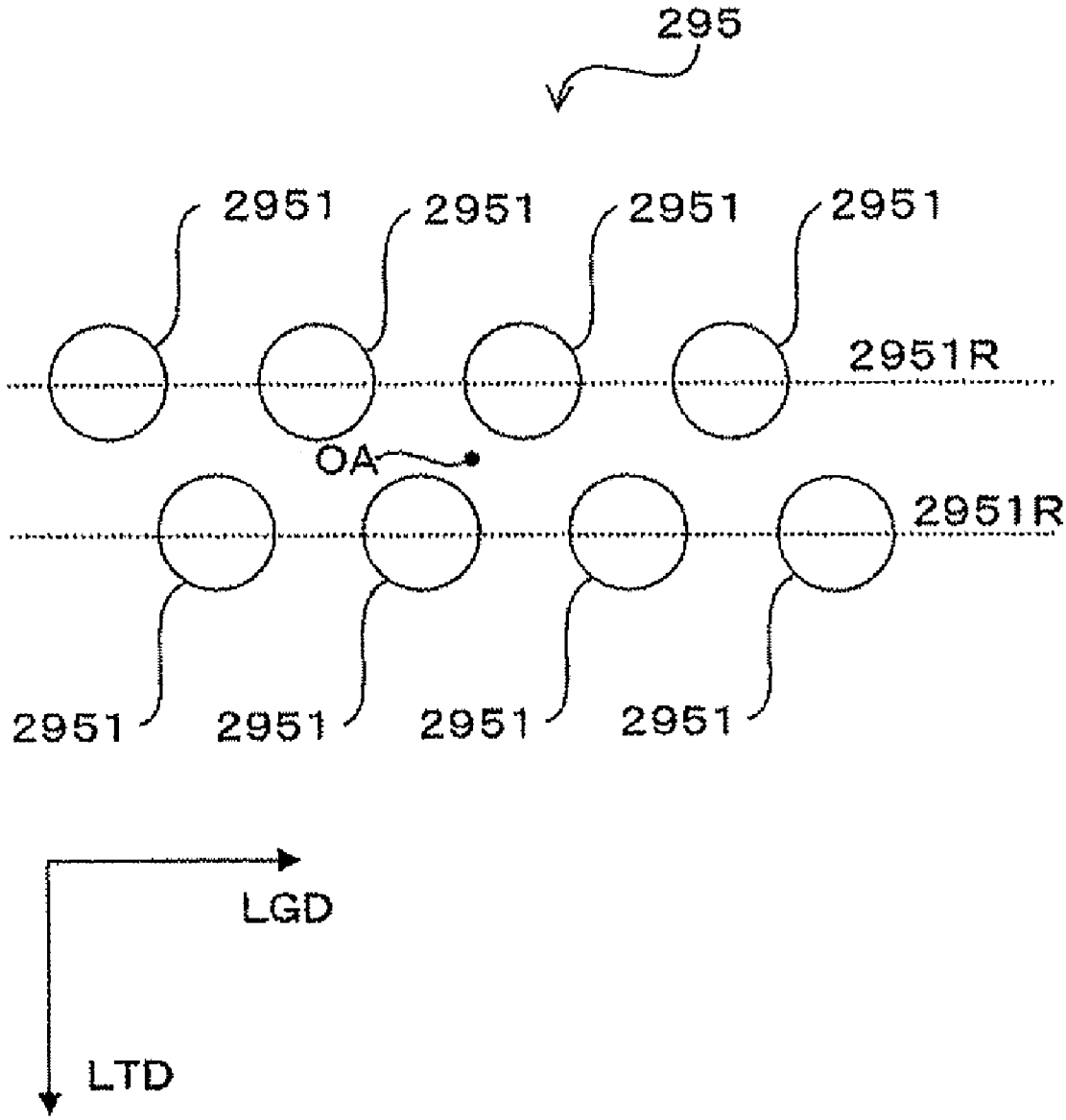
FIG. 10 is a diagram showing an arrangement of light emitting elements in each of light emitting element groups.

FIG. 9 is a diagram showing a configuration of the reverse surface of the head substrate, corresponding to the case in which the reverse surface is viewed from the obverse surface of the head substrate. FIG. 10 is a diagram showing an arrangement of the light emitting elements in each of the light emitting element groups. It should be noted that in FIG. 9, although the lenses LS are illustrated with double-dashed lines, this does not denote that the lenses LS are disposed on the reverse surface of the substrate, but denotes that the light emitting element groups 295 are disposed corresponding one-on-one to the lenses LS. As shown in FIG. 9, a plurality of light emitting element group columns 295C, each having three light emitting element groups 295 disposed at positions different from each other in the width direction LTD, are arranged in the longitudinal direction LGD. In other words, the light emitting element group rows 295R having a plurality of light emitting element groups 295 arranged along the longitudinal direction LGD are arranged in the width direction LTD in three rows. In this case, the light emitting element group rows 295R are shifted from each other in the longitudinal direction LGD so that the light emitting element groups 295 do not overlap with each other in the width direction LTD. Here, the three light emitting element group rows are denoted with the reference marks 295R_A, 295R_B, and 295R_C in order from the upstream side in the width direction LGD.

In each of the light emitting element groups 295, two light emitting element rows 2951R each having four light emitting elements 2951 arranged along the longitudinal direction LGD are arranged in parallel in the width direction LTD (FIG. 10). In this case, the light emitting element rows 2951R are shifted from each other in the longitudinal direction LGD so that the light emitting elements 2951 do not overlap with each other in the width direction LTD. As a result, there are eight, light emitting elements 2951 arranged in a zigzag manner. Further, as shown in FIG. 10, each of the light emitting element groups 295 is disposed in an axisymmetric manner with respect to the optical axis OA of the corresponding lens LS. In other words, the eight light emitting elements 2951 forming the light emitting element group 295 are arranged symmetrically with respect to the optical axis OA. Therefore, the light beam from the light emitting element 2951 relatively distant from the optical axis OA can also be imaged in a condition with a small aberration.

In correspondence with the light emitting element group rows 295R_A, 295R_B, and 295R_C, there are provided drive circuits DC_A (for the light emitting element group row 295_A), DC_B (for the light emitting element group row 295_B), and DC_C (for the light emitting element group row 295_C), respectively, and the drive circuits DC_A, DC_B, and DC_C are composed of thin film transistors (TFTs) (FIG. 9). The drive circuits DC_A, DC_B, and DC_C are disposed on one side of the corresponding light emitting element group rows 295R_A, 295R_B, and 295R_C in the width direction, and are connected to the light emitting elements 2951 in the corresponding light emitting element group rows 295R_A, 295R_B, and 295R_C with wires WL, respectively. When the drive circuits DC_A, DC_B, and DC_C apply the drive signals to each of the light emitting elements 2951, the light emitting elements 2951 emit light beams with the wavelengths equal to each other. The emission surface of the light emitting element 2951 is a so-called perfect diffuse surface light source, and the light beam emitted from the emission surface follows Lambert's cosine law.

The drive operation of the drive circuit DC is controlled based on the video data VD. Specifically, when receiving a vertical request signal VREQ from the head controller HC, the main controller MC generates the video data VD corresponding to one page (FIG. 4). Further, every time the main controller MC receives a horizontal request signal HREQ from the head controller HC, the video data VD corresponding to one line is transmitted to the head controller HC. Further, the head controller HC controls the drive circuits DC based on the video data thus received. A specific configuration of realizing these control operations will hereinafter be explained.

It should be noted that in the first embodiment, corresponding respectively to the colors of YMCK, there are four sets of the signals described above, namely the request signals VREQ, HREQ transmitted from the head controller HC to the main controller MC, and the video data VD transmitted from the main controller MC to the head controller HC. The colors are hereinafter discriminated by adding a hyphen and a symbol representing one of the colors to signal names, if necessary. For example, the vertical request signal, the horizontal request signal, and video data for yellow are denoted as VREQ-Y, HREQ-Y, and VD-Y, respectively.

Figure 11:
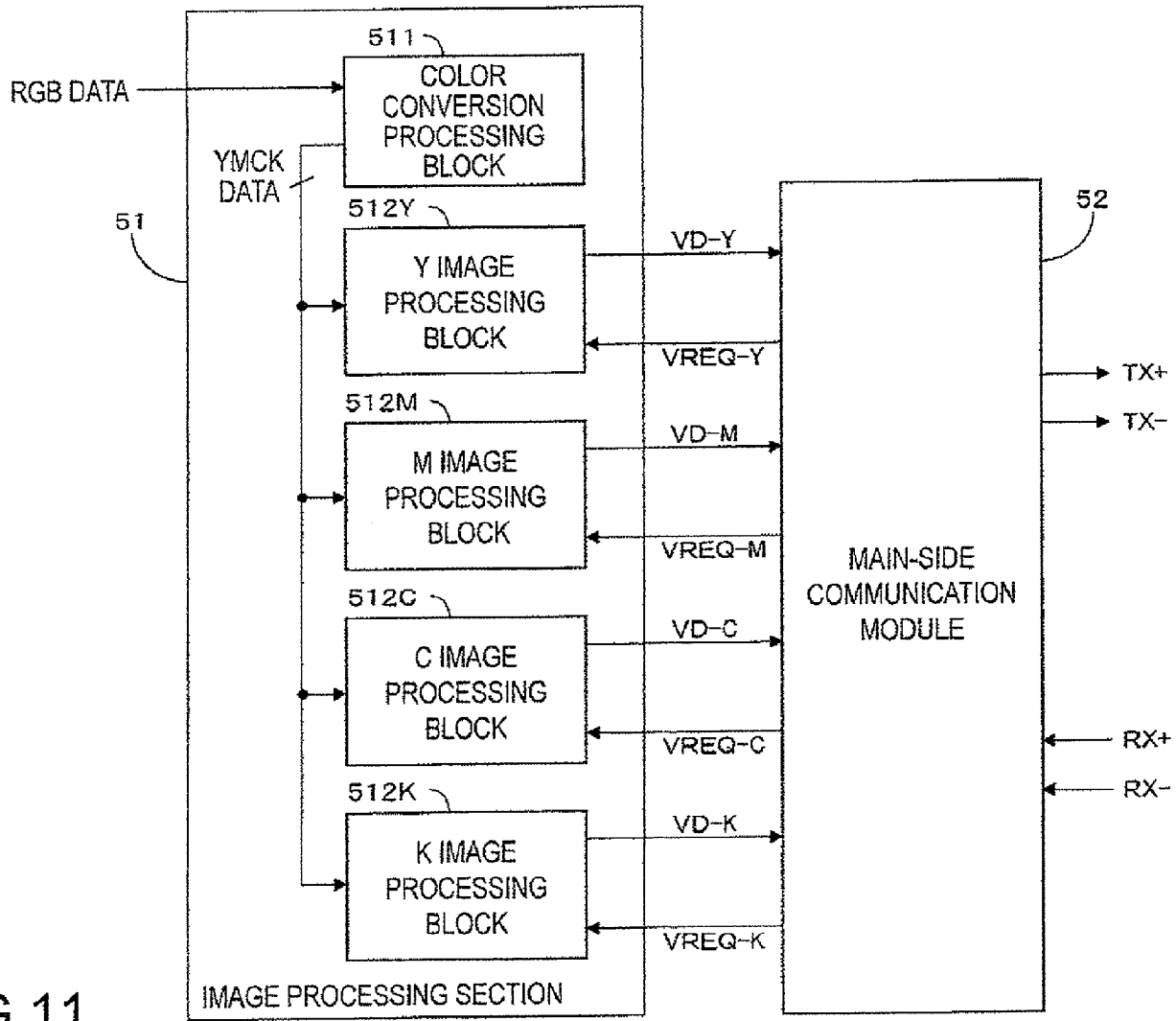
FIG. 11 is a block diagram showing a configuration of a main controller.

FIG. 11 is a block diagram showing the configuration of the main controller. The main controller MC is provided with an image processing section 51 for executing necessary signal processing on the image data included in the image formation command provided from an external device, and a main-side communication module 52. The image processing section 51 is provided with a color conversion processing block 511 for developing the RGB image data into CMYK image data corresponding to the respective toner colors. Further, the image processing section 51 is provided with image processing blocks 512Y (for yellow), 512M (for magenta), 512C (for cyan), and 512K (for black) corresponding respectively to the toner colors, and the following signal processing is executed on the image data. Specifically, the image processing blocks 512Y, 512M, 5120, and 512K execute the bitmap development on the image data in accordance with the resolution of the line heads 29, and then execute the screen treatment, the gamma correction, and so on the bitmap-developed data to generate the video data VD-Y, VD-M, VD-C, and VD-K, respectively. Through the process described above, the image data is converted into the information having the pixel as the minimum unit. Here, the pixel is the minimum unit composing the image formed by the line heads 29. The series of signal processing is executed on the image corresponding to one page every input of the vertical request signal VREQ-Y, and the video data VD-Y, VD-M, VD-C, and VD-K corresponding to one line thus generated are sequentially output to the main-side communication module 52.

The main-side communication module 52 time-division multiplexes the four colors of video data VD-Y, VD-M, VD-C, and VD-K output from the image processing section 51, and transmits the video data VD thus multiplexed to the head controller HC serially via differential output terminals TX+, TX−. On the other hand, the vertical request signals VREQ_Y, VREQ_M, VREQ_C, and VREQ_K, and the horizontal request signals HREQ_Y, HREQ_M, HREQ_C, and HREQ_K are time-division multiplexed and input from the head controller HC via differential input terminals RX+, RX−. These request signals VREQ, HREQ are developed into parallel signals, and the vertical request signals VREQ (e.g., VREQ-Y) are input to the image processing blocks 512 (e.g., 512Y) for the respective colors.

Figure 12:
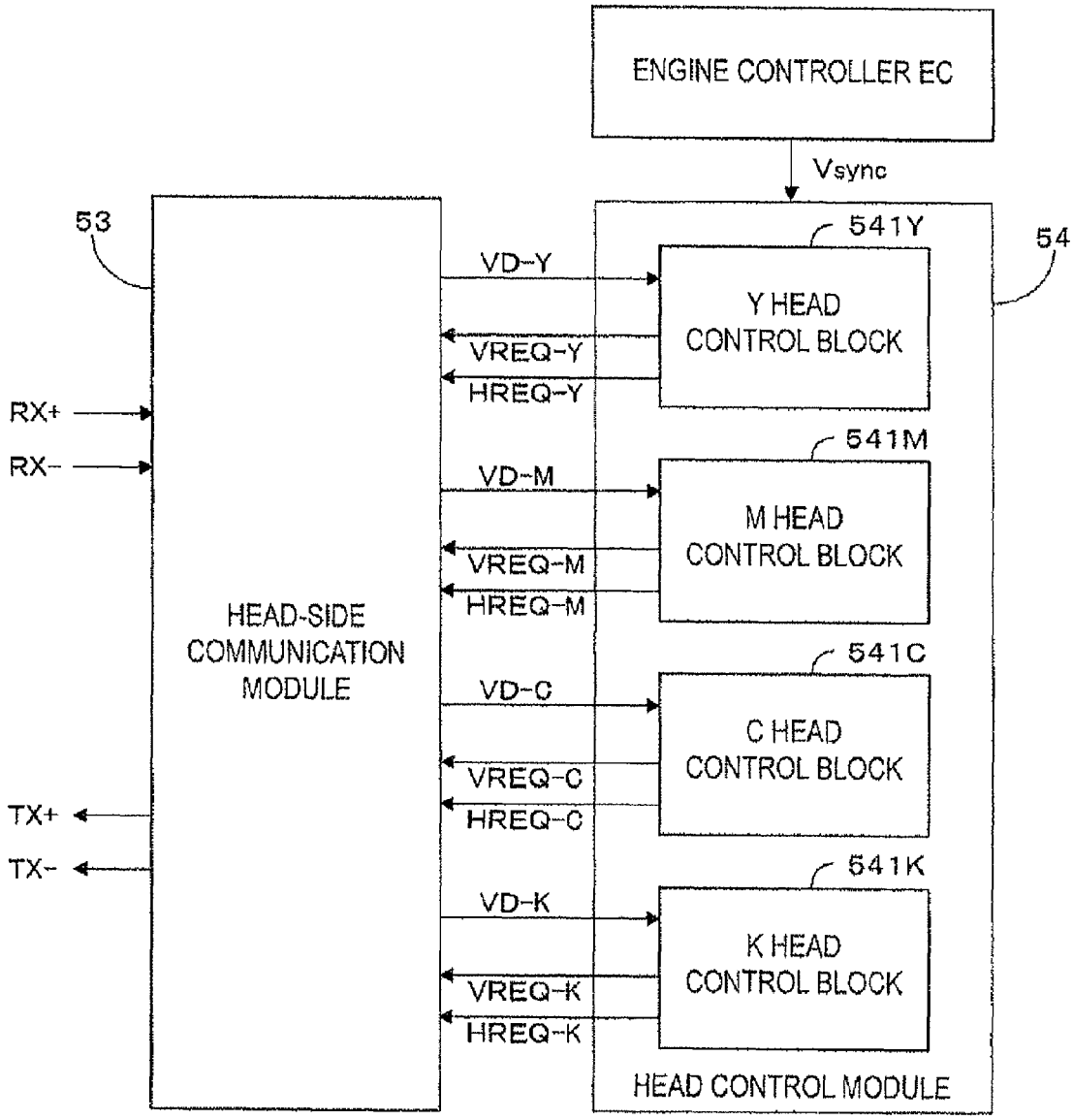
FIG. 12 is a block diagram showing a configuration of a head controller.

FIG. 12 is a block diagram showing the configuration of the head controller. The head controller HC is provided with a head-side communication module 53 and a head control module 54. The head-side communication module 53 time-division multiplexes the four colors of request signals output from the head control module 54, namely the vertical request signals VREQ_Y, VREQ_M, VREQ_C, and VREQ_K, and the horizontal request signals HREQ_Y, HREQ_M, HREQ_C, and HREQ_K. The request signals thus time-division multiplexed are transmitted serially to the main controller MC via differential output terminals TX+, TX−. Meanwhile, the video data VD-Y, VD-M, VD-C, and VD-K are time-division multiplexed and input from the main controller MC via differential input terminals RX+, RX−. These video data VD-Y, VD-M, VD-C, and VD-K are developed into parallel signals and input to head control blocks 541Y, 541M, 541C, and 541K of the respective colors.

The head control module 54 is provided with four head control blocks 541Y (for yellow), 541M (for magenta), 541C (for cyan), and 541K (for black) corresponding to the respective colors. The head control blocks 541Y, 541M, 541C, and 541K output the request signals VREQ_Y, VREQ_M, VREQ_C, VREQ_K, HREQ_Y, HREQ_M, HREQ_C, and HREQ_K for requesting the video data VD-Y, VD-M, VD-C, and VD-K, respectively, and meanwhile, control the exposure operations of the line heads 29 of the respective colors based on the video data VD-Y, VD-M, VD-C, and VD-K, thus received.

Figure 13:
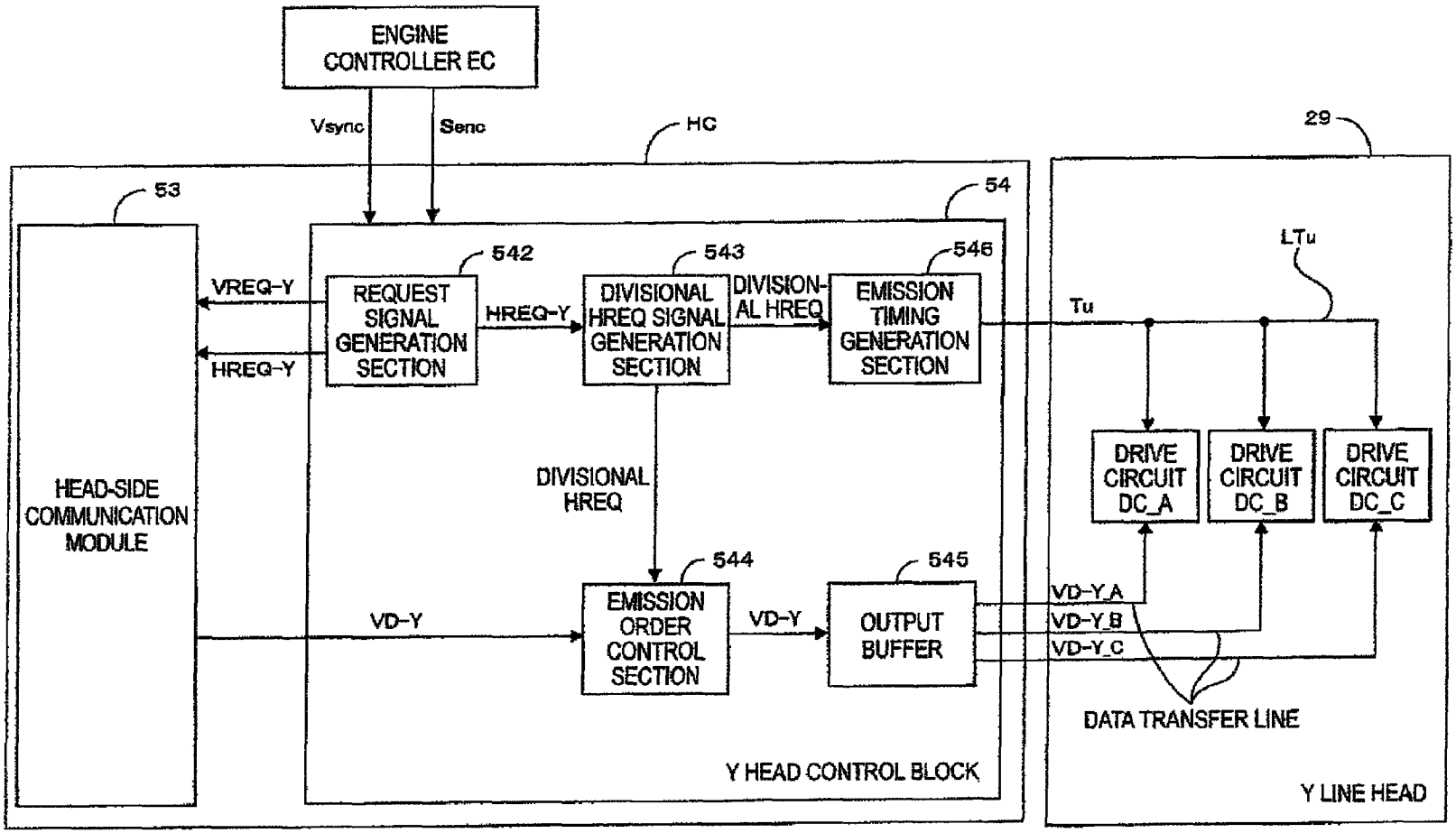
FIG. 13 is a block diagram showing a configuration of a head control block and so on in a first embodiment.

FIG. 13 is a block diagram showing a configuration of a head control block and so on in the first embodiment. Although the Y head control block 541Y for yellow is only explained here, the other blocks 541M, 541C, and 541K have the same structures. The Y head control block 541Y is provided with a request signal generation section 542 for generating the request signals VREQ-Y and HREQ-Y based on the sync signal Vsync provided from the engine controller EC. Upon reception of the sync signal Vsync, the request signal generation section 542 starts a counting operation of an internal timer, and outputs the vertical request signal VREQ-Y representing the top of the page when predetermined standby time has elapsed. Subsequently to the output of the vertical request signal VREQ-Y, the request signal generation section 542 outputs the corresponding number of pulses of the horizontal request signal HREQ-Y to the number of lines composing the image of one page repeatedly at a predetermined interval. These request signals VREQ-Y and HREQ-Y are transmitted to the head-side communication module 53, and time-division multiplexed together with the request signals of the other colors to be transmitted to the main controller MC.

The horizontal request signal HREQ-Y is also input to a divisional HREQ signal generation section 543, and the divisional HREQ signal generation section 543 multiplies the request signal HREQ-Y by, for example, 16 to generate the divisional HREQ signal. The divisional HREQ signal is input to an emission order control section 544, and the emission order control section 544 reorders the video data VD-Y based on the divisional HREQ signal. Specifically, as described later, each of the light emitting element group rows 295R forms the spot groups SG at the positions a sub-scanning spot group pitch Psgs shifted from each other in the sub-scanning direction SD (e.g., FIGS. 14 and 15). Therefore, in order for forming the spot latent images corresponding to one line aligned in the main-scanning direction MD, it is necessary to transmit the video data VD-Y to each of the drive circuits DC_A, DC_B, and DC_C taking such a difference in the forming positions of the spot groups SG into consideration. Therefore, in the emission order control section 544, the video data VD-Y is discriminated into the video data VD-Y_A, VD-Y_B, and VD-Y_C corresponding respectively to the light emitting element group rows 295R_A, 295R_B, and 295R_C, and each of the video data VD-Y_A, VD-Y_B, and VD-Y_C is reordered in accordance with the difference in the forming positions of the spot groups SG of each of the light emitting element group rows 295R_A, 295R_B, and 295R_C. In a manner as described above, the video data VD-Y received line-by-line from the top of the page is reordered so as to correspond to the order in which the data is transmitted to the drive circuits DC_A, DC_B, and DC_C. It should be noted that the spot latent image is a latent image formed on the surface of the photoconductor drum by the spot SP.

An output buffer 545 supplies the drive circuits DC_A, DC_B, and DC_C with the video data VD-Y_A, VD-Y_B, and VD-Y_C, respectively, via the data transfer lines. The output buffer 545 is composed of, for example, shift registers. Further, the drive circuits DC_A, DC_B, and DC_C drive the light emitting elements 2951 to emit light based on the video data VD-Y_A, VD-Y_B, and VD-Y_C supplied from the output buffer 545, respectively. On this occasion, the driving of emission by the drive circuits DC_A, DC_B, and DC_C is performed in sync with emission timing Tu supplied from an emission timing signal generation section 546 explained as follows.

The divisional HREQ signal is also input to the emission timing signal generation section 546, and the emission timing signal generation section 546 generates the emission timing Tu based on the divisional HREQ signal. The emission timing signal generation section 546 is connected to each of the drive circuits DC_A, DC_B, and DC_C via emission timing control lines LTu, and each of the emission timing control lines LTu is used commonly by the drive circuits. The emission timing signal generation section 546 supplies each of the drive circuits DC_A, DC_B, and DC_C with the emission timing Tu via the emission timing control lines LTu. Further, the drive circuits DC_A, DC_B, and DC_C drive the corresponding light emitting elements 2951 of the light emitting element group rows 295R_A, 295R_B, and 295R_C to emit light at the emission timing Tu based on the video data VD-Y_A, VD-Y_B, and VD-Y_C supplied previously, respectively. By thus controlling the driving of emission of the light emitting elements 2951 at every emission timing Tu, it becomes possible to form the spots SP respectively to the pixels PX on the surface of the photoconductor drum. Therefore, the spot forming operation will hereinafter be explained.

Figure 14:
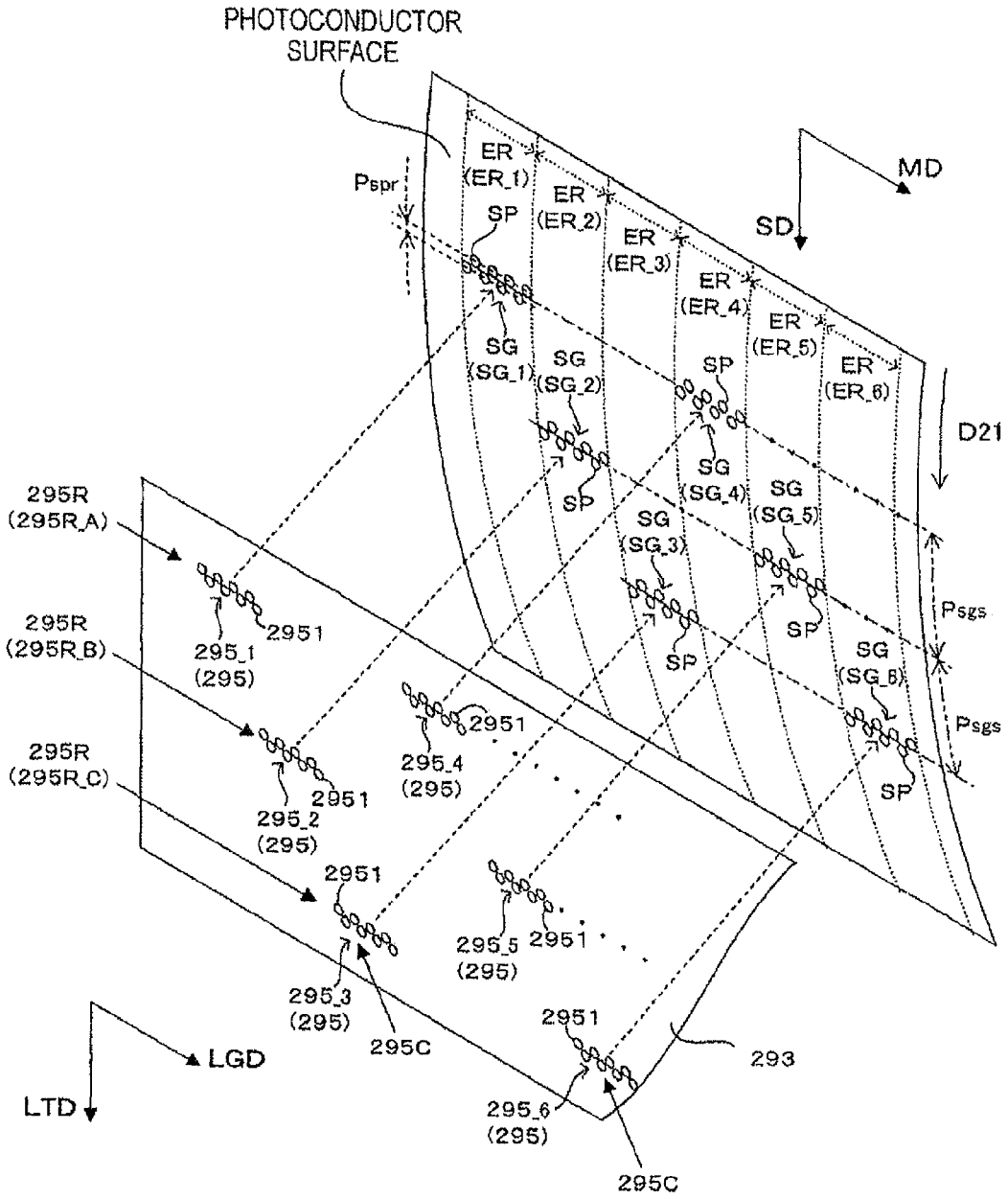
FIG. 14 is a perspective view for explaining a spot forming operation.
Figure 15:
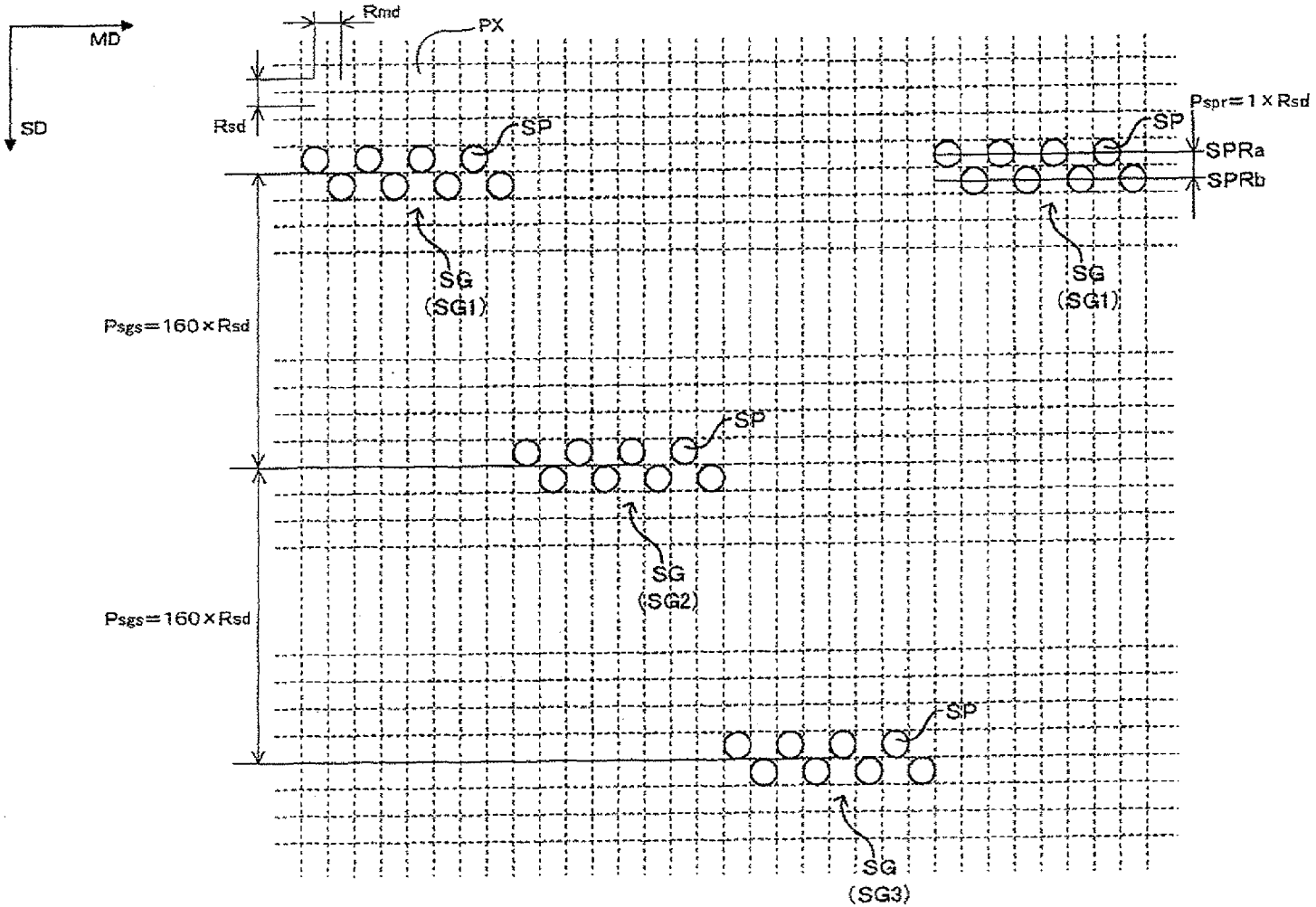
FIG. 15 is a diagram showing spot groups formed on the surface of the photoconductor drum in the first embodiment.

FIG. 14 is a perspective view for explaining the spot formation operation, and FIG. 15 is a diagram showing the spot groups formed on the surface of the photoconductor drum at the emission timing Tu in the first embodiment. It should be noted that the illustration of the lens array 299 is omitted in FIG. 14. Here, the relationship between the spot group SG and the pixels PX will firstly be explained, and then the formation of the spots at the emission timing Tu will be explained.

As shown in FIG. 14, the light emitting element groups 295 can form the spot groups SG respectively in exposure regions ER different from each other in the main-scanning direction MD. Here, the spot group SG is an aggregate of a plurality of spots SP formed when each of the light emitting elements 2951 in the light emitting element group 295 emit light simultaneously. In the first embodiment, three light emitting element groups 295 capable of forming the spot groups SG in the exposure regions ER arranged consecutively in the main-scanning direction MD are disposed shifted from each other in the width direction LTD. Specifically, the three light emitting element groups 295_1, 295_2, and 295_3 capable of forming the spot groups SG_1, SG_2, and SG_3 in the consecutive exposure areas ER_1, ER_2, and ER_3 disposed in the main-scanning direction MD, for example, are disposed so as to be shifted from each other in the width direction LTD. These three light emitting element groups 295 form the light emitting element group column 295C, and a plurality of light emitting element group columns 295C is arranged along the longitudinal direction LGD. As a result, although described in the explanation of FIG. 9, the three light emitting element group rows 295R_A, 295R_B, and 295R_C are arranged in the width direction LTD, and the light emitting element group rows 295R_A, 295R_B, and 295R_C respectively form the spot groups SG at positions different from each other in the sub-scanning direction SD.

As illustrated with the broken lines shown in FIG. 15, the surface of the photoconductor drum 21 is imaginarily provided with a plurality of pixels PX, a plurality of pixels PX arranged in the main-scanning direction MD forms a pixel line, and a plurality of pixel lines is arranged side by side in the sub-scanning direction SD. A pitch between the adjacent pixels in the main-scanning direction MD is defined as a main-scanning pixel pitch Rmd, and a pitch between the adjacent pixels in the sub-scanning direction SD is defined as a sub-scanning pixel pitch Rsd. In the drawing, both of the main-scanning resolution and the sub-scanning resolution are 600 dpi (dots per inch), and therefore, the main-scanning pitch Rmd and the sub-scanning pitch Rsd are equal to each other. Here, the resolution is the pixel density, and represents the number of pixels per inch.

Incidentally, the pixel pitch on the surface of the photoconductor drum can be obtained from, for example, the pixel pitch of an image formed on a paper sheet. It should be noted that there are some cases in which the moving velocity of the surface of the photoconductor drum and the conveying velocity of the paper sheet are slightly different from each other in the sub-scanning direction. SD, and in such cases, the sub-scanning pixel pitch is different between the surface of the photoconductor drum and the paper sheet. Therefore, in the case in which the sub-scanning pixel pitch on the surface of the photoconductor drum is obtained from the image formed on the paper sheet, it is possible to multiply the sub-scanning image pitch obtained from the image on the paper sheet by the velocity ratio of the moving velocity of the surface of the photoconductor drum to the conveying velocity of the paper sheet. It should be noted that as the velocity ratio, a value described in the specification of the image forming device such as a printer can be used.

As shown in FIGS. 14 and 15, in each of the spot groups SG, two spot rows SPRa, SPRb are arranged in the sub-scanning direction SD at the spot row pitch Pspr. In the first embodiment, the spot row pitch Pspr is set to be the value obtained by multiplying the sub-scanning pixel pitch Rsd by an integral number (i.e., 1) (FIG. 15). Further, the spot groups SG formed respectively by the light emitting element group rows 295R different from each other are located at positions different from each other in the sub-scanning direction SD, and the pitch in the sub-scanning direction SD between the spot groups SG becomes a sub-scanning spot group pitch Psgs. The sub-scanning spot group pitch Psgs is set to be a value obtained by multiplying the sub-scanning pixel pitch Rsd by an integral number (i.e., 160). It should be noted that in the first embodiment, the line head 29 is configured so that the pitch Pegr between the light emitting element groups in the width direction LTD and the pitch Plsr between the lenses LS in the width direction LTD are equal to each other, and to the value obtained by multiplying the sub-scanning pixel pitch by an integral number (i.e., 160). Therefore, by thus configuring the line head 29, it becomes possible to easily and simply set the sub-scanning spot group pitch Psgs to be a value obtained by multiplying the sub-scanning pixel pitch Rsd by an integral number.

As described above, in the line head of the first embodiment, since the sub-scanning spot group pitch Psgs is set to a value obtained by multiplying the sub-scanning pixel pitch Rsd by an integral number, it is possible to form all of the spots SP to the pixels PX simultaneously at the emission timing Tu. Therefore, in the first embodiment, the emission timing Tu is common to all of the light emitting element groups 295. Therefore, the emission of the light emitting elements 2951 forming the respective spots SP is switched at the timing Tu at which the respective spots SP reach the positions corresponding to the pixels PX (FIG. 15). Here, switching of the emission denotes both of switching from a non-emission state to an emission state and switching from the emission state to the non-emission state. According to the first embodiment, it is arranged that by switching the emission of the light emitting elements 2951 at such emission timing Tu, the spots SP are formed on the respective pixels PX, and thus the spot latent images can be formed on the respective pixels PX.

Figure 16:
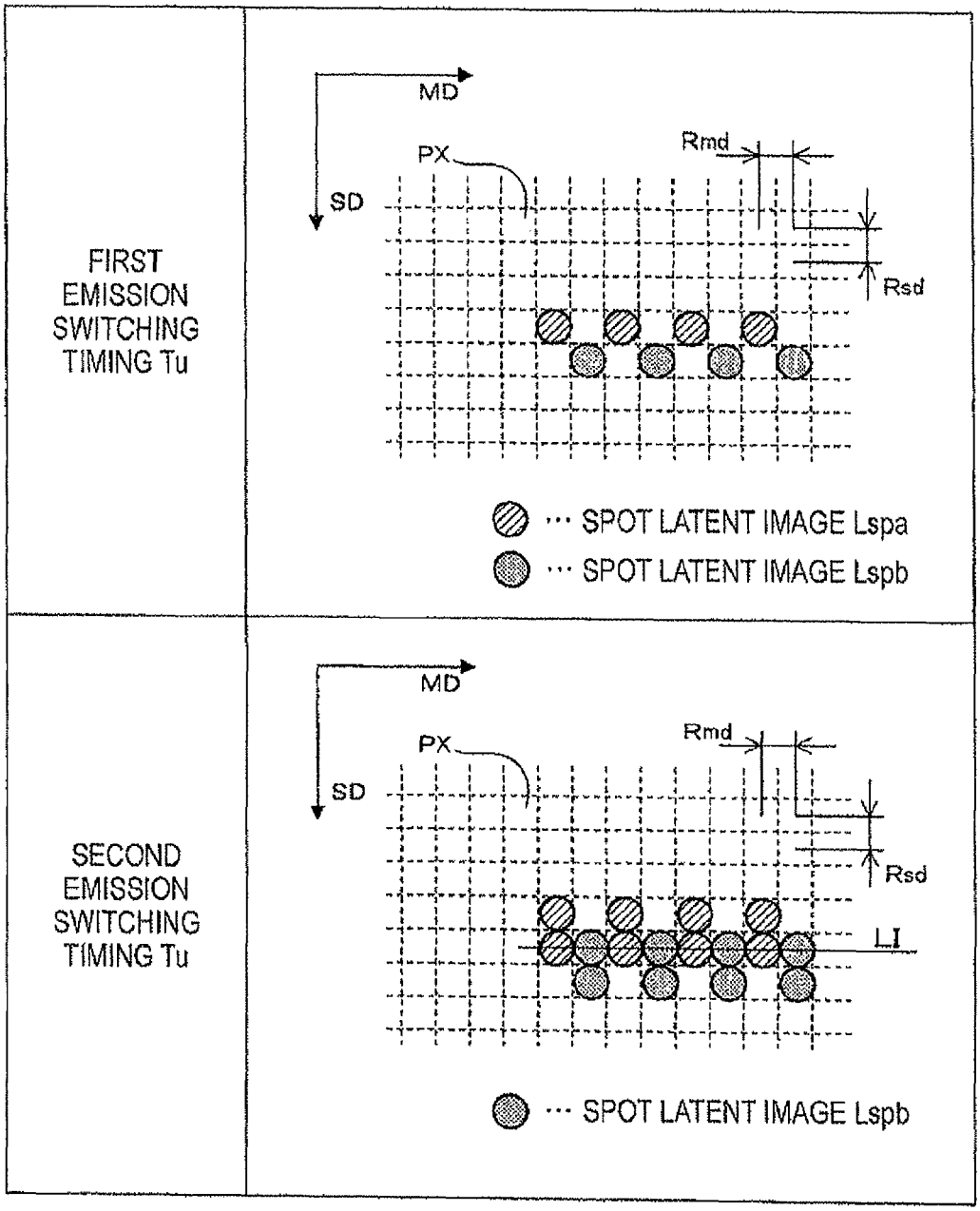
FIG. 16 is a diagram showing an example of a spot latent image forming operation.

FIG. 16 is a diagram showing an example of the spot latent image forming operation. The drawing shows how one of the light emitting element groups 295 forms the latent image. As shown in the "FIRST EMISSION TIMING Tu" section of the drawing, when the light emitting elements 2951 are driven to emit light at the first emission timing Tu, and the spots SP of the spot rows SPRa, SPRb are formed, the spot latent images Lspa, Lspb are formed on the respective pixels PX. Here, the spot latent image Lspa is the latent image formed by the spot row SPRa, and the spot latent image Lspb is the latent image formed by the spot row SPRb. Subsequently, the light emitting elements 2951 are driven to emit light at the second emission timing Tu when the surface of the photoconductor drum 21 moves a distance corresponding to the sub-scanning pixel pitch Rsd, thus the spots SP of the respective spot rows SPRa, SPRb are formed. Thus, as shown in the "SECOND EMISSION TIMING Tu" section, new spot latent images Lspa, Lspb are formed at positions one pixel down stream of the spot latent images formed at the first emission timing Tu in the sub-scanning direction SD. As described above, the respective light emitting elements 2951 emit light in sync with the emission timing Tu generated at a predetermined interval, thereby forming the spot latent images on the respective pixels PX. Further, as is understood, from the section, the latent image formation operation is executed, thereby forming a linear latent image LI composed of the spot latent images Lspa, Lspb. The linear latent image LI has a width of one pixel in the sub-scanning direction SD, and a length of eight pixels in the main-scanning direction MD.

Incidentally, as described above, in the image forming device of the present embodiment, the surface of the photoconductor drum 21 moves in the sub-scanning direction SD. Further, each of the light emitting element group rows 295R_A, 295R_B, and 295R_C expose the points different from each other in the sub-scanning direction SD at a timing according to the movement of the surface of the photoconductor drum, thereby forming the latent image. However, there are some cases in which the velocity of the surface of the photoconductor drum varies for the reason of, for example, a variation in the internal environment of the device, and as a result, there are some in which the latent image is not formed preferably.

Figure 17:
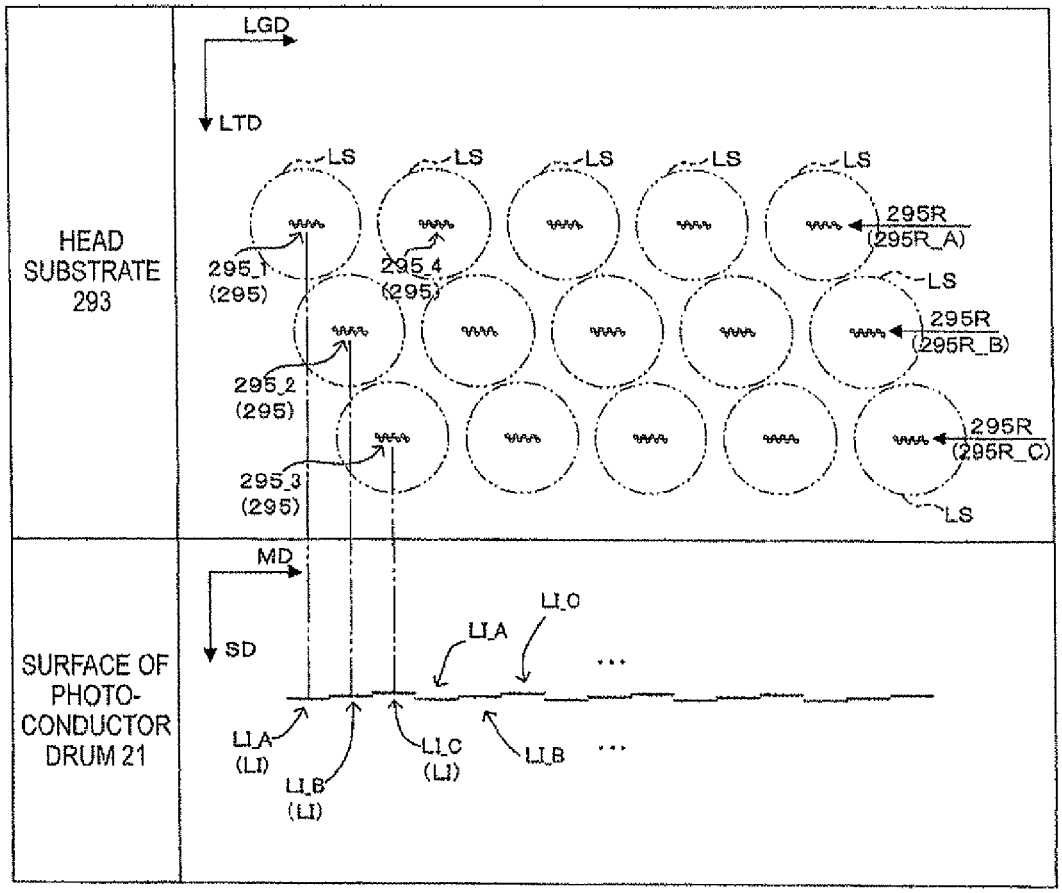
FIG. 17 is a diagram showing an example of a latent image formation failure, which may occur in the image forming device of the present embodiment.

FIG. 17 is a diagram showing an example of a latent image formation failure, which may occur in the image forming device of the present embodiment. In the "HEAD SUBSTRATE 293" section of the drawing, there are shown the light emitting element groups 295 disposed on the head substrate 293. Further, in the "SURFACE OF PHOTOCONDUCTOR DRUM 21" section of the drawing, there is shown how the latent image is formed in the case in which the variation in the moving velocity of the surface of the photoconductor drum is caused. In the latent image formation operation exemplified in the drawing, firstly, the uppermost-stream light emitting element group row 295R_A in the width direction LTD forms a plurality of linear latent images LI_A. Subsequently, the light emitting element group row 295R_B located on the downstream side of the light emitting element group row 295R_A in the width direction LTD forms a plurality of linear latent images LI_B. Further, the light emitting element group row 295R_C located on the downstream side of the light emitting element group row 295R_B in the width direction LTD forms a plurality of linear latent images LI_C. Incidentally, in the example shown in the drawing, the positions at which the linear latent images LI_A, LI_B, and LI_C are formed, respectively, are shifted from each other in the sub-scanning direction SD (see the section of "SURFACE OF PHOTOCONDUCTOR DRUM 21"). Such shift in the formation positions is caused by the variation in the moving velocity of the surface of the photoconductor drum occurring in the period from the formation of the linear latent images LI_A to the formation of the linear latent images LI_B, or in the period from the formation of the linear latent images LI_B to the formation of the linear latent images LI_C. Therefore, in the first embodiment, in order for preventing such shift in the latent image formation positions, there is provided an encoder for detecting the moving velocity of the surface of the photoconductor drum.

Figure 18:
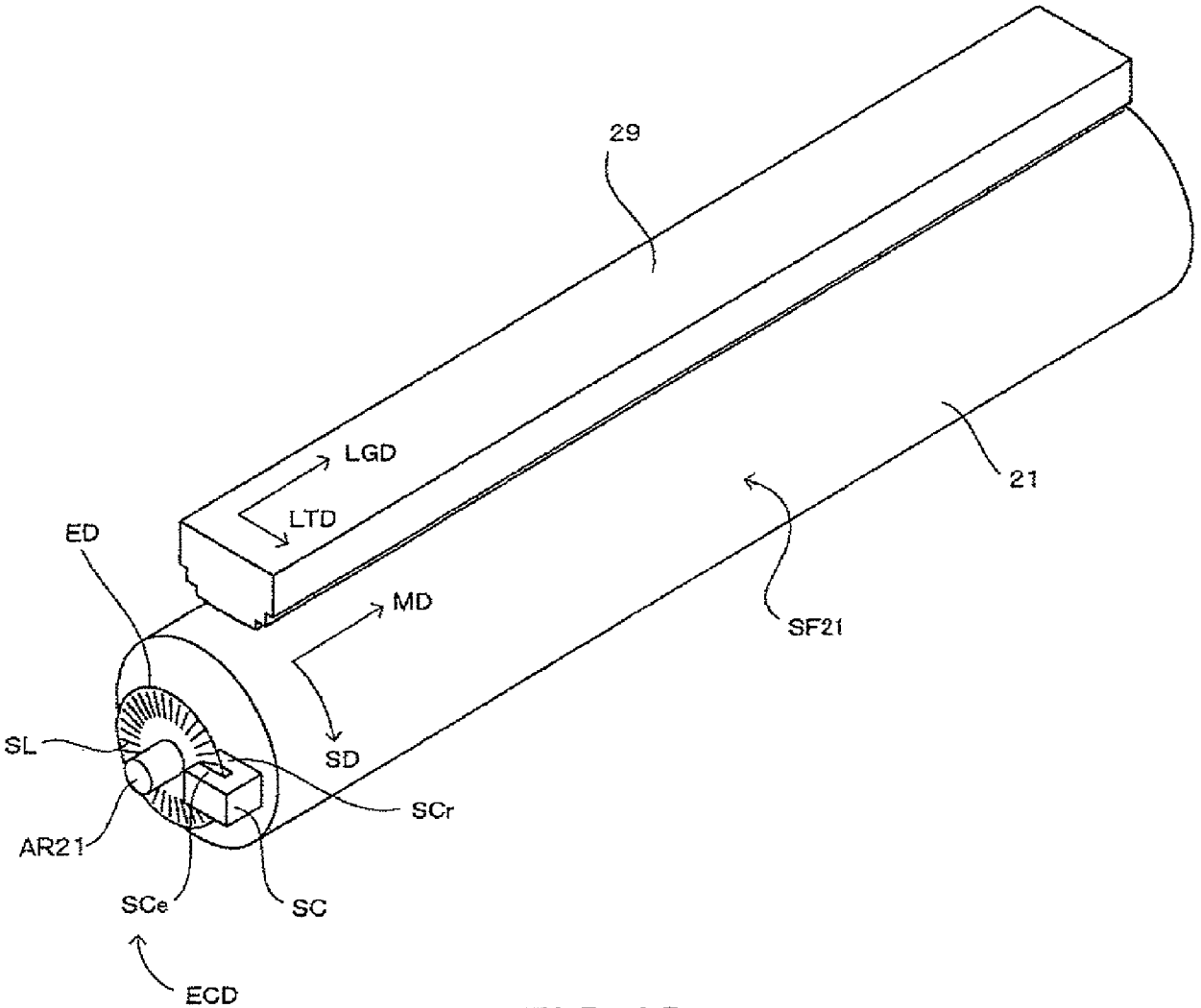
FIG. 18 is a perspective view showing a configuration of an encoder.
Figure 19:
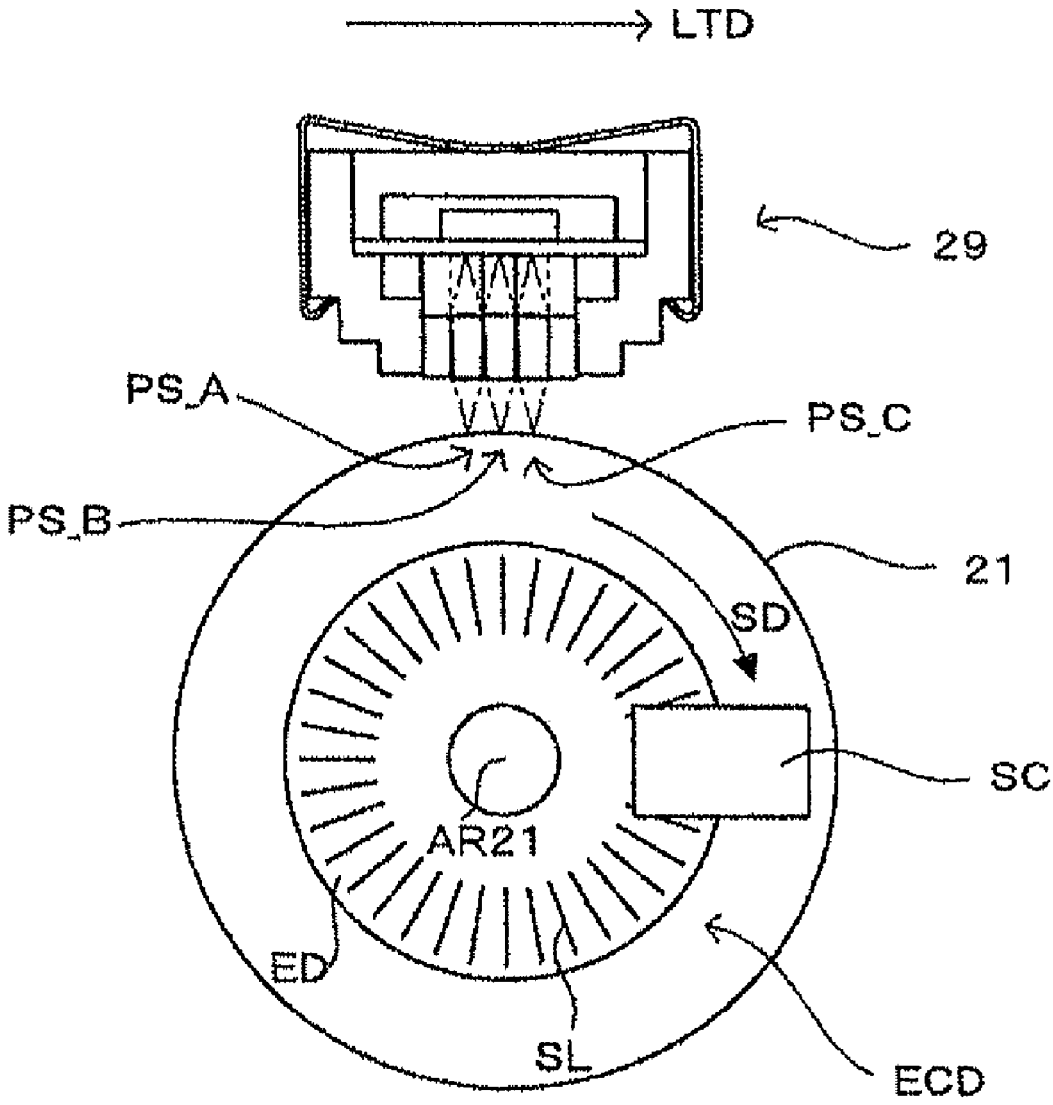
FIG. 19 is a front view showing the configuration of the encoder.

FIG. 18 is a perspective view showing the configuration of the encoder. Further, FIG. 19 is a front view showing the configuration of the encoder, and corresponds to the case of viewing the encoder from the longitudinal direction of the rotating shaft AR21 of the photoconductor drum 21. It should be noted that the rotating shaft AR21 extends in a direction perpendicular to or substantially perpendicular to the sub-scanning direction SD, and is parallel to or substantially parallel to the main-scanning direction MD. As described above, the line head 29 is disposed so as to be opposed to the surface SF21 of the photoconductor drum 21, and the light emitting element group rows 295R of the line head 29 expose the points at positions different from each other in the sub-scanning direction SD. It should be noted that in FIG. 19, the exposed positions by each of the light emitting element group rows 295R is represented by positions PS_A, PS_E, and PS_C, respectively, and the points at the positions PS_A, PS_B, and PS_C are exposed by the light emitting element group rows 295R_A, 295R_B, and 295R_C, respectively.

The encoder ECD has an encoder disc ED having a disc like shape and a transmissive photo sensor SC. The center portion of the encoder disc ED is attached to the rotating shaft AR21 of the photoconductor drum 21, and the encoder disc is also rotated in conjunction with rotation of the photoconductor drum 21. Further, the encoder disc ED is provided with a plurality of slits SL disposed radially from a rotational axis AX. Further, the slits SL are detected by the photo sensor SC. Specifically, the photo sensor SC has a light emitting section SCe and a light receiving section SCr, and the light emitting section SCe emits light towards the light receiving section SCr. The photo sensor SC is disposed so as to accommodate the encoder disc ED between the light emitting section SCe and the light receiving section SCr. Therefore, the light passing through the slits SL out of the light emitted from the light emitting section SCe enters the light receiving section SCr. Meanwhile, the light receiving section SCr, which has detected the incident light, outputs an encoder signal Senc. Therefore, by measuring the interval of the encoder signal Senc, the moving velocity of the surface SF21 of the photoconductor drum can be detected. The encoder signal Senc output by the light receiving section SCr is supplied to the head controller HC via the engine controller EC (FIG. 13). Further, the emission timing signal generation section 546 of the head controller HC adjusts the emission timing Tu of the light emitting elements 2951 based on the encoder signal Senc.

Figure 20:
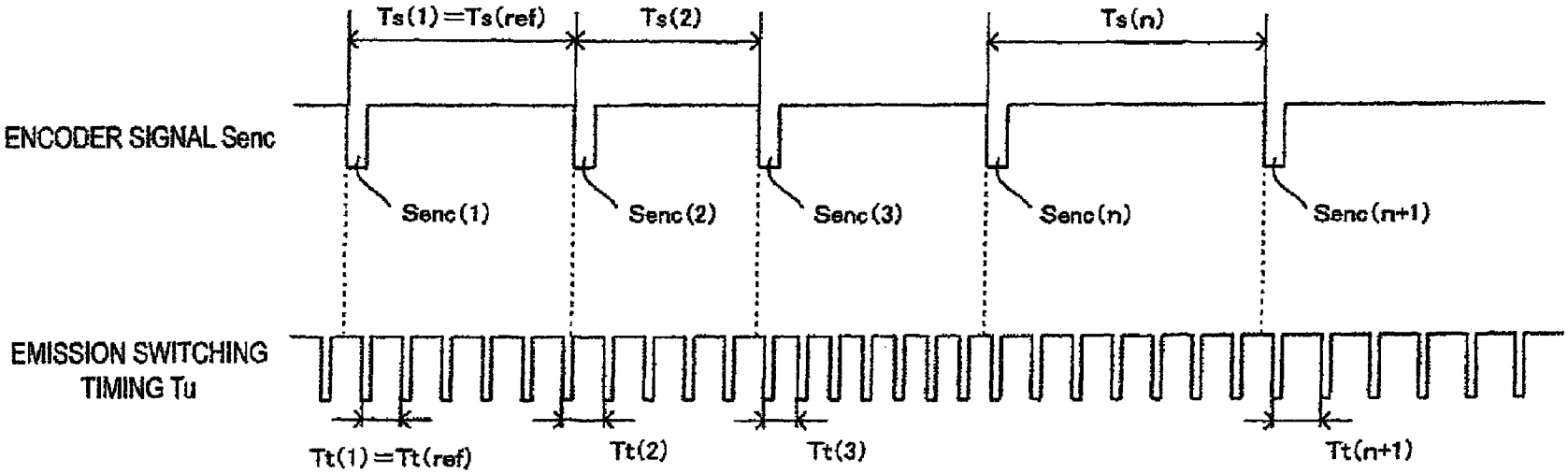
FIG. 20 is a diagram showing an adjustment operation of emission timing in the first embodiment.

FIG. 20 is a diagram showing an adjustment operation of the emission timing executed by the head controller in the first embodiment. In the drawing, each of the encoder signals Senc and the emission timing Tu is represented as a pulse with a low level. In the first embodiment, the emission timing is adjusted based on the difference between the moving velocity of the surface SF21 of the photoconductor drum and an ideal velocity (a reference velocity). Here, the ideal velocity is the moving velocity of the surface SF21 of the photoconductor drum in the case of having no variation in velocity. Specifically, the emission timing Tu is adjusted based on the difference between a reference signal interval Ts(ref) as the interval of the encoder signal Senc in the case in which the surface SF21 of the photoconductor drum is moving at the ideal velocity, and a signal interval Ts(n) of the encoder signal Senc measured actually. In the drawing, the signal interval Ts(1) between the first encoder signal Senc(1) and the second encoder signal Senc(2) is equal to the reference signal interval Ts(ref). Therefore, in the period between the first encoder signal Senc(1) and the second encoder signal Senc(2), an interval (an emission interval Tt(1)) of the emission timing Tu is set to a reference emission interval Tt(ref). Then, in the case in which the signal interval Ts(2) between the second encoder signal Senc(2) and the third encoder signal Senc(3) is shorter, it is determined that the velocity of the surface of the photoconductor drum is shifted to be higher, and the emission interval Tt(2) is set to be shorter. Specifically, the emission interval Tt(2) is set based on the following formula.

$$Tt(2)=(Ts(2)/Ts(ref))\times Tt(ref)$$

In other words, in a generalized manner, the emission interval Tt(n+1) is set based on the following formula with respect to the interval Ts(n) between the nth encoder signal Senc(n) and the n+1th encoder signal Senc(n+1).

$$Tt(n+1)=(Ts(n)/Ts(ref)\times Tt(ref)$$

Further, the emission timing Tu is adjusted so that the interval of the emission timing Tu becomes the emission interval Tt(n+1).

As described above, in the first embodiment, the moving velocity of the surface SF21 (the circumferential surface) of the photoconductor drum 21 is detected by the encoder ECD, and the emission timing Tu of the light emitting elements 2951 is adjusted based on the result of the detection. Therefore, the shift of the latent image formation position based on the variation in the moving velocity of the surface SF21 of the photoconductor drum can be prevented from occurring, thus the preferable latent image formation becomes possible.

Further, in the first embodiment, the head controller HC (a control section) adjusts the emission timing Tu of the light emitting elements 2951 based on the difference between the moving velocity of the surface SF21 of the photoconductor drum and the ideal velocity (the reference velocity). Therefore, since the emission timing Tu of the light emitting elements 2951 is adjusted based on the shift of the moving velocity of the surface SF21 of the photoconductor drum from the ideal velocity, it becomes possible to efficiently prevent the shift of the latent image formation position, thus the preferable latent image formation becomes possible.

Further, in the image forming device 1 according to the first embodiment, the photoconductor drum 21 rotating around the rotating shaft AR21 is used as the latent image carrier, and it is particularly preferable to apply the invention to such an image forming device 1. The reason therefor is that there are some cases in which a variation is caused in the rotational velocity of the rotation of such a photoconductor drum 21 around the rotating shaft AR21, and the variation in the rotational velocity causes the variation in the moving velocity of the surface SF21 (the circumferential surface) of the photoconductor drum. Therefore, it is preferable to apply the invention to such an image forming device 1 to prevent the shift of the latent image formation position caused by the variation in the moving velocity of the surface SF21 of the photoconductor drum from occurring.

Further, in the first embodiment, the moving velocity of the surface SF21 of the photoconductor drum is detected by the encoder ECD having the encoder disc ED provided with a plurality of slits SL disposed radially from the rotating shaft AR21 of the photoconductor drum 21 and the photo sensor SC for detecting the slits SL. In other words, the detection of the moving velocity of the surface SF21 of the photoconductor drum is executed based on the plurality of slits SL disposed radially from the rotating shaft AR21 of the photoconductor drum 21. Therefore, it becomes possible to perform the detection of the moving velocity of the surface SF21 of the photoconductor drum with high accuracy.

Further in the first embodiment, since the sub-scanning spot group pitch Pegs is set to be a value obtained by multiplying the sub-scanning pixel pitch Rsd by an integral number, it becomes possible to control the light emission of each of the light emitting elements 2951 of each of the light emitting element groups 295 with the common emission timing Tu. Therefore, the simplification of the control of the emission timing for the light emitting elements 2951 is achieved, and the image forming device 1 of the first embodiment is preferable.

C. Second Embodiment

In the first embodiment described above, the sub-scanning spot group pitch Psgs is set to be a value obtained by multiplying the sub-scanning pixel pitch Rsd by an integral number, and each of the light emitting element group rows 295R emits light at the same emission timing Tu. However, it is also possible to set the sub-scanning spot group pitch Psgs to be a value obtained by multiplying the sub-scanning pixel pitch Rsd by a non-integral number. On this occasion, the light emitting element group rows 295R_A, 295R_B, and 295R_C are provided with emission timings Tu_A, Tu_B, and Tu_C, respectively. Such a case will hereinafter be explained.

Figure 21:
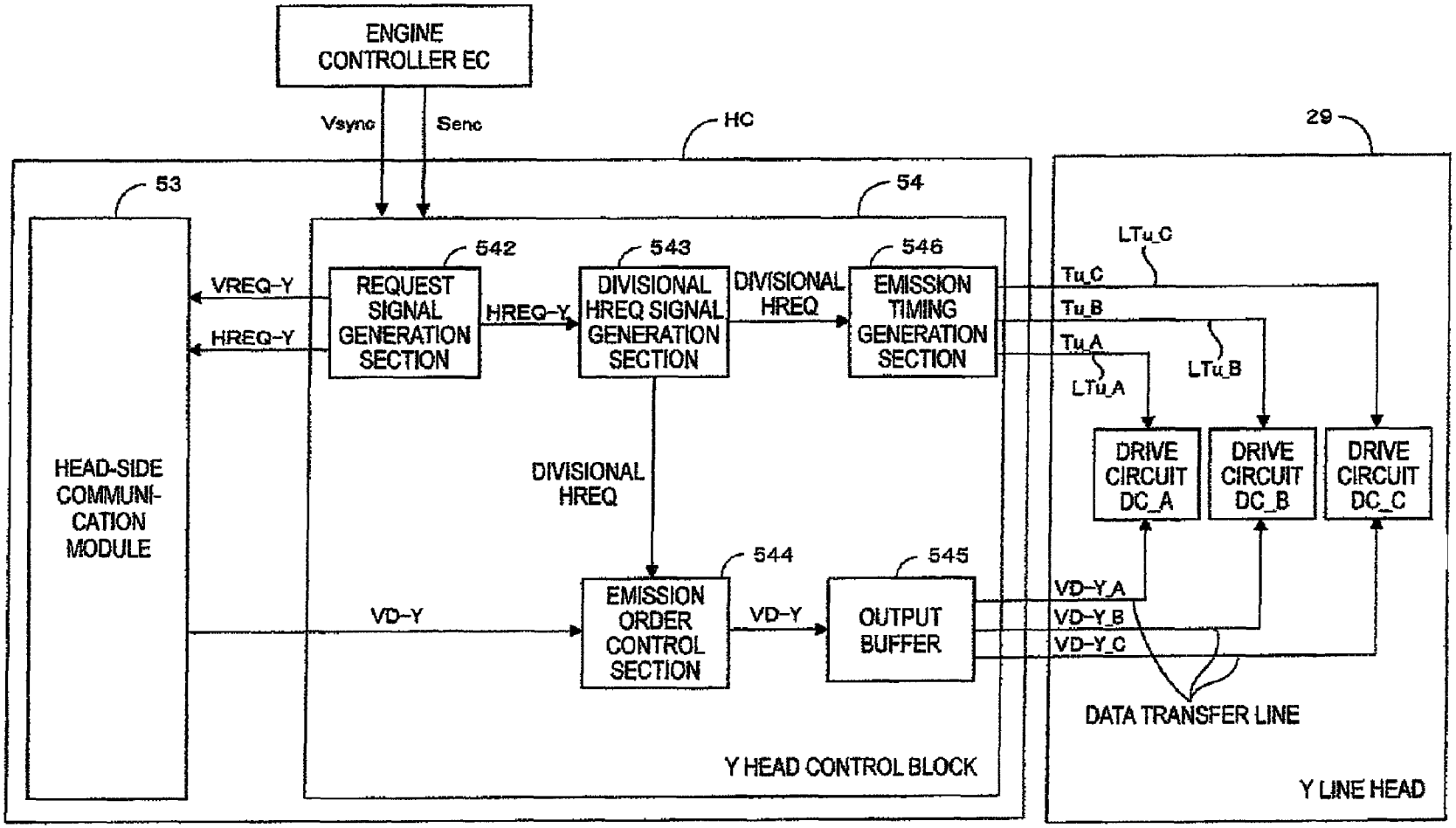
FIG. 21 is a block diagram showing a configuration of a head control block and so on in a second embodiment.

FIG. 21 is a block diagram showing a configuration of a head control block and so on in the second embodiment. Hereinafter, different points form the first embodiment will mainly be explained, and the common parts will be denoted with the corresponding reference marks, and the explanations therefor will be omitted. As shown in the drawing, in the second embodiment, the emission timing signal generation section 546 generates a plurality of emission timing corresponding respectively to the light emitting group rows 295R_A, 295R_B, and 295R_C, namely the emission timings Tu_A (for the light emitting element group row 295R_A), Tu_B (for the light emitting element group row 295R_B), and Tu_C (for the light emitting element group row 295R_C), respectively. The emission timings Tu_A, Tu_B, and Tu_C are supplied from the emission timing signal generation section 546 to the driving circuit DC_A, DC_B, and DC_C via corresponding emission timing control lines LTu_A (for the emission timing Tu_A), LTu_B (for the emission timing Tu_B), and LTu_C (for the emission timing Tu_C), respectively. Further, also in the second embodiment, in order for preventing the shift of the latent image position from occurring, the emission timing signal generation section 546 of the head controller HC adjusts each of the emission timings Tu_A, Tu_B, and Tu_C based on the velocity of the surface SF21 of the photoconductor drum.

Figure 22:
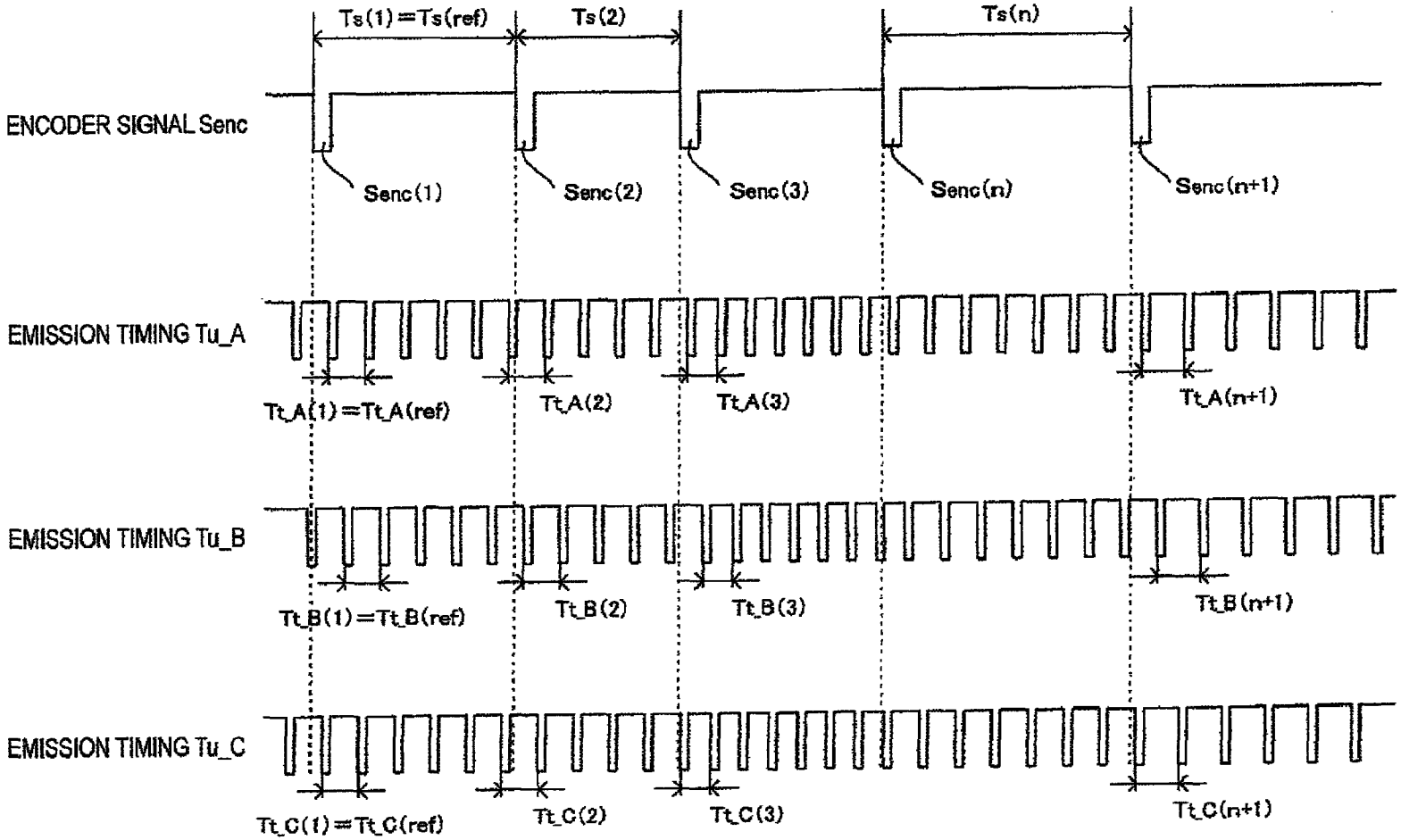
FIG. 22 is a diagram showing an adjustment operation of emission timing in the second embodiment.

FIG. 22 is a diagram showing an adjustment operation of the emission timing executed by the head controller in the second embodiment. In the drawing, each of the encoder signals Senc and the emission timing Tu is represented as a pulse with a low level. In the second embodiment, each of the emission timings Tu_A, Tu_B, and Tu_C is adjusted based on the difference between the moving velocity of the surface SF21 of the photoconductor drum and the ideal velocity (the reference velocity). It should be noted that since the adjustment operations of the emission timings Tu_A, Tu_B, and Tu_C are basically the same, the adjustment operation for the emission timing Tu_A will hereinafter mainly be explained, and the explanations of the adjustment operations for other emission timings Tu_B and Tu_C will be presented with the corresponding reference marks, or omitted if appropriate.

As shown in the drawing, the emission timing Tu_A is adjusted based on the difference between a reference signal interval Ts(ref) as the interval of the encoder signal Senc in the case in which the surface SF21 of the photoconductor drum is moving at the ideal velocity, and a signal interval Ts(n) of the encoder signal Senc measured actually. In the drawing, the signal interval Ts(1) between the first encoder signal Senc(1) and the second encoder signal Senc(2) is equal to the reference signal interval Ts(ref). Therefore, in the period between the first encoder signal Senc(1) and the second encoder signal Senc(2), the interval (the emission interval Tt_A(1)) of the emission timing Tu_A is set to the reference emission interval Tt_A(ref). Then, in the case in which the signal interval Ts(2) between the second encoder signal Senc (2) and the third encoder signal Senc(3) is shorter, it is determined that the velocity of the surface of the photoconductor drum is shifted to be higher, and the emission interval Tt_A(2) is set to be shorter. Specifically, the emission interval Tt_A(2) is set based on the following formula.

$$Tt_A(2)=(Ts(2)/Ts(ref))\times Tt_A(ref)$$

In other words, in a generalized manner, the emission interval Tt_A(n+1) is set based on the following formula with respect to the interval Ts(n) between the nth encoder signal Senc(n) and the n+1th encoder signal Senc(n+1).

$$Tt_A(n+1)=(Ts(n)/Ts(ref))\times Tt_A(ref)$$

Further, the emission timing Tu_A is adjusted so that the interval of the emission timing Tu_A becomes the emission interval Tt_A(n+1).

Further, the emission intervals Tt_B(n+1), Tt_C(n+1) of the other emission timings Tu_B, Tu_C are also set based on substantially the same formulas.

$$Tt_B(n+1)=(Ts(n)/Ts(ref))\times Tt_B(ref)$$

$$Tt_C(n+1)=(Ts(n)/Ts(ref))\times Tt_C(ref)$$

As described above, in the second embodiment, the moving velocity of the surface SF21 (the circumferential surface) of the photoconductor drum 21 is detected by the encoder ECD, and the emission timings Tu_A, Tu_B, and Tu_C of the light emitting elements 2951 are adjusted based on the result of the detection. Therefore, the shift of the latent image formation position based on the variation in the moving velocity of the surface SF21 of the photoconductor drum can be prevented from occurring, thus the preferable latent image formation becomes possible.

D. Third Embodiment

Incidentally, in the first and second embodiments described above, the communication of the video data VD between the main controller MC and the head controller HC is executed with asynchronous serial communication. However, the communication method of the video data VD is not limited thereto.

Figure 23:
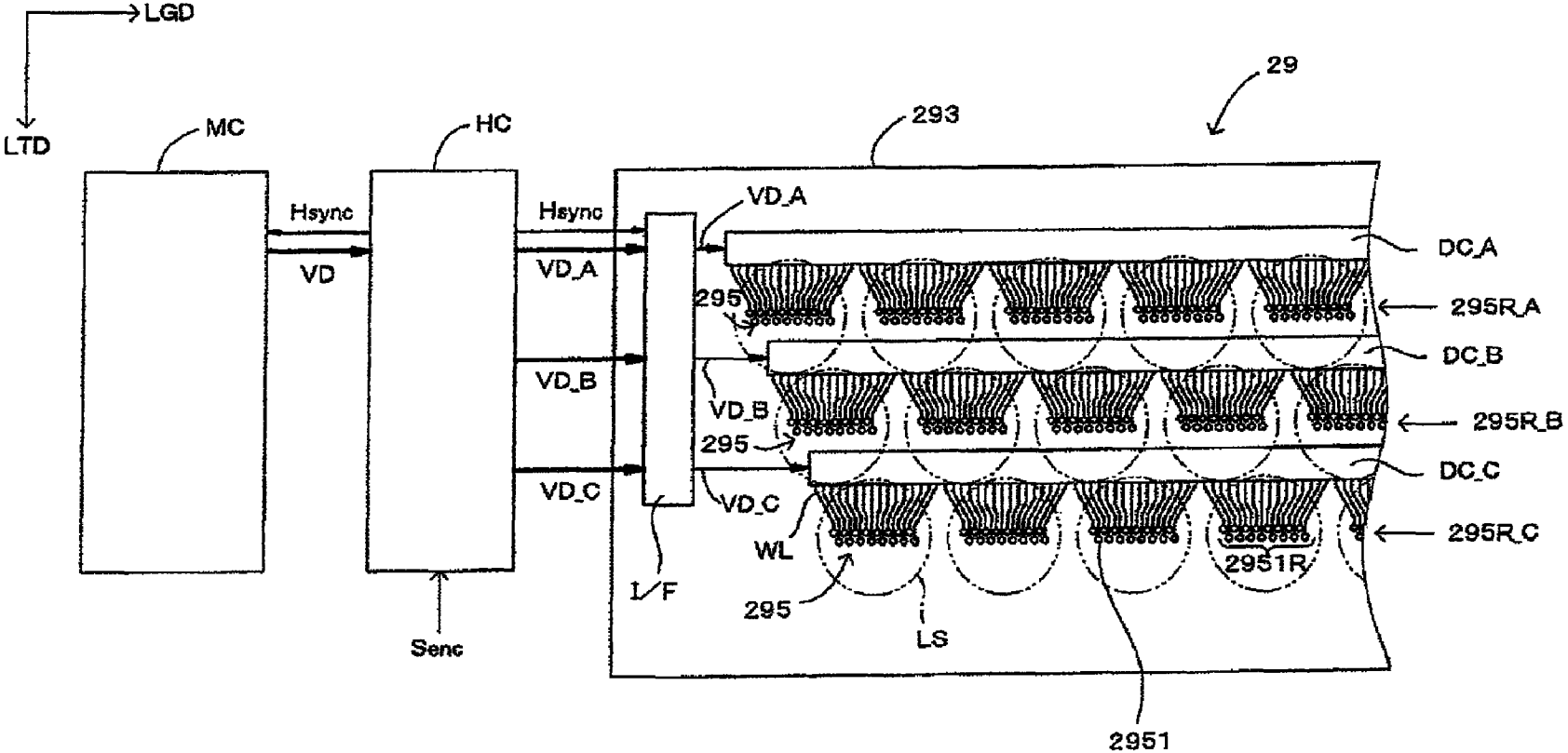
FIG. 23 is a diagram showing a configuration of the main controller and so on in a third embodiment.

FIG. 23 is a diagram showing a configuration of the main controller, the head controller, and the line head in a third embodiment. In the third embodiment, the head controller HC outputs the horizontal sync signal Hsync to the main controller MC for the video data VD. Meanwhile, the main controller MC outputs the video data VD to the head controller HC in sync with the horizontal sync signal Hsync. Further, the head controller HC, which has received the video data VD, discriminate the video data VD_A (for the light emitting element group row 295R_A), the video data VD_B (for the light emitting element group row 295R_B), and the video data VD_C (for the light emitting element group row 295R_C) corresponding respectively to the light emitting element group rows 295R_A, 295R_B, and 295R_C of the line head 29, and outputs the video data VD_A, VD_B, and VD_C toward the line head 29.

On the reverse surface of the head substrate 293 of the line head 29, there are formed three light emitting element group rows 295R (295R_A, 295R_B, and 295R_C), each of which has a plurality of light emitting element groups 295 arranged in the longitudinal direction LGD, arranged side-by-side in the width direction. Further, on the reverse surface of the head substrate 293, there are disposed three drive circuits DC_A (for the light emitting element group row 295R_A), DC_B (for the light emitting element group row 295R_B), DC_C (for the light emitting element group row 295R_C) corresponding respectively to the light emitting element group rows 295R_A, 295R_B, and 295R_C.

In each of the light emitting element groups 295, two light emitting element rows 2951R each having eight light emitting elements 2951 aligned in the longitudinal direction LGD are arranged side by side in the width direction LTD. Further, the light emitting elements 2951 in each of the light emitting element group rows 295R_A, 295R_B, and 295R_C are connected to the drive circuits DC_A, DC_B, and DC_C, respectively, via the wires WL. Therefore, each of the drive circuits DC_A, DC_B, and DC_C is capable of driving the corresponding light emitting element group rows 295R_A, 295R_B, and 295R_C via the wires WL. In a manner as described above, the light emitting element groups 295 driven by the drive circuits DC_A, DC_B, and DC_C emit light, thus forming the spot groups SG on the surface SF21 of the photoconductor drum 21.

The emission operation of such light emitting element groups 295 is controlled as follows. Firstly, each of the video data VD_A, VD_B, and VD_C transmitted from the head controller HC is temporarily stored in an interface circuit I/F. When receiving the horizontal sync signal Hsync from the head controller HC, the interface circuit I/F outputs each of the video data VD_A, VD_B, and VD_C to the drive circuits DC_A, DC_B, and DC_C (FIG. 23). Then, the drive circuits DC_A, DC_B, and DC_C drive the light emitting element groups 295 based on the video data VD_A, VD_B, and VD_C thus received, thus forming the spot groups SG. As described above, each of the light emitting elements 2951 emits light in sync with the horizontal sync signal Hsync.

Further, in the third embodiment, similarly to the first embodiment, the sub-scanning spot group pitch Psgs is set to be a value obtained by multiplying the sub-scanning pixel pitch Rsd by an integral number, and when each of the light emitting element group rows 295R emit light at the same timing, the spot latent image can be formed at each of the pixels PX. Therefore, it is possible to make the light emitting element group rows 295R_A, 295R_B, and 295R_C emit light in sync with the common horizontal sync signal Hsync, thus the simplification of the control is achieved.

Incidentally, also in the third embodiment, each of the light emitting element group rows 295R_A, 295R_B, and 295R_C expose the points at the positions different from each other in the sub-scanning direction SD at a timing according to the movement of the surface SF21 of the photoconductor drum, thereby forming the latent image. Therefore, there are some cases in which the latent image is not preferably formed due to the velocity variation of the surface SF21 of the photoconductor drum. Therefore, in the third embodiment, the encoder ECD detects the velocity of the surface SF21 of the photoconductor drum, and the horizontal sync signal Hsync is adjusted based on the result of the detection.

Figure 24:
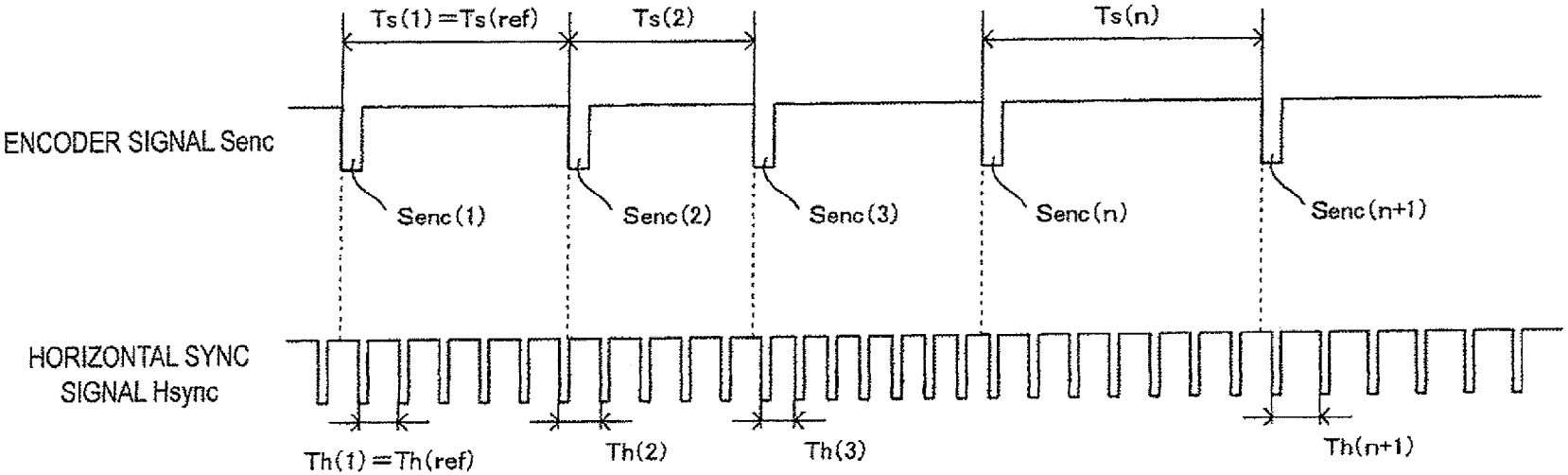
FIG. 24 is a diagram showing an adjustment operation of a horizontal sync signal in the third embodiment.

FIG. 24 is a diagram showing an adjustment operation of the horizontal sync signal executed by the head controller in the third embodiment. In the drawing, each of the encoder signals Senc and the horizontal sync signals Hsync is represented as a pulse with a low level. In the third embodiment, the horizontal sync signal is adjusted based on the difference between the moving velocity of the surface SF21 of the photoconductor drum and an ideal velocity (a reference velocity). Specifically, the horizontal sync signal Hsync is adjusted based on the difference between a reference signal interval Ts(ref) as the interval of the encoder signal Senc in the case in which the surface SF21 of the photoconductor drum is moving at the ideal velocity, and a signal interval Ts(n) of the encoder signal Senc measured actually. In the drawing, the signal interval Ts(1) between the first encoder signal Senc(1) and the second encoder signal Senc(2) is equal to the reference signal interval Ts(ref). Therefore, in the period between the first encoder signal Senc(1) and the second encoder signal Senc(2), an interval (a synchronization interval Th(1)) of the horizontal sync signal Hsync is set to a reference synchronization interval Th(ref). Then, in the case in which the signal interval Ts(2) between the second encoder signal Senc(2) and the third encoder signal Senc(3) is shorter, it is determined that the velocity of the surface of the photoconductor drum is shifted to be higher, and the synchronization interval Th(2) is set to be shorter. Specifically, the synchronization interval Th(2) is set based on the following formula.

$$Th(2)=(Ts(2)/Ts(ref))\times Th(ref)$$

In other words, in a generalized manner, the synchronization interval Th(n+1) is set based on the following formula with respect to the interval Ts(n) between the nth encoder signal Senc(n) and the n+1th encoder signal Senc(n+1).

$$Th(n+1)=(Ts(n)/Ts(ref))\times Th(ref)$$

Then, the horizontal sync signal Hsync is adjusted so that the interval of the horizontal sync signal Hsync becomes the synchronization interval Th(n+1). In a manner as described above, in the third embodiment, the horizontal sync signal Hsync is adjusted, thereby the emission timing of the light emitting elements 2951 is adjusted.

As described above, in the third embodiment, the encoder ECD detects the moving velocity of the surface SF21 (the circumferential surface) of the photoconductor drum 21, and the emission timing of the light emitting elements 2951 is adjusted based on the result of the detection. Therefore, the shift of the latent image formation position based on the variation in the moving velocity of the surface SF21 of the photoconductor drum can be prevented from occurring, thus the preferable latent image formation becomes possible.

E. Fourth Embodiment

Incidentally, in the third embodiment described above, the sub-scanning spot group pitch Pegs is set to be a value obtained by multiplying the sub-scanning pixel pitch Red by an integral number, and each of the light emitting element group rows 295R emits light at the same emission timing. However, it is also possible to set the sub-scanning spot group pitch Pegs to be a value obtained by multiplying the sub-scanning pixel pitch Rsd by a non-integral number. On this occasion, the light emitting element group rows 295R_A, 295R_B, and 295R_C are provided with horizontal sync signals Hsync_A, Hsync_B, and Hsync_C, respectively. Such a case will hereinafter be explained.

Figure 25:
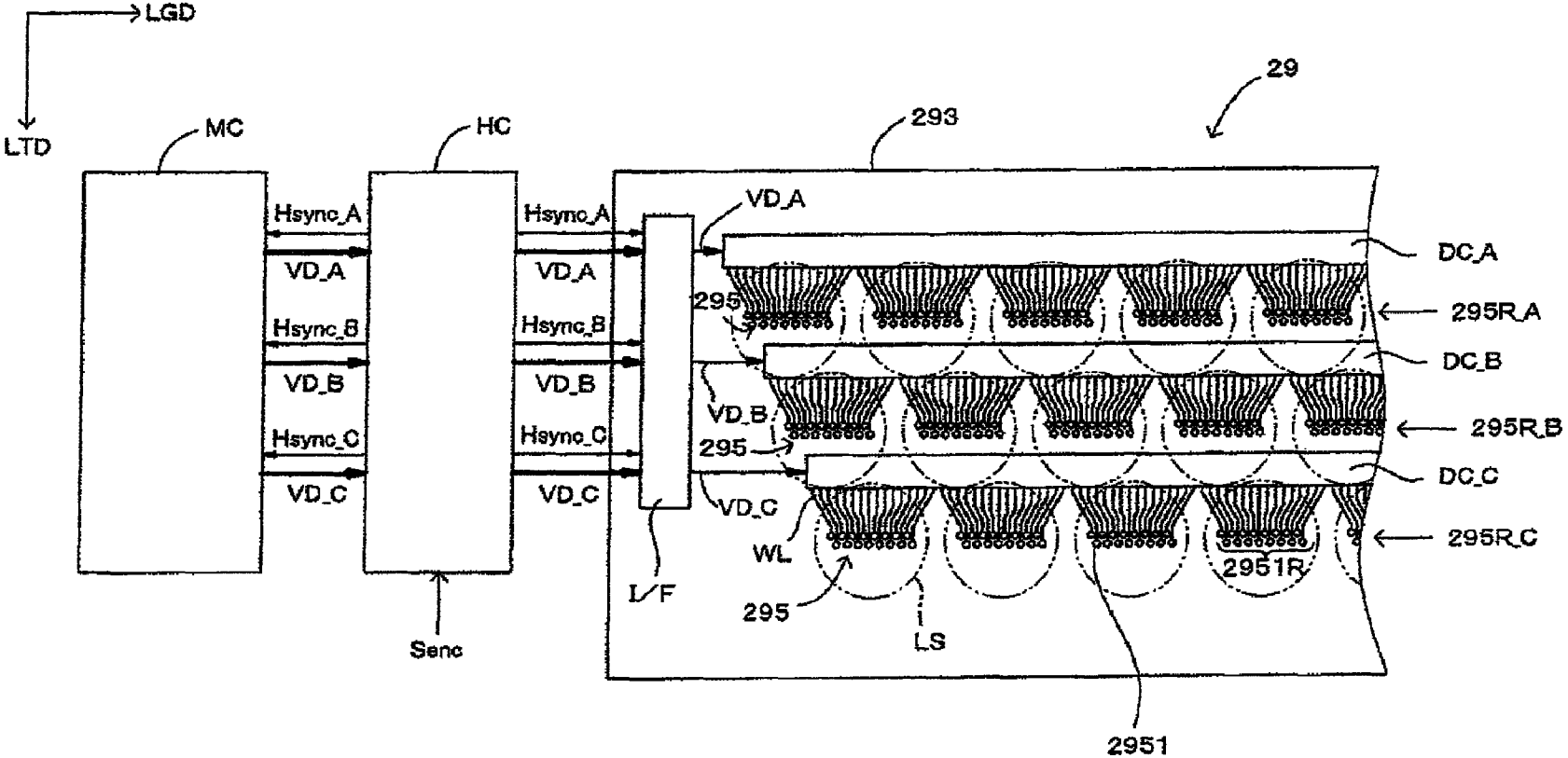
FIG. 25 is a diagram showing a configuration of the main controller and so on in a fourth embodiment.

FIG. 25 is a diagram showing a configuration of the main controller, the head controller, and the line head in a fourth embodiment. Hereinafter, different points form the third embodiment will mainly be explained, and the common parts will be denoted with the corresponding reference marks, and the explanations therefor will be omitted. In the fourth embodiment, in order for requesting the video data corresponding to the light emitting group rows 295R_A, 295R_B, and 295R_C, the head controller HC outputs three types of horizontal sync signals Hrync_A (for the light emitting element group row 295R_A), Hrync_B (for the light emitting element group row 295R_B), and Hrync_C (for the light emitting element group row 295R_C), respectively, to the main controller MC. When receiving the horizontal sync signal Hsync_A, the main controller MC outputs the video data VD_A to the head controller HC, when receiving the horizontal sync signal Hsync_B, the main controller MC outputs the video data VD_B to the head controller HC, and when receiving the horizontal sync signal Hsync_C, the main controller MC outputs the video data VD_C to the head controller HC. The head controller HC outputs each of the video data VD_A, VD_B, and VD_C, which are received from the main controller MC, to the line head 29.

In the line head 29, each of the video data VD_A, VD_B, and VD_C transmitted from the head controller HC is temporarily stored in the interface circuit I/F. The interface circuit I/F is provided with the three types of horizontal sync signals Hrync_A, Hrync_B, and Hrync_C described above input thereto. Further, when receiving the horizontal sync signal Hrync_A, the interface circuit I/F outputs the video data VD_A to the drive circuit DC_A, when receiving the horizontal sync signal Hsync_B, the interface circuit I/F outputs the video data VD_B to the drive circuit DC_B, and when receiving the horizontal sync signal Hrync_C, the interface circuit I/F outputs the video data VD_C to the drive circuit DC_C (FIG. 25). In a manner as described above, each of the light emitting group rows 295R_A, 295R_B, and 295R_C emit light in sync with the corresponding horizontal sync signals Hrync_A, Hrync_B, and Hrync_C.

Incidentally, also in the fourth embodiment, each of the light emitting element group rows 295R_A, 295R_B, and 295R_C expose the points at the positions different from each other in the sub-scanning direction SD at a timing according to the movement of the surface SF21 of the photoconductor drum, thereby forming the latent image. Therefore, there are some cases in which the latent image is not preferably formed due to the velocity variation of the surface SF21 of the photoconductor drum. Therefore, also in the fourth embodiment, the encoder ECD detects the velocity of the surface SF21 of the photoconductor drum, and the horizontal sync signals Hsync are adjusted based on the result of the detection.

Figure 26:
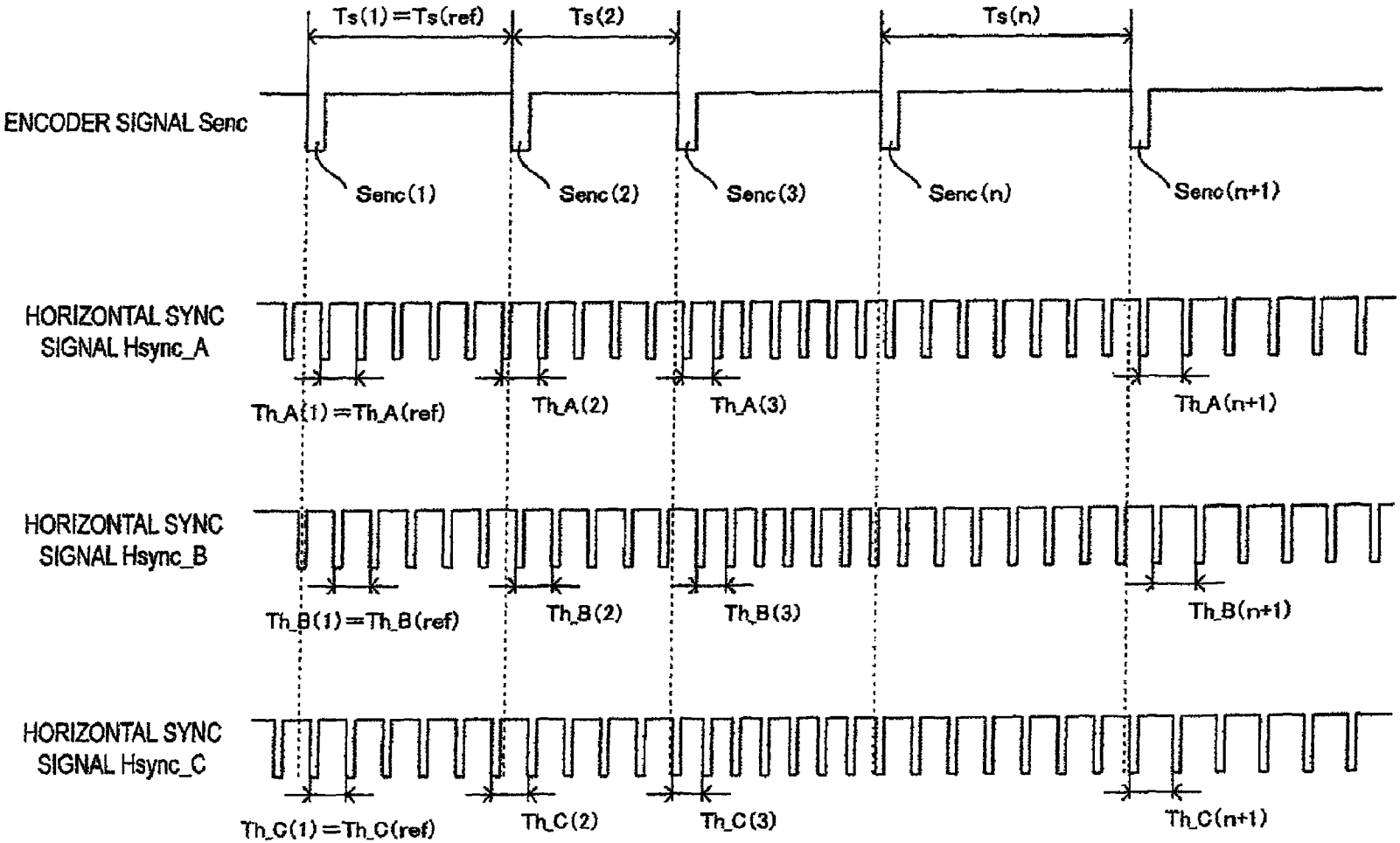
FIG. 26 is a diagram showing an adjustment operation of a horizontal sync signal in the fourth embodiment.

FIG. 26 is a diagram showing an adjustment operation of the horizontal sync signals executed by the head controller in the fourth embodiment. In the drawing, each of the encoder signals Senc and the horizontal sync signals Hrync_A, Hrync_B, and Hrync_C is represented as a pulse with a low level. In the fourth embodiment, each of the horizontal sync signals Hrync_A, Hrync_B, and Hrync_C is adjusted based on the difference between the moving velocity of the surface SF21 of the photoconductor drum and the ideal velocity (the reference velocity). It should be noted that since the adjustment operations of the horizontal sync signals Hrync_A, Hrync_B, and Hrync_C are basically the same, the adjustment operation for the horizontal sync signal Hrync_A will hereinafter mainly be explained, and the explanations of the adjustment operations for other horizontal sync signals Hrync_B and Hrync_C will be presented with the corresponding reference marks, or omitted if appropriate.

As shown in the drawing, the horizontal sync signal Hsync_A is adjusted based on the difference between a reference signal interval Ts(ref) as the interval of the encoder signal Senc in the case in which the surface SF21 of the photoconductor drum is moving at the ideal velocity, and a signal interval Ts(n) of the encoder signal Senc measured actually. In the drawing, the signal interval Ts(1) between the first encoder signal Senc(1) and the second encoder signal Senc(2) is equal to the reference signal interval Ts(ref). Therefore, in the period between the first encoder signal Senc(1) and the second encoder signal Senc(2), the interval (the synchronization interval Th_A(1)) of the horizontal sync signal Hsync_A is set to a reference synchronization interval Th_A(ref). Then, in the case in which the signal interval Ts(2) between the second encoder signal Senc(2) and the third encoder signal Senc(3) is shorter, it is determined that the velocity of the surface SF21 of the photoconductor drum is shifted to be higher, and the synchronization interval Th_A(2) is set to be shorter. Specifically, the synchronization interval Th_A(2) is set based on the following formula.

$$Th_A(2)=(Ts(2)/Ts(ref))\times Th_A(ref)$$

In other words, in a generalized manner, the synchronization interval Th_A(n+1) is set based on the following formula with respect to the interval Ts(n) between the nth encoder signal Senc(n) and the n+1th encoder signal Senc(n+1).

$$Th_A(n+1)=(Ts(n)/Ts(ref))\times Th_A(ref)$$

Then, the horizontal sync signal Hsync_A is adjusted so that the interval of the horizontal sync signal Hsync_A becomes the synchronization interval Th_A(n+1).

Further, the horizontal sync signals Th_B(n+1), Th_C(n+1) of the other horizontal sync signals Hsync_B, Hsync_C are also set based on substantially the same formulas.

$$Th_B(n+1)=(Ts(n)/Ts(ref))\times Th_B(ref)$$

$$Th_C(n+1)=(Ts(n)/Ts(ref))\times Th_C(ref)$$

In a manner as described above, in the fourth embodiment, the horizontal sync signals Hrync_A, Hrync_B, and Hrync_C are adjusted, thereby the emission timing of the light emitting elements 2951 is adjusted.

As described above, in the fourth embodiment, the encoder ECD detects the moving velocity of the surface SF21 (the circumferential surface) of the photoconductor drum 21, and the emission timing of the light emitting elements 2951 is adjusted based on the result of the detection. Therefore, the shift of the latent image formation position based on the variation in the moving velocity of the surface SF21 of the photoconductor drum can be prevented from occurring, thus the preferable latent image formation becomes possible.

F. Fifth Embodiment

Incidentally, the image forming device is capable of sequentially forming a plurality of linear latent images, each of which has a length corresponding to one page in the main-scanning direction MD, in the sub-scanning direction SD, thereby forming a two-dimensional latent image corresponding to one page. Therefore, in the fifth embodiment, this latent image formation operation will be explained. It should be noted that in order for making it easy to understand the latent image formation operation, the explanation will be presented focusing attention to one linear latent image to be formed at a predetermined position (the position indicated by the arrow FL in FIGS. 27 through 29) on the circumferential surface of the photoconductor drum 21.

Figure 27:
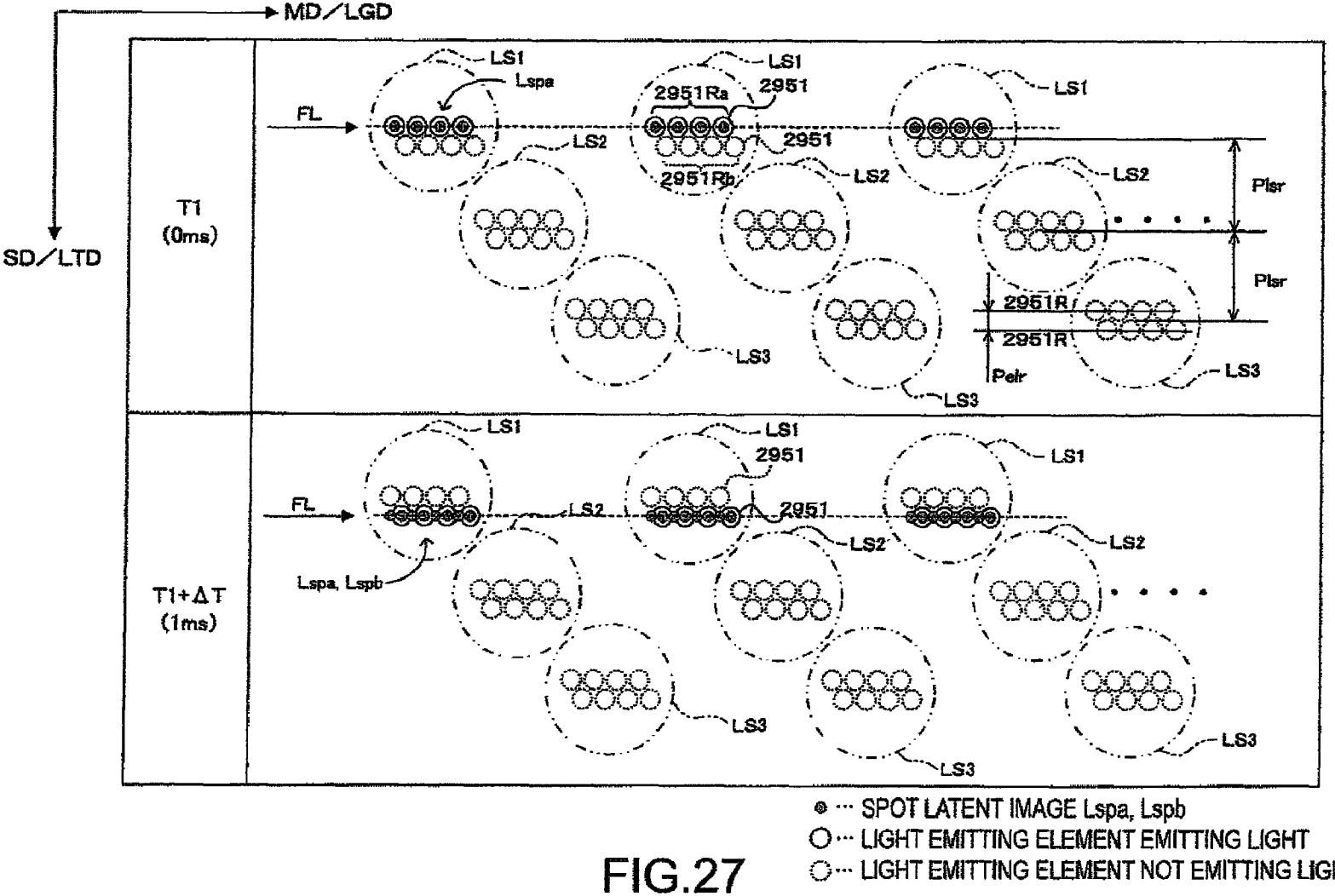
FIG. 27 is an explanatory diagram of emission timing control of the light emitting elements in the latent image forming operation.
Figure 28:
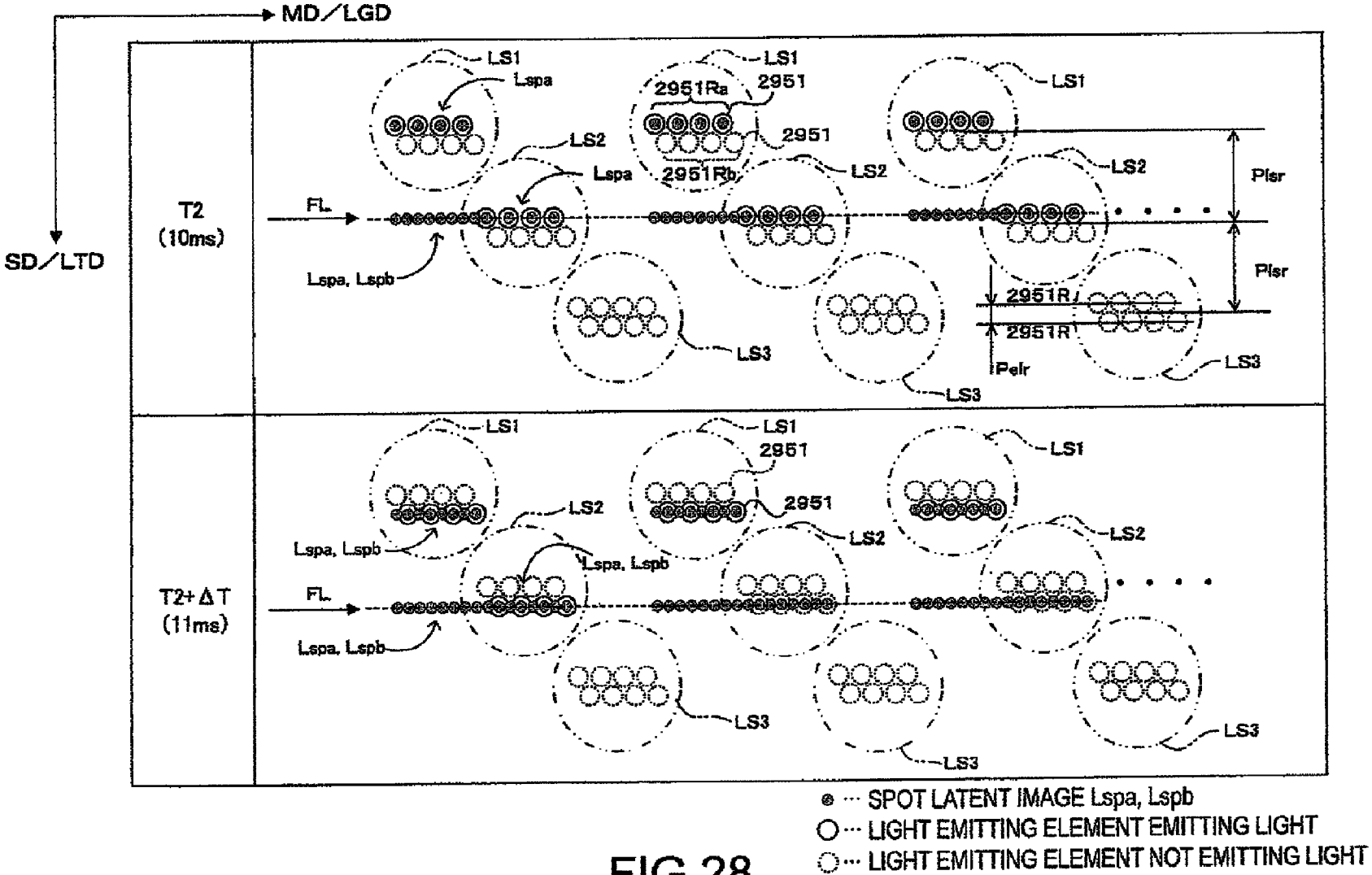
FIG. 28 is an explanatory diagram of emission timing control of the light emitting elements in the latent image forming operation.
Figure 29:
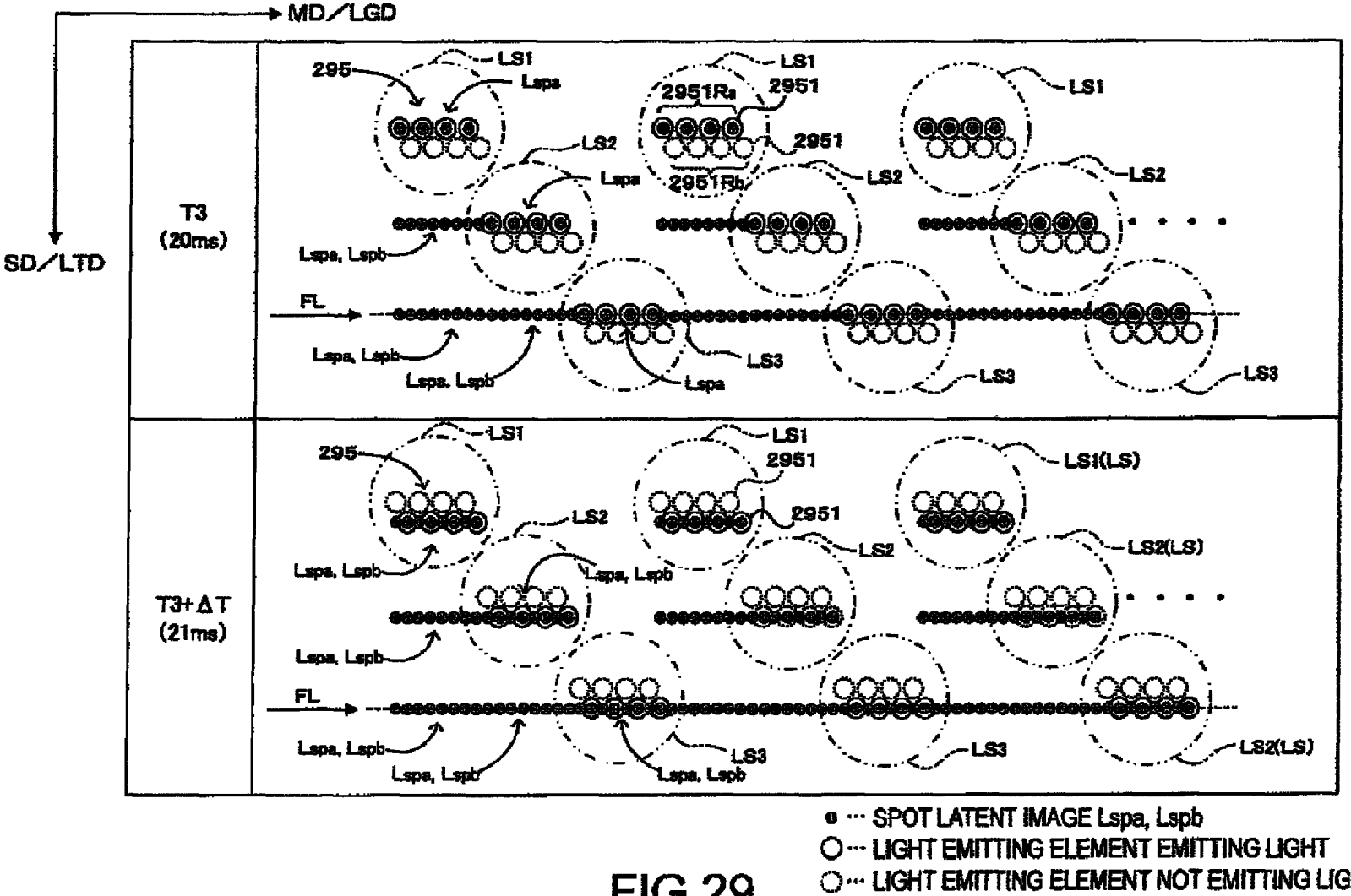
FIG. 29 is an explanatory diagram of emission timing control of the light emitting elements in the latent image forming operation.

FIGS. 27, 28, and 29 are explanatory diagrams of the emission timing control of the light emitting elements in the latent image formation operation, and correspond to the case of forming a plan view of the process of sequentially forming the latent image using the light emitting elements. In the drawing, the dotted white circle represents the light emitting element 2951 not emitting light, the solid white circle represents the light emitting element 2951 emitting light, and the hatched circle represents the spot latent image Lspa. Further, in the light emitting element group 295, the light emitting element row on the upstream side in the sub-scanning direction SD is denoted with the reference mark 2951Ra, and the light emitting element row on the downstream side in the sub-scanning direction SD is denoted with the reference mark 2951Rb.

In the present embodiment, it is assumed that the light emitting element row pitch (the distance between the light emitting element rows) Pelr=0.1 mm, the lens row pitch (the distance between the lens rows) Plsr=1 mm, and the circumferential velocity of the photoconductor is equal to 100 mm/s. Further, the spot group pitch (the distance between the spot groups) Psgs is a value obtained by multiplying the sub-scanning pixel pitch (the distance between the sub-scanning pixels) Rsd by an integral number, while the spot row pitch (the distance between the spot rows) Pspr is a value obtained by multiplying the sub-scanning pixel pitch (the distance between the sub-scanning pixels) Rsd by a non-integral number (not shown). Further, for the sake of easier understanding of the emission timing control, in the present embodiment, it is assumed that the lens LS1 is an electing lens with equal magnification.

As the circumferential surface (the surface of the latent image carrier) of the photoconductor drum 21 moves, the predetermined position FL on which the linear latent image is formed moves in the sub-scanning direction SD. As is explained below, each of the light emitting elements 2951 emits light at the timing at which the predetermined position FL reaches the position where each of the light emitting elements 2951 can form the spot SP. Thus, the linear latent image can be formed at the predetermined position. A specific operation is as follows.

As shown in FIG. 27, at the time point T1 (=0 ms), the light emitting element row 2951Ra for emitting light imaged by the lenses LS1 located on the uppermost stream side in the sub-scanning direction SD emits light, and a plurality of spot latent images Lspa aligned straight in the main-scanning direction MD at the predetermined position FL is formed. Further, at the time point T1+ΔT (=1 ms) after the time ΔT (=1 ms) has elapsed, the light emitting element row 2951Rb for emitting light imaged by the lenses LS1 emits light, and a plurality of spot latent images Lspb aligned in the main-scanning direction MD at the predetermined position FL is formed. By thus shifting the emission of the light emitting element row 2951Ra and the emission of the light emitting element row 2951Rb from each other as much as the time ΔT, the plurality of spot latent images Lspa formed by the light emitting element row 2951Ra and the plurality of spot latent images Lspb formed by the light emitting element row 2951Rb are aligned straight in the main-scanning direction MD at the predetermined position FL.

Then, as shown in FIG. 28, at the time point T2 (=10 ms), the light emitting element row 2951Ra for emitting light imaged by the lenses LS2 emits light, and subsequently at the time point T2+ΔT (=11 ms), the light emitting element row 2951Rb for emitting light imaged by the lenses LS2 emits light. In this manner, a plurality of spot latent images Lspa, Lspb aligned straight in the main-scanning direction MD at the predetermined position FL is formed by the lenses LS2. Further, there is provided a time difference (T2−T1) between the emission of the light emitting element row 2951Ra (2951Rb) for emitting light imaged by the lenses LS1 and the emission of the light emitting element row 2951Ra (2951Rb) for emitting light imaged by the lenses LS2. Thus, the plurality of spot latent images Lspa, Lspb formed by the lenses LS1 and the plurality of spot latent images Lspa, Lspb formed by the lenses LS2 are aligned straight in the main-scanning direction MD at the predetermined position FL.

Further, as shown in FIG. 29, at the time point T3 (=20 ms), the light emitting element row 2951Ra for emitting light imaged by the lenses LS3 emits light, and subsequently at the time point T3+ΔT (=21 ms), the light emitting element row 2951Rb for emitting light imaged by the lenses LS3 emits light. In this manner, a plurality of spot latent images Lspa, Lspb aligned straight in the main-scanning direction MD is formed by the lenses LS3. Further, there is provided a time difference (T3−T2) between the emission of the light emitting element row 2951Ra (2951Rb) for emitting light imaged by the lenses LS2 and the emission of the light emitting element row 2951Ra (2951Rb) for emitting light imaged by the lenses LS3. Thus, the plurality of spot latent images Lspa, Lspb formed by the lenses LS1, LS2 and the plurality of spot latent images Lspa, Lspb formed by the lenses LS3 are aligned straight in the main-scanning direction MD. In a manner as described above, one linear latent image (one page length linear latent image) having a length of one page in the main-scanning direction MD is formed.

It should be noted that as shown in FIG. 28, since the spot group pitch Psgs is set to be a value obtained by multiplying the sub-scanning pixel pitch Rsd by an integral number, the light emitting element row 2951Ra (2951Rb) corresponding to the lenses LS1 also emits light at the same time as the light emitting element row 2951Ra (2951Rb) corresponding to the lenses LS2 emits light. The light emitting element row 2951Ra (2951Rb) corresponding to the lenses LS1 is for forming the latent image at other positions than the predetermined position FL. Further, similarly in FIG. 29, the light emitting element rows 2951Ra (2951Rb) corresponding respectively to the lenses LS1, LS2, and LS3 emit light simultaneously. In contrast, since the spot row pitch Pspr is a value obtained by multiplying the sub-scanning pixel pitch Rsd by a non-integral number, there is no chance for the light emitting element row 2951Ra and the light emitting element row 2951Rb to emit light simultaneously.

Incidentally, there are some cases in which the variation in the circumferential velocity of the photoconductor drum 21 causes unevenness in the one page length linear latent image. For example, as a result of the variation in the velocity of the photoconductor drum 21 in the period from the time point of 0 ms to the time point of 10 ms, there are some cases in which the predetermined position FL goes beyond the spot formation position of the lenses LS2 or the predetermined position do not reach the spot formation position at the time point of 10 ms (FIGS. 27, 28). Therefore, there are some cases in which the spot latent images Lspa, Lspb formed by the lenses LS1 and the spot latent images Lspa, Lspb formed by the lenses LS2 are shifted from each other in the sub-scanning direction SD.

Therefore, in the present embodiment, the encoder ECD as shown in FIGS. 18 and 19 detects (a detection process) the position of the circumferential surface of the photoconductor drum 21, and the head controller blocks 541Y, 541M, 541C, and 541K adjust (a latent image formation process) the emission timing of the light emitting elements 2951 based on the result of the detection by the encoder ECD. Specifically, the time (corresponding to the time difference (T2−T1)) the position FL of the surface of the photoconductor drum 21 takes to move from the position (a first position) where the light emitting elements 2951 for emitting light to be imaged by the lenses LS1 (a first imaging optical system) form spots SP to the position (a second position) where the light emitting elements 2951 for emitting light to be imaged by the lenses LS2 (a second imaging optical system) form spots SP is detected. Further, the time from when the light emitting elements 2951 for emitting light to be imaged by the lenses LS1 emit light to when the light emitting elements 2951 for emitting light to be imaged by the lenses L52 emit light is controlled based on the result of the detection. Thus, the plurality of spot latent images Lspa, Lspb formed by the lenses LS1 and the plurality of spot latent images Lspa, Lspb formed by the lenses LS2 are aligned straight in the main-scanning direction MD at the predetermined position FL. Further, similarly, the time (corresponding to the time difference (T3−T2)) the position FL of the surface of the photoconductor drum 21 takes to move from the position (a first position) where the light emitting elements 2951 for emitting light to be imaged by the lenses LS2 (a first imaging optical system) form spots SP to the position (a second position) where the light emitting elements 2951 for emitting light to be imaged by the lenses LS3 (a second imaging optical system) form spots SP is detected. Further, the time from when the light emitting elements 2951 for emitting light to be imaged by the lenses LS2 emit light to when the light emitting elements 2951 for emitting light to be imaged by the lenses LS3 emit light is controlled based on the result of the detection. Thus, the plurality of spot latent images Lspa, Lspb formed by the lenses LS2 and the plurality of spot latent images Lspa, Lspb formed by the lenses LS3 are aligned straight in the main-scanning direction MD at the predetermined position FL. In a manner as described above, it becomes possible to form the one page length linear latent image with no unevenness independently of the variation in the circumferential velocity of the photoconductor drum 21, thus it becomes possible to execute preferable latent image formation operation.

It should be noted that in the fifth embodiment, since the time difference ΔT between the emission of the light emitting element row 2951Ra and the emission of the light emitting element row 2951Rb belonging to the same light emitting element group 295 is sufficiently short, the adjustment based on the position of the photoconductor drum 21 is not executed on the time difference ΔT assuming that there is no substantial influence of the variation in the velocity of the photoconductor drum 21 during the time difference ΔT on the latent image formation position. However, in the case in which the variation in the velocity of the photoconductor drum 21 during the time difference ΔT exerts a considerable influence on the latent image formation position, it is also possible to adjust the time difference ΔT based on the position of the photoconductor drum 21. In other words, the time from the emission of the light emitting elements 2951 (the first light emitting element) in the light emitting element row 2951Ra to the emission of the light emitting elements 2951 (the third light emitting element) in the light emitting element row 2951Rb can be adjusted. Thus, the latent image by the light emitting element row 2951Ra and the latent image by the light emitting element row 2951Rb are aligned straight in the main-scanning direction MD at the predetermined position FL.

G. Sixth Embodiment

Figure 30:
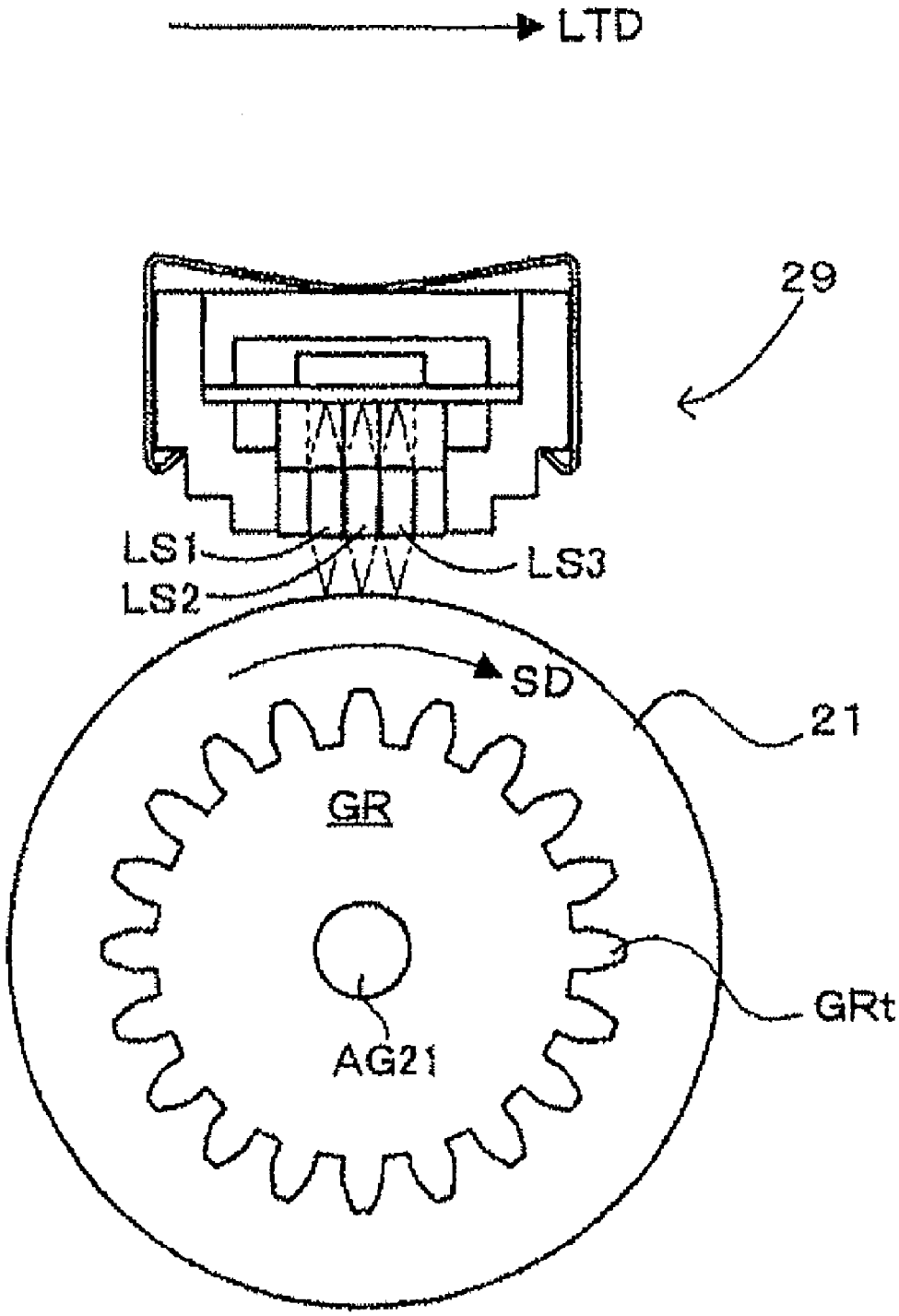
FIG. 30 is a diagram showing a photoconductor drum and a line head in a sixth embodiment.
Figure 31:
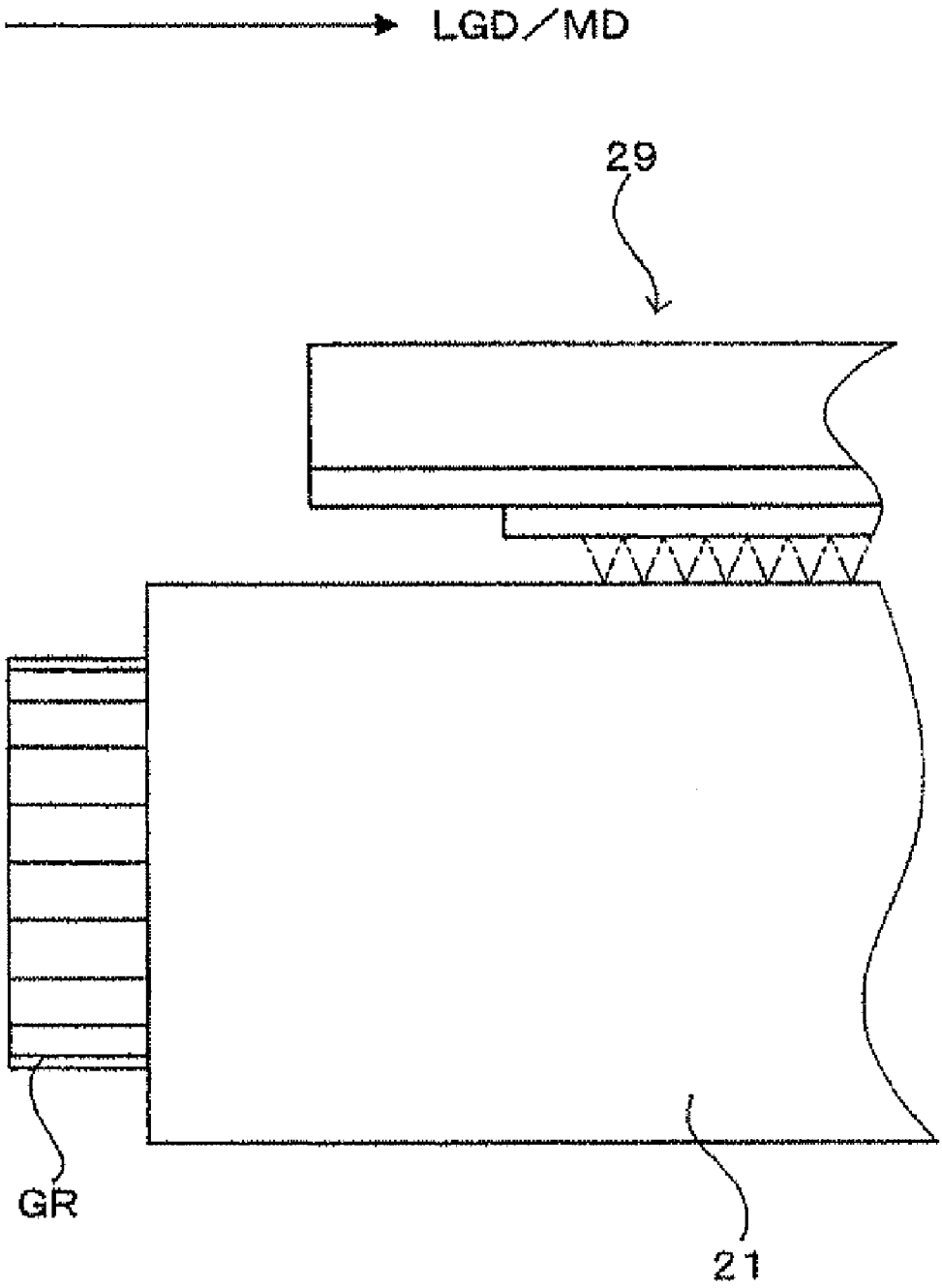
FIG. 31 is a diagram showing a photoconductor drum and a line head in a sixth embodiment.

FIG. 30 is a diagram of the photoconductor drum and the line head in the sixth embodiment viewed from the longitudinal direction (the main-scanning direction), and the line head 29 is shown with a partially cross-sectional view. FIG. 31 is a diagram of the photoconductor drum and the line head in the sixth embodiment viewed from the width direction (the sub-scanning direction). In the present embodiment, the photoconductor drum 21 is provided with a gear GR. The gear GR has a substantially disc-like shape, and provided with a plurality of gear teeth GRt arranged on the circumferential surface at a predetermined pitch. The center of the gear GR is attached to the rotating shaft of the photoconductor drum 21, and the plurality of gear teeth GRt is arranged radially from the rotational center of the photoconductor drum 21. Further, as shown in FIG. 31, the gear GR is integrally connected to the photoconductor drum 21 without using a coupling intervening therebetween. Further, an engine section EG (a drive source) applies driving power to the gear GR. Specifically, the driving power is transmitted thereto via another gear (not shown) engaged with the gear teeth GRt. Thus, the photoconductor drum 21 rotates. As described above, the photoconductor drum 21 is rotated by the external force acting on the gear GR, and the circumferential surface of the photoconductor drum 21 moves in the sub-scanning direction SD.

In such a configuration of driving the photoconductor drum 21 by the gear GR, there are some cases in which a variation in the circumferential velocity of the photoconductor drum 21 is caused by, for example, the variation in the pitch of the gear teeth GRt. Therefore, with respect to such a configuration, it is preferable to adjust the time difference (e.g., the time difference (T2−T1)) between the emission of the light emitting elements 2951 for emitting light to be imaged by the first lenses LS (e.g., LS1) to the emission of the light emitting elements 2951 for emitting light to be imaged by the second lenses LS (e.g., LS2) in accordance with the position of the circumferential surface of the photoconductor drum 21 based on the result of the detection of the position of the photoconductor drum 21.

H. Seventh Embodiment

Incidentally, the velocity variation of the circumferential surface of the photoconductor drum 21 caused in the configuration using the gear GR described above includes periodicity. The velocity variation period can easily be obtained from the inverse of a value obtained by multiplying the number of rotations of the photoconductor drum 21 per unit time by the number (number of teeth) of the teeth GRt of the gear GR, and can specifically be obtained by the following formula.

$$(\text{velocity variation period } [s]) = 60/(CT21 \times NT)$$

Here, the value CT21 is the number of rotations per unit time [rpm] of the photoconductor drum 21, and the NT is the number of teeth of the gear GR. Further, it is preferable that the lens row pitch Plsr, namely the distance (lens-to-lens distance) Plsr between the lens LS1 and the lens LS2 in the width direction LTD, or the distance Plsr between the lens LS2 and the lens LS3 in the width direction LTD is longer than the value (the distance of the photoconductor drum 21) obtained by multiplying the velocity variation period by the average value of the circumferential velocity of the photoconductor drum. For example, assuming CT21=60[rpm] and (the number of teeth)=40, (velocity variation period)=0.025 [s] is obtained. Therefore, assuming that the average value of the circumferential velocity of the photoconductor drum is 94.2 [mm/s], the value obtained by multiplying the velocity variation period by the average value of the circumferential velocity of the photoconductor drum becomes 2.355 [mm]. Therefore, it is preferable that the lens-to-lens distance Plsr is equal to or longer than 2.36 [mm]. In particular, it is preferable that the lens-to-lens distance Plsr is set to be 25 through 100 times as large as the value obtained by multiplying the velocity variation period by the average value of the circumferential velocity of the photoconductor drum.

I. Others

As described above, in the embodiments described above, the main-scanning direction MD and the longitudinal direction LGD correspond to "a first direction" of the invention, the sub-scanning direction SD and the width direction LTD correspond to "a second direction" of the invention, the lenses LS correspond to "an imaging optical system" of the invention, the photoconductor drum 21 corresponds to "a latent image carrier" of the invention, and the surface SF21 (circumferential surface) of the photoconductor drum 21 corresponds to "a surface of the latent image carrier" of the invention. Further, the head controller HC corresponds to "a control section" of the invention, the encoder ECD corresponds to "a detection section" of the invention, and the photo sensor SC corresponds to "an optical sensor" of the invention. Further, the relationship between the lens LS1 and the lens LS2 (or the lens LS2 and the lens LS3) corresponds to the relationship between "a first imaging optical system" and "a second imaging optical system" of the invention. Further, the line head 29 corresponds to "an exposure head" of the invention.

It should be noted that the invention is not limited to the embodiment described above, but can variously be modified besides the embodiment described above within the scope of the invention. For example, in the encoder ECD in the above embodiments, one photo sensor SC is provided (FIG. 19). However, the number of the photo sensors SC is not limited thereto, but can be two or more than two. Therefore, the encoder ECD can be configured as described below, for example.

Figure 32:
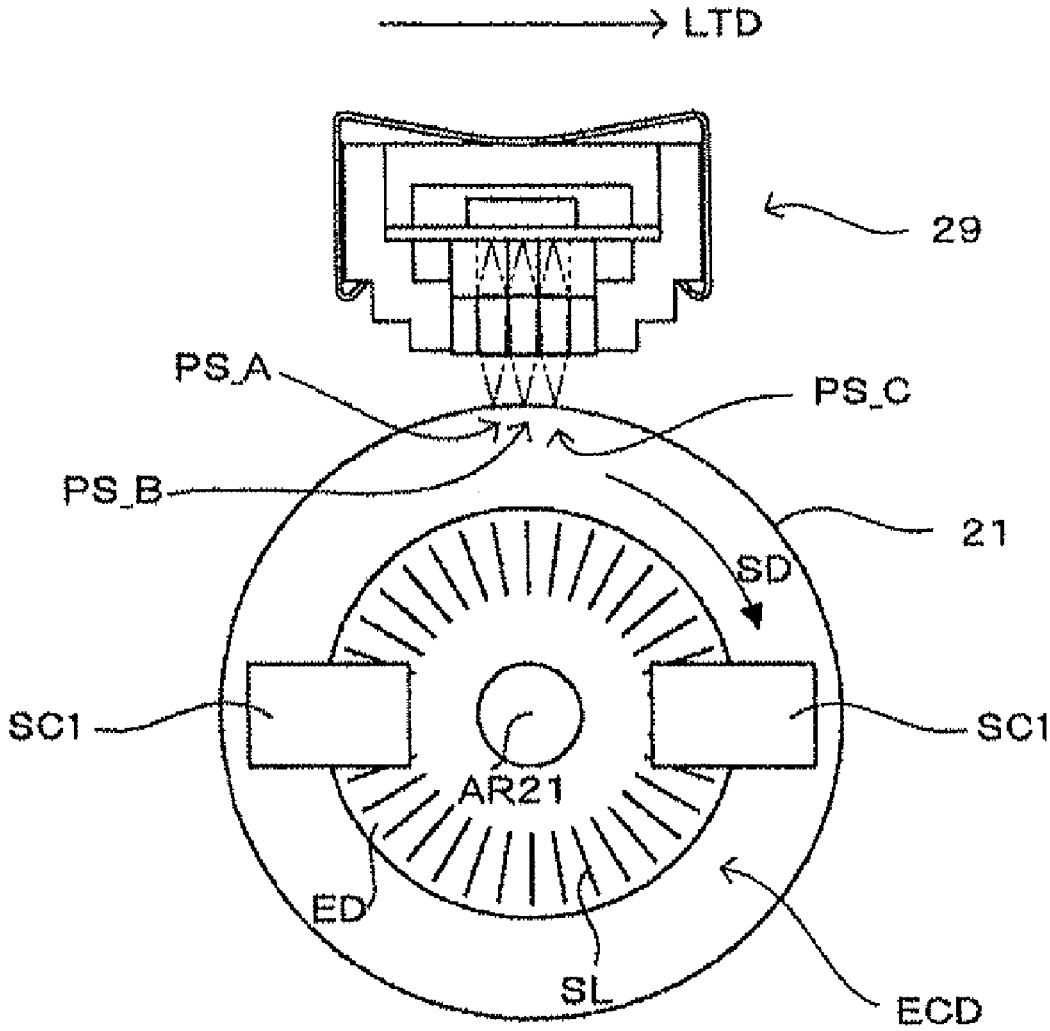
FIG. 32 is a diagram showing another configuration of the encoder.

FIG. 32 is a diagram showing another configuration of the encoder. In the following explanation, the different points from the encoder shown in FIG. 19 will mainly be described, and the common sections are denoted with the corresponding reference marks, and the description therefor will be omitted. In the encoder ECD shown in the drawing, two photo sensors SC1, SC2 are provided. These two photo sensors SC1, SC2 are disposed on both sides of the rotating shaft AR21 of the photoconductor drum 21 in the width direction LTD. In other words, the two photo sensors SC1, SC2 are disposed 2-fold symmetrically around the rotating shaft AR21. Further, when the light receiving section (not shown) of each of the photo sensors SC1, SC2 detects the light passing through the slit SL, the detection signal of each of the photo sensors SC1, SC2 can be obtained. A sum of the detection signals of the photo sensors SC1, SC2 thus obtained is output to the engine controller EC as the encoder signal Senc.

As described above, in the encoder ECD shown in FIG. 32, the two photo sensors SC1, SC2 are disposed (in the radial direction of the photoconductor drum 21) on both sides of the rotating shaft AR21 of the photoconductor drum 21 in the width direction LTD, and the sum of the detection signals of the photo sensors SC1, SC2 is output to the engine controller EC as the encoder signal Senc. Therefore, for example, even in the case in which the encoders ECD are attached eccentrically around the rotating shaft AR21 of the photoconductor drum 21, it becomes possible to cancel the eccentric component of the signals by taking the sum of the detection signals of the photo sensors SC1, SC2. Therefore, it becomes possible to stably obtain the encoder signal Senc, thus the detection of the velocity of the surface of the photoconductor drum with high accuracy becomes possible.

Further, in the embodiments described above, the emission timing of the light emitting elements is adjusted based on the difference between the moving velocity of the surface of the photoconductor drum and the ideal velocity. However, it is also possible to configure that the emission timing of the light emitting element is adjusted based on the difference between the moving velocity of the surface of the photoconductor drum and the average value of the moving velocity. Specifically, it is possible to perform the adjustment operation as shown in FIG. 20 using, for example, the interval of the encoder signal Senc in the case in which the surface SF21 of the photoconductor drum moves at an average velocity as the reference signal interval Ts(ref). In such a configuration, since the emission timing of the light emitting elements 2951 is adjusted based on the shift of the moving velocity of the surface of the photoconductor drum from the average value, it becomes possible to efficiently prevent the shift of the latent image formation position, thus the preferable latent image formation becomes possible.

Further, although in the embodiment described above, both of the main-scanning resolution and the sub-scanning resolution are 600 dpi, the resolutions are not limited to 600 dpi. In particular, regarding the sub-scanning resolution, the resolution higher than 600 dpi can be realized with relative ease by breaking the emission time of the light emitting elements 2951 into small parts using pulse width modulation control called PWM control. Therefore, it is possible to increase the sub-scanning resolution to be 2400 dpi while setting the main-scanning resolution to 600 dpi. On this occasion, since the sub-scanning resolution is four times as high as the main-scanning resolution, the sub-scanning pixel pitch Rsd becomes one fourth of the main-scanning pixel pitch Rmd.

Further, although the light emitting element group column 295C is formed of the three light emitting element groups 295 in the first through the fourth embodiments, the number of the light emitting element groups 295 composing the light emitting element group column 295C is not limited thereto, but can be two or more.

Further, although the spot group SG is composed of the two spot rows SPR in the first through the fourth embodiments, the number of spot rows SPR composing the spot group SG is not limited thereto, but can be one, or three or more.

Further, although the spot row SPR is composed of four spots SP in the first and the second embodiments, the number of spots SP forming the spot row SPR is not limited thereto.

Further, although the light emitting element group 295 is composed of two light emitting element rows 2951R in the first through the fourth embodiments, the number of light emitting element rows 2951R forming the light emitting element group 295 is not limited thereto.

Figure 33:
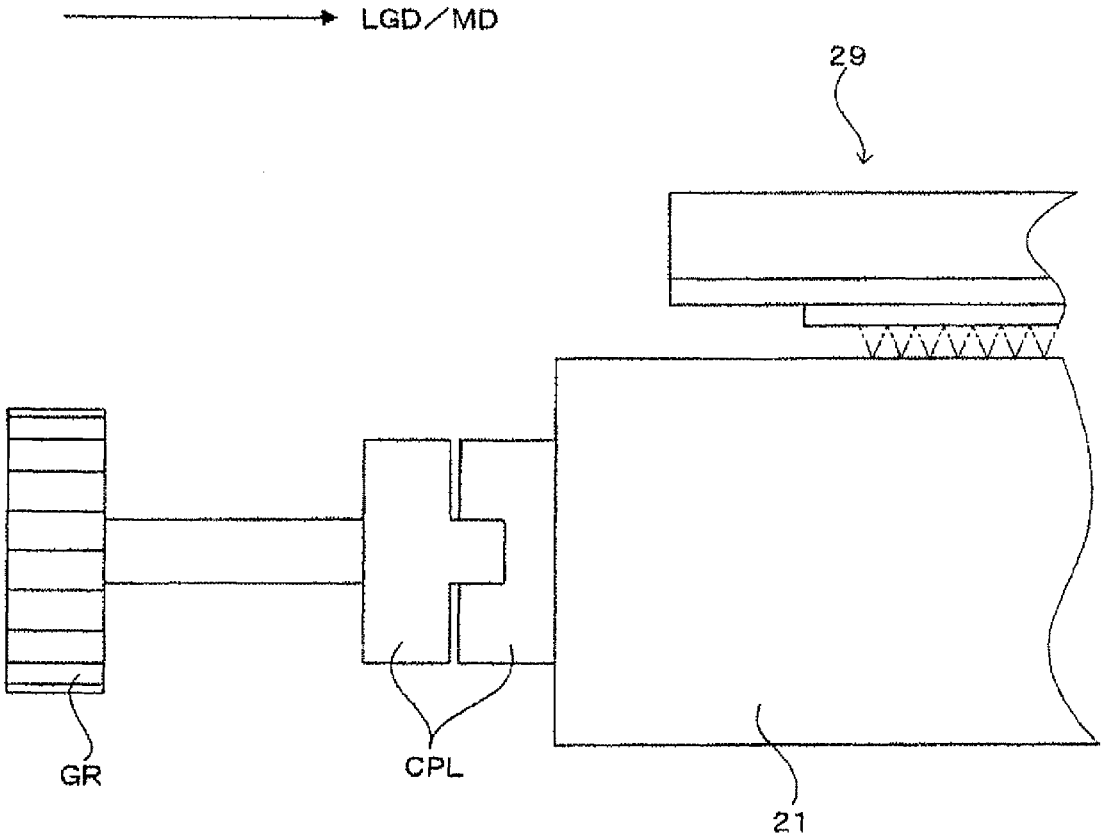
FIG. 33 is a diagram showing another connection condition between a gear and a photoconductor drum.

Further, in the sixth embodiment, the gear GR is integrally connected to the photoconductor drum 21. However, it is possible to configure the embodiment as shown in FIG. 33. FIG. 33 is a diagram showing another connection condition between the gear and the photoconductor drum. In the drawing, the gear GR is connected to the photoconductor drum 21 via the coupling CPL.

J. Specific Examples

Although a specific example of the invention will hereinafter be described, it is obvious that the invention is not limited by the specific example described below, and can be put into practice with appropriate modification within the scope of the invention described in the anteroposterior descriptions, either of which is included in the scope and sprit of the present invention.

Figure 34:
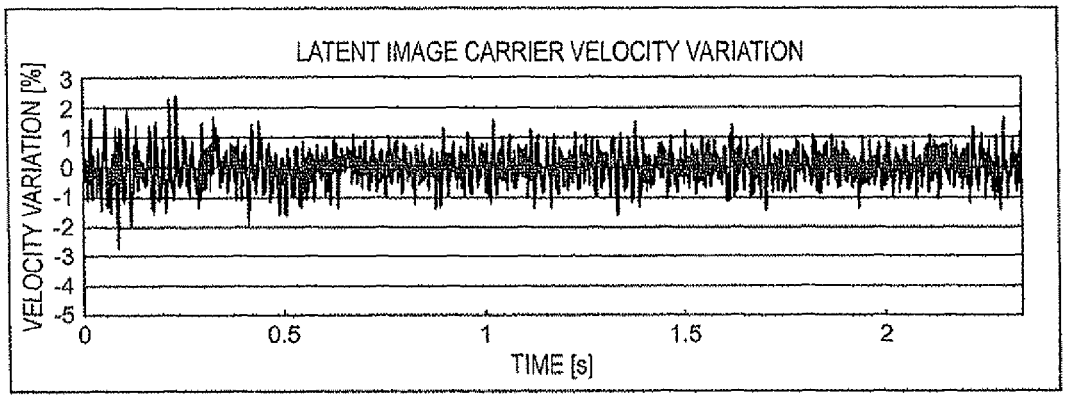
FIG. 34 illustrates diagrams showing an embodiment of the invention.
Figure 34:
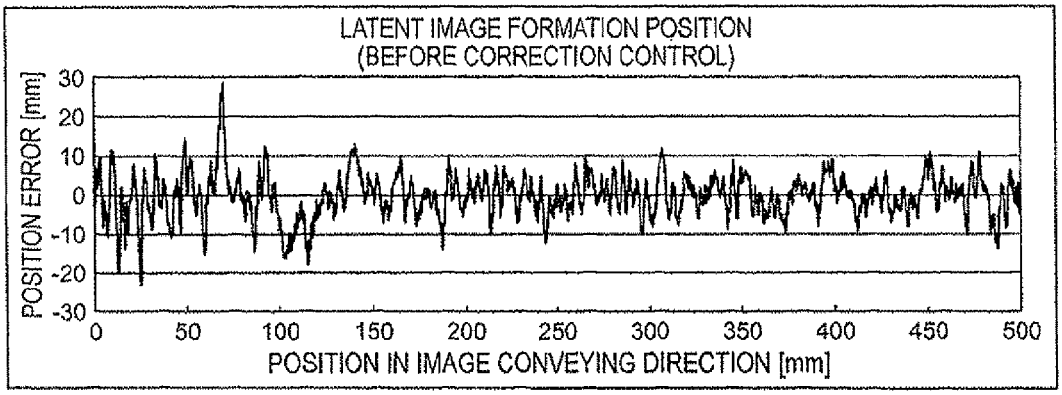
Figure 34:
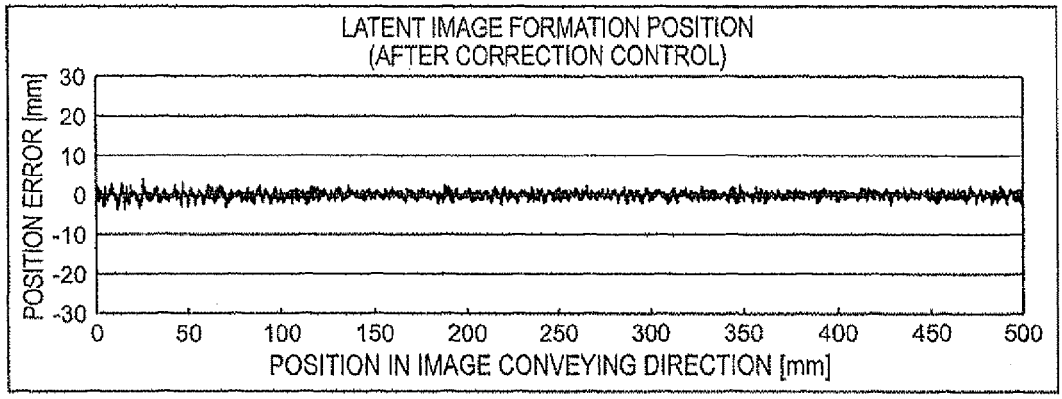

FIG. 34 illustrates diagrams which show the specific example of the invention, and show the effectiveness of the invention. Firstly, the "VELOCITY VARIATION OF LATENT IMAGE CARRIER" section on the top of the drawing will be explained. The graph described in the section shows the velocity variation of the moving velocity of the surface of the latent image carrier. In other words, in this graph, the horizontal axis represents time [s], and the vertical axis represents the velocity variation of the surface of the latent image carrier. It should be noted that the velocity variation is described as the shift from the average value of the moving velocity. As is understood from the graph, in the specific example, the moving velocity of the surface of the latent image carrier has a velocity variation of greater than ±2%.

Then, the "LATENT IMAGE FORMATION POSITION (BEFORE CORRECTION CONTROL)" section on the middle of FIG. 34 will be explained. The graph described on the section shows the latent age formation position in the case of forming the latent image without performing the correction control in the condition in which the velocity variation described above occurs. Here, the correction control denotes the control of performing the adjustment of the emission timing explained in the first through the fourth embodiments. Specifically, the graph has the horizontal axis representing position [mm] in the image conveying direction (corresponding to the position in the sub-scanning direction SD), and has the vertical axis representing position error [μm]. Here, the position error corresponds to the shift between the position at which the latent image is to be originally formed and the position at which the latent image has actually been formed. As will be understood from the graph, in the condition without the correction control, the maximum position error of about 30 [μm] occurs.

Then, the "LATENT IMAGE FORMATION POSITION (AFTER CORRECTION CONTROL)" section on the bottom of FIG. 34 will be explained. The graph described on the section shows the latent image formation position in the case of forming the latent image while performing the correction control in the condition in which the velocity variation described above occurs. Specifically, the graph has the horizontal axis representing position [mm] in the image conveying direction, and has the vertical axis representing position error [μm]. As is understood from the graph, by performing the correction control, the position error is suppressed to a few [μm]. As described above, in the present specific example, it has proved that by forming the latent image while performing the correction control, it is possible to suppress the influence of the velocity variation of the surface of the latent image carrier, thus the preferable latent image formation can be performed.

What is claimed is:

1. An image forming device comprising:

an exposure head having a first light emitting element that emits light, a second light emitting element arranged in a first direction of the first emitting element, a third light emitting element arranged in a second direction perpendicular to the first direction of the first emitting element, a fourth light emitting element arranged in the second direction, a first imaging optical system that images light emitted from the first, second and third light emitting elements, and a second imaging optical system arranged in the second direction that images light emitted from the fourth emitting element;

a latent image carrier that moves in the second direction, wherein the latent image carrier is a photoconductor drum rotatable in the second direction;

a detection section that detects a moving time that the latent image carrier takes to move from a first position to a second position in the second direction;

a control section that controls an emission time interval between an emission timing of the first light emitting element and an emission timing of the fourth light emitting element based on a detection result of the detection section, thereby aligning a latent image formed by emitting of the first light emitting element, a latent image formed by emitting of the second light emitting element, and a latent image formed by emitting of the fourth light emitting element in the first direction on the latent image carrier;

a drive source; and a gear that transmits driving power from the drive source to the photoconductor drum, wherein a distance between the first and second imaging optical systems in the second direction is longer than a distance obtained by multiplying a velocity variation period of the photoconductor drum by an average velocity of the photoconductor drum.

2. The image forming device according to claim 1, wherein the control section controls an emission time interval between the emission timing of the first emitting element and an emission timing of the third light emitting element based on the detection result of the detection section, thereby aligning the latent image formed by emitting of the first light emitting element, the latent image formed by emitting of the second light emitting element, and a latent image formed by emitting of the third light emitting element in the first direction on the latent image carrier.

3. The image forming device according to claim 1, wherein the velocity variation period is obtained from an inverse of a value obtained by multiplying a number of rotations per unit time of the photoconductor drum by a number of teeth of the gear.

4. The image forming device according to claim 1, wherein the gear is connected to the photoconductor drum via a coupling.

5. The image forming device according to claim 1, wherein the gear and the photoconductor drum are connected integrally.

6. The image forming device according to claim 1, wherein a distance in the second direction of the latent image carrier between the latent image formed by emitting of the first light emitting element and the latent image formed by emitting of the fourth light emitting element when the first and fourth emitting elements emit at the same time is a value obtained by multiplying a pixel-to-pixel distance in pixels in the second direction by an integral number.

7. The image forming device according to claim 6, wherein the pixel-to-pixel distance in the second direction is shorter than a pixel-to-pixel distance in the pixels in the first direction.

8. The image forming device according to claim 7, wherein the control section controls the emission timing of light emitting elements using PWM control.

* * * * *